US008509670B2

(12) United States Patent
Hatakeyama et al.

(10) Patent No.: US 8,509,670 B2
(45) Date of Patent: Aug. 13, 2013

(54) IMAGE BEARING MEMBER TO WHICH BORON NITRIDE IS ATTACHED

(75) Inventors: Kumiko Hatakeyama, Sagamihara (JP); Toshiyuki Kabata, Yokohama (JP); Hiroshi Nakai, Yokohama (JP)

(73) Assignee: Ricoh Company, Ltd, Tokyo (JP)

( * ) Notice: Subject to any disclaimer, the term of this patent is extended or adjusted under 35 U.S.C. 154(b) by 323 days.

(21) Appl. No.: 12/900,855

(22) Filed: Oct. 8, 2010

(65) Prior Publication Data

US 2011/0085824 A1 Apr. 14, 2011

(30) Foreign Application Priority Data

Oct. 14, 2009 (JP) ..... 2009-237595
Nov. 30, 2009 (JP) ..... 2009-271869
Jul. 23, 2010 (JP) ..... 2010-166209
Sep. 2, 2010 (JP) ..... 2010-196693

(51) Int. Cl.
*G03G 21/00* (2006.01)

(52) U.S. Cl.
USPC ..... 399/346; 399/350

(58) Field of Classification Search
USPC ..... 399/346, 350, 351, 159
See application file for complete search history.

(56) References Cited

U.S. PATENT DOCUMENTS

| | | | | |
|---|---|---|---|---|
| 7,103,301 | B2 | 9/2006 | Watanabe et al. | |
| 7,218,879 | B2 | 5/2007 | Enoki et al. | |
| 7,251,438 | B2 | 7/2007 | Watanabe et al. | |
| 7,383,013 | B2 | 6/2008 | Watanabe et al. | |
| 7,995,931 | B2 * | 8/2011 | Inami et al. | |
| 2006/0216624 | A1 * | 9/2006 | Ueda et al. | |
| 2009/0232541 | A1 * | 9/2009 | Hatakeyama et al. | 399/159 |
| 2009/0279930 | A1 | 11/2009 | Kabata et al. | |
| 2010/0034570 | A1 * | 2/2010 | Hatakeyama et al. | 399/346 |
| 2010/0178073 | A1 | 7/2010 | Kabata et al. | |

FOREIGN PATENT DOCUMENTS

| | | |
|---|---|---|
| JP | 52-36016 | 3/1977 |
| JP | 8-320641 | 12/1996 |
| JP | 2004-279518 | 10/2004 |
| JP | 2005-91799 | 4/2005 |
| JP | 2005-215042 | 8/2005 |
| JP | 2007-3694 | 1/2007 |
| JP | 2008-134467 | 6/2008 |
| JP | 4443837 | 1/2010 |

* cited by examiner

*Primary Examiner* — Susan Lee
(74) *Attorney, Agent, or Firm* — Oblon, Spivak, McClelland, Maier & Neustadt, L.L.P.

(57) ABSTRACT

An image bearing member including an electroconductive substrate, a photosensitive layer provided overlying the electroconductive substrate, an optional layer overlying the photosensitive layer, and boron nitride attached to at least part of the surface of an outermost layer.

7 Claims, 3 Drawing Sheets

IMAGE BEARING MEMBER TO WHICH BORON NITRIDE IS ATTACHED

BACKGROUND OF THE INVENTION

1. Field of the Invention

The present invention relates to an image bearing member.

2. Discussion of the Background

In an image forming apparatus using electrophotography, images are formed by processes of charging, irradiation, development, transfer etc. applied to an image bearing member, for example, a photoreceptor.

Corona products produced in the charging process that remain on the surface of the image bearing member, and toner or its component remaining on the surface of the image bearing member after the transfer process, are removed by a cleaning process.

For the cleaning process, a cleaning system having a cleaning blade such as a rubber blade is typically used because such a cleaning blade has a simple and cost-saving configuration with good cleaning properties. However, since the cleaning blade is pressed against the image bearing member to remove residual material on the surface thereof, the cleaning blade is under heavy stress including mechanical stress caused by friction between the surface of the image bearing member and the cleaning blade. This leads to attrition of the cleaning blade and the surface layer of the image bearing member particularly in the case of an organic photoconductor, which shortens the working life of both the cleaning blade and the organic photoconductor.

In addition, the toner used in image formation is reduced in particulate size to satisfy demand for improved image quality. In the case of an image forming apparatus using a toner having a small particle diameter, the proportion of residual toner that slips through between the edge portion of the cleaning blade and the surface of the image bearing member tends to increase. This is particularly true when dimensional accuracy and/or assembly accuracy are not sufficient or the cleaning blade partially vibrates, which degrades the quality of output images.

To deal with this problem, for example, a method is employed in which a lubricant (i.e., protective agent) is powdered by rotating an applicator brush that contacts the lubricant (typically in solid form) and supplied to an image bearing member, and a film of the lubricant is formed thereon by the cleaning blade.

Because of the lubricant present between the image bearing member and the cleaning blade, the cleaning blade and the surface of the image bearing member are protected. Therefore, abrasion of the image bearing member and deterioration of the blade caused by friction between the blade and the image bearing member is reduced. In addition, the deterioration of the image bearing member caused by discharging energy when the image bearing member is discharged is reduced.

In addition, the protective agent applied to the surface of an image bearing member increases the lubricant property thereof, thereby reducing the partial vibration of the cleaning blade. Therefore, the amount of toner that slips through beneath the cleaning blade in the cleaning process is reduced.

However, in the above-described method, the lubricant is supplied to the image bearing member while the image bearing member is in rotation for image formation. Therefore, unless a film of the lubricant is preliminarily applied to the surface of the image bearing member prior to image formation, the image bearing member has no lubricant on its surface before image formation. That is, the lubricant property between the image bearing member and the cleaning blade is poor before image formation starts, thereby degrading both the blade and the image bearing member.

In addition, color image forming apparatuses have come into wide use of late and market demand for quality images is increasing. Thus, the most common charging system currently employed uses a charging roller applying an AC voltage in which an AC voltage is overlapped with a DC voltage to the surface of the image bearing member. Furthermore, an AC charging system using a charging roller satisfies the need for size reduction, produces smaller amounts of oxidized gases such as ozone and $NO_x$, and naturally is expected to be widely used in the future.

However, a drawback of the above-described AC charging system is that the image bearing member is charged with repetitive positive and negative discharging several hundreds to several thousands of times per second depending on frequency when the AC charging system is used. Thus, the image bearing member is easily and heavily damaged in the AC charging system in comparison with a DC charging system in which an image bearing member is charged with positive discharging only once while the image bearing member passes through the charging device. Therefore, protecting the image bearing member from the damage caused by charging is demanded of the AC charging system.

For the foregoing reason, there is a strong need for an improved cleaning blade effective to protect the image bearing member from AC charging, apply a large amount of a lubricant to an image bearing member, and remove toner having a small particle diameter. However, taken together, these requirements, when satisfied, lead to acceleration of deterioration of the cleaning blade.

In addition, if the brush is strongly pressed against a protective agent to supply it in a large amount, the protective agent having a large particle diameter is supplied to an image bearing member. Therefore, the protective agent easily slips through a cleaning blade and the protective agent tends to be not uniformly covered by the protective agent.

In addition, toner that has slipped through the cleaning blade and a lubricant such as metal soap scatter and easily attach to the charging roller, thereby causing bad charging. Therefore, protecting the charging roller from contamination also creates a problem.

Typically, the working life of the image bearing member is long, but the charging roller and the cleaning blade tend wear out relatively quickly and are replaced when they deteriorate. However, in terms of concerns for the environment, there is a strong need for prolongation of the working life of each member such as the charging roller, the cleaning blade, and the image bearing member. Therefore, technologies are demanded that prevent deterioration and contamination of each of these members.

Thus, for example, use of metal soap as the protective agent leads to metal soap powder being supplied to an image bearing member, passing through the cleaning blade, scattering to the charging roller and attaching thereto, causing poor charging. However, mixing an inorganic lubricant such as boron nitride (BN) and a metal soap instead of just the metal soap alone is known to be effective to solve this problem.

A lubricant mixture in which an inorganic lubricant is mixed with metal soap and solidified into a bar can be used instead of the typical lubricant (i.e., zinc stearate).

For example, JOP 2008-134467-A describes using a mixture in which boron nitride (BN) is blended with metal soap as the protective gent instead of metal soap. In this case, mica or boron nitride is blended with metal soap (zinc stearate) to reduce scattering of the metal soap to the charging roller and abrasion of the cleaning blade for an extended period of time.

However, since boron nitride (BN) is extremely expensive, there is a trade-off between the cost and the effect when using boron nitride.

For these reasons, the present inventors recognize that a need exists for an image bearing member and an image forming apparatus that produce quality images for an extended period of time, and provides an extremely long working life with less frequent replacement to other members such as the charging roller, the cleaning blade, and the protective agent applicator blade arranged around the image bearing member.

SUMMARY OF THE INVENTION

Accordingly, an object of the present invention is to provide an image bearing member and an image forming apparatus that produce quality images for an extended period of time, and provides an extremely long working life with less frequent replacement to other members such as a charging roller, a cleaning blade, and a protective agent applicator blade arranged around the image bearing member.

Briefly, this object and other objects of the present invention as hereinafter described will become more readily apparent and can be attained, either individually or in combination thereof, by an image bearing member including an electroconductive substrate, a photosensitive layer provided overlying the electroconductive substrate, an optional layer overlying the photosensitive layer, and boron nitride attached to at least part of the surface of an outermost layer.

It is preferred that the image bearing member has a drum form and the amount of the boron nitride attached to the surface is from 0.002 to 1 mg/cm in an accumulation amount in the circumferential direction of the image bearing member for each 1 can of width in a longitudinal direction of the image bearing member.

It is still further preferred that, in the image bearing member mentioned above, the outermost layer includes a filler.

It is still further preferred that, in the image bearing member mentioned above, metal soap is attached to the surface of the image bearing member.

It is still further preferred that, in the image bearing member mentioned above, the weight ratio of the attachment amount of the boron nitride to the total attachment amount of the metal soap and the boron nitride is 10% by weight or greater.

As another aspect of the present invention, an image forming apparatus is provided that includes the image bearing member described above, a charging device that charges the surface of the image bearing member, an irradiator that irradiates the surface of the image bearing member to form the latent electrostatic image thereon, a development device that develops the latent electrostatic image with a development agent containing toner to form a visualized image, a transfer device that transfers the visualized image to a recording medium, and a cleaning device that removes the toner remaining on the surface of the image bearing member.

It is preferred that the image forming apparatus further includes a protective layer formation device that imparts a protective agent to the image bearing member to form a protective layer on the image bearing member.

It is still further preferred that, in the image forming apparatus mentioned above, the protective agent contains metal soap and boron nitride, and the content of the boron nitride is 30% by weight or less based on the total content of the metal soap and the boron nitride.

It is still further preferred that, in the image forming apparatus mentioned above, the protective agent is provided in the form of a bar.

It is still further preferred that, in the image forming apparatus described above, the protective layer formation device includes a protective agent applicator blade.

It is still further preferred that, in the image forming apparatus mentioned above, the protective agent applicator blade contacts the surface of the image bearing member against the rotation direction of the image bearing member.

It is still further preferred that, in the image forming apparatus mentioned above, the protection agent application blade contacts the surface of the image bearing member at an obtuse angle thereto.

As another aspect of the present invention, another image forming apparatus is provided that includes an image bearing member that bears a latent electrostatic image, a charging device that charges a surface of the image bearing member, an irradiator that irradiates the surface of the image bearing member to form the latent electrostatic image thereon, a development device that develops the latent electrostatic image with a development agent containing a toner to form a visualized image, a transfer device that transfers the visualized image to a recording medium, a cleaning device having a cleaning blade having a front end that removes the toner remaining on the surface of the image bearing member, with a lubricant containing boron nitride being attached to the front end, and a protective agent supplying device that supplies a protective agent containing metal soap to the cleaned surface of the image baring member.

It is preferred that, in the image forming apparatus mentioned above, the lubricant contains metal soap.

It is still further preferred that, in the image forming apparatus mentioned above, the weight ratio of the boron nitride to the total weight of the boron nitride and the metal soap is 10% or greater.

It is still further preferred that, in the image forming apparatus mentioned above, the average attachment amount of the boron nitride in an area where the lubricant is attached is from 0.01 to 1 mg/cm$^2$.

It is still further preferred that, in the image forming apparatus mentioned above, the front end of the cleaning blade contacts the image bearing against the rotation direction thereof.

It is still further preferred that, in the image forming apparatus mentioned above, the front end of the cleaning blade has an obtuse angle while in contact with the image bearing member.

It is still further preferred that, in the image forming apparatus mentioned above, the protective agent contains boron nitride and the weight ratio of the boron nitride in the protective agent to the total weight of the boron nitride in the protective agent and the metal soap in the protective agent is 30% or less.

It is still further preferred that the image forming apparatus mentioned above further includes a second blade having a front end that contacts the surface of the image bearing member and regulates a layer thickness of the protective agent supplied to the image bearing member, and a lubricant containing boron nitride is attached to the front end of the second blade, These and other objects, features and advantages of the present invention will become apparent upon consideration of the following description of the preferred embodiments of the present invention (taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
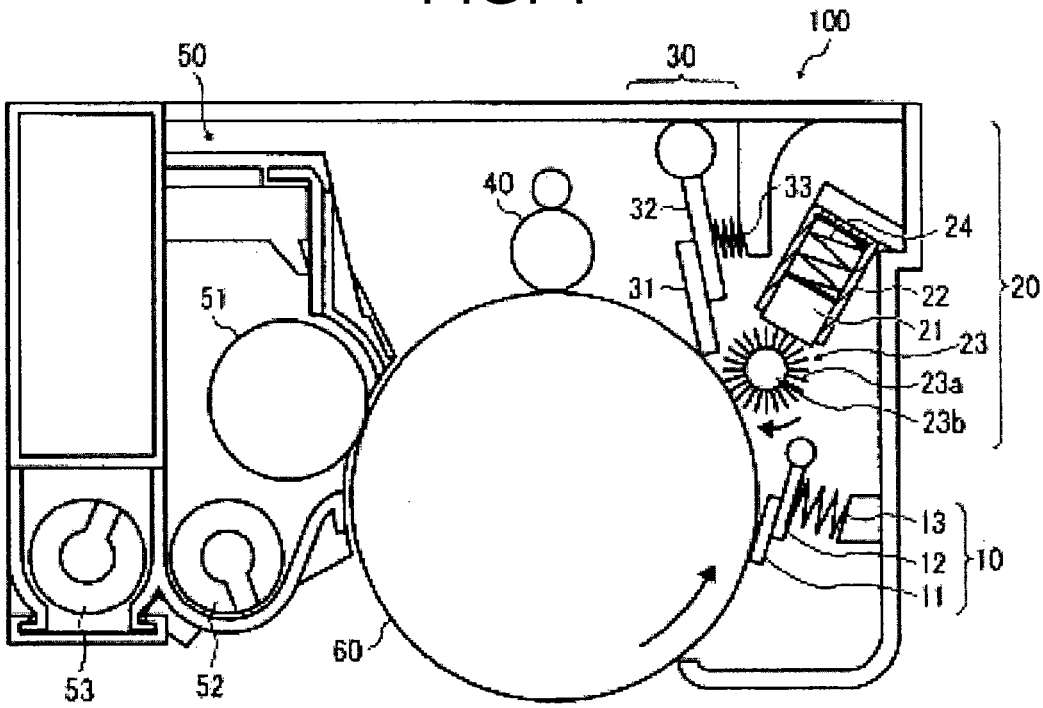
FIG. 1 is a schematic diagram illustrating an example of the process cartridge of the present disclosure.

With regard to an image forming apparatus using an image bearing member, the present inventors have made an intensive study on how to make a system that provides a longer working life for the image bearing member itself and all the members arranged around the image bearing member such as an cleaning blade, a charging roller, and an intermediate transfer belt. The present inventor have reached a conclusion that decreasing the friction between the cleaning blade and the image bearing member leads to prolongation of the working lives of the cleaning blade and the image bearing member. Thus, the present inventor have made a further study on how to reduce the friction between the cleaning blade and the image bearing member First, to decrease the friction, a method is known in which metal soap is incessantly supplied and applied to the surface of an image bearing member. Although metal soap is successful in prolongation of the working life of the image bearing member, degraded metal soap accelerates degrading the cleaning blade. Therefore, no suitable method has been found to elongate the working life of both the image bearing member and the cleaning member by using only metal soap.

Then, the present inventors have studied about whether there is any lubricant that decreases the friction between the image bearing member and the cleaning blade instead of metal soap or increasing the amount thereof.

To be specific, a lubricant such as a silicone resin, an acrylic resin, an ethylene acrylate resin, or a fluorine containing resin, or a mixture thereof is attached to the cleaning blade and images are formed while also applying metal soap continuously to the image bearing member. However, although abrasion of the cleaning blade and the image bearing member at the initial stage is successfully limited by attaching these lubricants to the cleaning blade and resultantly the working life thereof is slightly prolonged, the working life of each of the image bearing member, the cleaning blade, the charging roller, and the intermediate transfer belt is not dramatically prolonged. In addition, when the metal soap is applied in a large amount while continuing image formation, the minute vibration of the cleaning blade is hardly reduced. This minute vibration causes degradation of the cleaning blade. In addition, the lubricant easily slips through the cleaning blade if the cleaning blade vibrates. The materials that have slipped through scatter and attach to the charging roller, resulting in poor charging. Particularly, in a low temperature environment, abnormal images having streaks due to poor charging is frequently produced, which is a serious problem.

In addition, when the amount or the mixing ratio of the lubricants such as a silicone resin, an acrylic resin, an ethylene acrylate resin, and a fluorine containing resin attached to the cleaning blade is changed, degradation of the cleaning blade is lessened in comparison with when the lubricant is not attached, but the effect by changing the amount or the mixing ratio is small.

Therefore, the working life of the cleaning blade is not dramatically prolonged by attaching he lubricants such as a silicone resin, an acrylic resin, an ethylene acrylate resin, and a fluorine containing resin to the cleaning blade because the cleaning blade deteriorates in an extended period of time as the number of output images increases. Particularly, when the charging roller to which poor charging occurs is observed with a scanning electron microscope (SEM), extraneous matters attached to the charging roller is found to be metal soap.

On the other hand, when images are formed with incessant supply and application of metal soap and boron nitride to the surface of an image bearing member, the working life of the cleaning blade is prolonged and slipping through of toner and metal soap is prevented, resulting in no occurrence of poor charging.

Therefore, it is found that the working life of all the members of the image bearing member, the cleaning blade, and the charging roller is prolonged by applying metal soap and boron nitride to the surface of the image bearing member.

However, boron nitride is expensive. Therefore, another intensive study has been made to find a way to prolong the working life of each member even with a small amount of boron nitride.

As a result, it is found that when boron nitride is incessantly supplied to the surface of an image bearing member, the amount of boron nitride increases but most of it is not fixed on the surface of the image bearing member but consumed with toner for development or discharging.

However, a certain amount of boron nitride is still attached to the cleaning blade and the attached boron nitride is not detached from the cleaning blade and remains present between the cleaning blade and the image bearing member.

Therefore, since the minute shaking of the cleaning blade is reduced and toner and metal soap are prevented from slipping through the cleaning blade, thereby causing no poor charging.

In addition, the present inventors have also found that, when images are produced using an image bearing member to which powder of boron nitride (BN) is preliminarily applied, the powder of BN preliminarily applied to the image bearing member is transferred to the portion between the image bearing member and the cleaning blade as the image bearing member rotates, and held there for an extended period of time, thereby contributing to providing an extremely long working life to each member of the image bearing member, the cleaning blade, the charging roller, etc.

Furthermore, similar to the case in which powder of BN is incessantly supplied to the surface of an image bearing member, the powder applied to the image bearing member before use is hardly fixed thereon.

Accordingly, the present inventor have found that applying BN to an image bearing member before starting image formation is good enough to obtain the effect of BN and there is no necessity to supply BN to the image bearing member incessantly.

Furthermore, it is found that when boron nitride is preliminarily attached to the cleaning blade, boron nitride contributes to prolongation of the working life of each of the image bearing member, the cleaning blade, and the charging roller and thus boron nitride is not necessarily supplied to the surface of the image bearing member incessantly.

Image Bearing Member

In the present disclosure, the image bearing member has at least an electroconductive substrate, a photosensitive layer provided overlying the electroconductive substrate, and an optional layer overlying the photosensitive layer. In addition, boron nitride is attached to at least part of the surface of the outermost layer on the side of the photosensitive layer. The photosensitive layer or the optional layer such as a surface layer can be the outermost layer.

The image bearing member before use represents that the image bearing member has never been used for image formation.

Basically, the image bearing member contained in an image forming apparatus or a process cartridge after factory shipment that has never been used for image formation has boron nitride (BN) attached to at least part of the surface of the image bearing member.

In addition, an image bearing member newly assembled or cleaned when a field engineer or a user maintains or cleans an image forming apparatus is also included in this scope.

Furthermore, the image bearing member before use that has boron nitride attached to at least part of its surface means the powder of boron nitride contacts the surface of the image bearing member and is also embedded in metal soap.

Boron nitride is considered to improve the lubricant property between the image bearing member and the cleaning blade and thus reduce minute vibration of the cleaning blade. This makes the posture of the cleaning blade stable, which leads to reduction of the production of abnormal images having streaks ascribable to metal soap powder that has slipped through the cleaning blade and attached to the charging roller.

In addition, attrition of the cleaning blade is restrained by the reduction of the vibration of the cleaning blade. Therefore, it is sufficient to have boron nitride (BN) only on the portion where an image bearing member and a cleaning blade meet.

In the present disclosure, the image bearing member before use has preferably metal soap and boron nitride attached to at least part of its surface.

Since toner is not present on an image bearing member which has never been used for image formation, the abrasion force between the image bearing member and the cleaning blade tends to be particularly strong. However, when a combination of boron nitride and metal soap is attached to the image bearing member before use, the lubricant property between the image bearing member and the cleaning blade is improved in comparison with the case in which boron nitride is solely used.

However, since the metal soap is detached from the blade over time, the boron nitride that is hardly detached from the cleaning blade is effective to maintain and improve the lubricant property.

In addition, toner contributes to improvement of the lubricant property between the image bearing member and the cleaning blade over time. Therefore, even when metal soap is detached from the cleaning blade, the lubricant property is maintained good.

Furthermore, a lubricant material other than metal soap can be suitably mixed with boron nitride and a mixture of boron nitride and toner can be also used.

Lubricant materials can be attached to an image bearing member alone or in combination.

Methods of attaching boron nitride, or a mixture of boron nitride and metal soap to an image bearing member are described next.

Application of boron nitride or a mixture of boron nitride and metal soap to the image bearing member is as follows: Wrap boron nitride or the mixture by cloth or gauze, and beat the cloth or gauze to an image bearing member to attach boron nitride or the mixture thereto; Operate only a protective layer formation device to attach boron nitride or the mixture to the image bearing member assembled in an image forming apparatus by using a protective agent bar, a protective agent applicator, a blade in a state in which images are not formed; or Apply boron nitride or the mixture to the image bearing member with a brush or sponge (for example, powder puff).

The protective layer formation device is described later.

It is preferable that powder of boron nitride or a mixture of boron nitride and metal soap is evenly attached to the surface of an image bearing member to limit deterioration thereof.

For example, when the image bearing member described above has a drum form, boron nitride attached to the image bearing drum is held on the cleaning blade by the rotation of the drum as described above. Therefore, it is preferable that the accumulated amount of boron nitride along the image bearing member does not vary with regard to the longitudinal direction.

Variance of the attachment amount of boron nitride in the longitudinal direction of the image bearing drum is represented by the following relationship 1. The amounts of boron nitride attached to the image bearing drum are calculated at positions along the longitudinal direction and the average amount is calculated. The, the average is subtracted from the actual amount value to obtain the absolute value followed by division by the average. Then, how far from the average can be calculated.

$$\text{Variance}(\%)=(|\text{Actual value}-\text{Average}|)/\text{Average}\times 100 \quad \text{Relationship 1}$$

The variance of the attached amount of boron nitride in the longitudinal direction is preferably 30% or less.

When the variance of the attached amount of boron nitride in the longitudinal direction is too large, deterioration state of the image bearing member varies depending on portions about the attached amount of boron nitride, which may affect the quality of output images.

A method of applying boron nitride to the image bearing drum along the circumferential direction to accumulate boron nitride thereon evenly with regard to the longitudinal direction includes, for example, dipping the image bearing drum in a solution in which boron nitride or a mixture of boron nitride and metal soap is dispersed in water, and pulling it out therefrom. Subsequent to dipping of the image bearing drum, the image bearing drum is dried.

Basically, boron nitride or a mixture of boron nitride and metal soap is enveloped in cloth or gauze having a fine opening, and the cloth or gauze is beaten to the image bearing drum with a constant force to evenly apply boron nitride or the mixture of boron nitride and metal soap to the image bearing drum.

Boron nitride attached to an image bearing member preferably has a primary particle or secondary particle size of 10 μm or less, and more preferably from 2 to 8 μm.

In addition, the particle diameter of the metal soap attached to the image bearing member is preferably from 0.1 to several μm.

The amount of boron nitride preliminarily attached to the surface of an image bearing member before use is preferably from 0.002 to 1 mg/cm, and more preferably from 0.003 to 0.3 mg/cm.

As described above, since boron nitride attached to the image bearing drum is held on the cleaning blade by the rotation of the image bearing drum, the amount of boron attached to the image bearing is regulated only by the accumulated amount of boron nitride along the circumferential direction of the image bearing drum. The value specified above represents the accumulated amount of boron nitride along the circumferential direction with each 1 can of width in a longitudinal direction of the image bearing member.

When the attachment amount is too large, image blur tends to occur. In addition, considering the cost of boron nitride, the smaller amount of boron nitride, the better.

By contrast, when the attachment amount is too small, boron nitride may not demonstrate its effect.

The amount of boron nitride attached to the surface of an image bearing member is strictly evaluated by ICP optical emission spectrochemical analysis.

The procedure of the ICP optical emission spectrochemical analysis is to: peel a reed shape with a size of 1 to 5 can in the longitudinal direction for one round along the circumferential direction of the photosensitive layer from an image bearing member; place the peeled reed shape photosensitive layer in a container containing nitric acid and sulfuric acid and airtightly stop up the container; irradiate the container with microwave to heat and decompose the strip of photosensitive layer followed by constant volume by ultrapure water to obtain a sample solution; and determine quantity of boron nitride in the sample solution by an ICP optical emission spectrochemical analyzer.

The attachment of boron nitride on the image bearing member is obtained by conversion of the quantity determination result of boron nitride.

Once the attachment amount (i.e., total weight) of boron nitride is calculated, the total weight is divided by the length (i.e., the size of the reed shape peeled off from the photosensitive layer) along the longitudinal direction. Using this calculated value, the attachment amount (mg/cm) of boron nitride per unit of length is obtained.

In addition, the attachment amount of boron nitride on the image bearing member is basically weighed by a precision balance.

One specific process of weighing the attachment amount by precision balance is as follows: wipe off boron nitride or a mixture of boron nitride and metal soap on an image bearing member with a microwipe; and calculate the attachment amount of boron nitride from the weight difference between before and after wiping off the surface of the image bearing member.

In the case of the mixture of boron nitride and metal soap, the attachment amount of boron nitride is calculated using the mixing ratio.

The total weight is divided by the length along the longitudinal direction and the attachment amount (mg/cm) of boron nitride per unit of length is obtained.

The area of wiping off the image bearing member by the microwipe is inside where the blade contacts the image bearing member. The attachment amount of boron nitride attached to the image bearing member outside where the blade contacts the image bearing member is not calculated.

Any area in the longitudinal direction can be wiped off from the image bearing member.

If that is the case, the area to be wiped off is one round of the image bearing member in the circumferential direction and the attachment amount (mg/cm) of boron nitride per unit of length is obtained by using the value obtained by division by the length of the arbitrary area in the longitudinal direction.

The amount of boron nitride preliminarily attached to the surface of an image bearing member before use is preferably 10% by weight and more, more preferably 30 to 90% by weight, and furthermore preferably from 50 to 80% by weight based on the total attachment amount of metal soap and boron nitride.

When the content of boron nitride is too small, boron nitride may not sustain the effect of improving the lubricant property between the cleaning blade and the image bearing member.

The content of boron nitride can be measured by, for example, ICP optical emission spectrochemical analysis, or FT-IR analysis.

The image bearing member for use in the image forming apparatus of the present disclosure includes an electroconductive substrate on which a photosensitive layer and other optional layers are provided.

The photosensitive layer is typified into a single layer type in which charge generation material and charge transport material are present in a mixed manner, a sequential layer accumulation type in which a charge transport layer is formed on a charge generation layer and a reverse layer accumulation type in which a charge generation layer is formed on a charge transport layer. In addition, an uppermost surface layer can be provided on the photosensitive layer to improve the properties such as the mechanical strength, anti-abrasion property, anti-gas property and cleaning property of the image bearing member.

Furthermore, an undercoating layer is provided between the photosensitive layer and the electroconductive substrate. In addition, an agent such as a plasticizer, an anti-oxidant and a leveling agent can be added in a suitable amount to each layer.

There is no specific limit to the selection of material for use in the electroconductive substrate as long as the material has a volume resistance of not greater than $1.0\times10^{10}$ Ω·cm. For example, there can be used plastic or paper having a film form or cylindrical form covered with a metal such as aluminum, nickel, chrome, nichrome, copper, gold, silver, and platinum, or a metal oxide such as tin oxide and indium oxide by depositing or sputtering. Also a board formed of aluminum, an aluminum alloy, nickel, and a stainless metal can be used. Further, a tube which is manufactured from the board mentioned above by a crafting technique such as extruding and extracting and surface-treatment such as cutting, super finishing and grinding is also usable.

The substrate having a drum form preferably has a diameter of from 20 to 150 mm, more preferably from 24 to 100 mm and particularly preferably from 28 to 70 mm. When the diameter of the drum is too small, physical arrangement of devices performing processes of charging, irradiation, development, transfer, cleaning, etc. around the image bearing member tends to be difficult. A diameter that is too large tends to result in increase in size of the image forming apparatus.

In particular, when an image forming apparatus of tandem type is used, a plurality of image bearing members is installed so that the diameter is preferably 70 mm at most and more preferably 60 mm at most.

In addition, as described in JP S52-36016-A, an endless nickel belt or endless stainless belt can be used as an electroconductive substrate.

The undercoating layer has a single layer structure or a laminar structure and can be formed of, for example, (1) mainly a resin, (2) mainly white pigment and a resin, or (3) oxidized metal film manufactured by chemically or electrochemically oxidizing the surface of the electroconductive substrate.

Among these, a mixture of white pigment and a resin is preferred.

Specific examples of the white pigments include, but are not limited to, metal oxides such as titanium oxide, aluminum oxide, zirconium oxide, and zinc oxide. Among these, titanium oxide is preferable in particular in terms of charge infusion prevention from the electroconductive substrate.

Specific examples of the resins include, but are not limited to, thermoplastic resins such as polyamide, polyvinylalcohol, casein, methylcellulose and thermocuring reins such as acryl, phenol, melamine, alkyd, unsaturated polyesters, and epoxy. These can be used alone or in combination.

There is no specific limit to the thickness of the undercoating layer. The undercoating layer preferably has a thickness of from 0.1 to 10 μm and more preferably from 0.1 to 5 μm.

Specific examples of the charge generation material for use in the photosensitive layer include, but are not limited to, azo pigments such as monoazo-based pigments, bisazo-based pigments, trisazo-based pigments, and tetrakisazo-based pigments; organic-based pigments and dyes such as triaryl methane-based dye, thiazine-based dye, oxazine-based dye, xanthene-based dye, cyanine-based dye, styryl-based dye, pyrylium-based dye, quinacridone-based pigment, indigo-based pigment, perylene-based pigment, polycyclic quinone-based pigment, bisbenzimidazole-based pigment, indanthrone-based pigment, squarylium-based pigment, and phthalocyanine-based pigment; and inorganic material such as selenium, selenium-arsenic, selenium-tellurium, cadmium-sulfide; zinc oxide; titanium oxide, and amorphous silicone. These can be used alone or in combination.

Specific examples of the charge transport material for use in the photosensitive layer include, but are not limited to, anthracene derivatives, pyrene derivatives, carbazole derivatives, tetrazole derivatives, metallocene derivatives, phenothiazine derivatives, pyrazolline derivatives, hydrazone derivatives, styryl derivatives, styryl hydrazone derivatives, enamine compounds, butadiene compounds, distyryl compounds, oxazole compounds, oxadiazole compounds, thiazole compounds, imidazole compounds, triphenyl amine derivatives, phenylene diamine derivatives, aminostilbene derivatives, and triphenyl amine derivatives. These can be used alone or in combination.

Thermoplastic resins, thermocuring resins, photocuring resins and photoconductive resins which are known and insulative can be used as the binder resins for use in forming the photosensitive layer.

Specific examples of such resins include, but are not limited to, thermoplastic resins such as polyvinyl chloride, polyvinylidene chloride, copolymers of vinyl chloride and vinyl acetate, copolymers of vinyl chloride-vinyl acetate-maleic anhydride, copolymers of ethylene-vinyl acetate, polyvinyl butyral, polyvinyl acetal, polyester, phenoxy resins, (meth) acrylic resin, polystyrene, polycarbonate, polyarylate, polysulfone, polyether sulfone, and ABS resins; thermocuring resins such as phenol resins, epoxy resins, urethane resins, melamine resins, isocyanate resins, alkyd resins, silicone resins, and thermocyring acryl resins, polyvinyl carbazole, polyvinyl anthracene and polyvinyl pyrene. These can be used alone or in combination.

Specific examples of the anti-oxidants include, but are not limited to, phenol-based compounds, paraphenylene diamines, organic sulfur compounds, and organic phosphorus compounds.

Specific examples of the phenol-based compounds include, but are not limited to, 2,6-di-t-butyl-p-cresol, butylated hydroxyanisol, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, and tocopherols.

Specific examples of paraphenylene diamines include, but are not limited to, N-phenyl-N'-isopropyl-p-phenylene diamine, N,N'-di-sec-butyl-p-phenylene diamine, N-phenyl-N-sec-butyl-p-phenylene diamine, N,N'-di-isopropyl-p-phenylene diamine, and N,N'-dimethyl-N,N'-di-t-butyl-p-phenylene diamine.

Specific examples of hydroquinones include, but are not limited to, 2,5-di-t-octyl hydroquinone, 2,6-didodecyl hydroquinone, 2-dodecyl hydroquinone, 2-dodecyl-5-chloro hydroquinone, 2-t-octyl-5-methyl hydroquinone, and 2-(2-octadecenyl)-5-methyl hydroquinone.

Specific examples of the organic sulfur compounds include, but are not limited to, dilauryl-3,3-thiodipropionate, distearyl-3,3'-thiodipropionate, and ditetradecyle-3,3'-thiodipropionate.

Specific examples of the organic phosphorous compounds include, but are not limited to, triphenyl phosphine, tri(nonylphenyl)phosphine, tri(dinonylphenyl)phosphine, tricresyl phosphine, and tri(2,4-dibutylphenoxy)phosphine.

These compounds are known as anti-oxidizing agents for rubbers, plastics, and oils, and commercial products thereof are readily available.

The addition amount of the anti-oxidants is preferably from 0.01 to 10% by weight based on the total amount of a layer to which the anti-oxidant is added.

Specific examples of the plasticizers include, but are not limited to, known resins such as dibutylphthalate and dioctyl phthalate.

The content of the plasticizers is preferably 30% by weight based on 100 parts by weight of the binder resin.

In addition, the photosensitive layer optionally contains leveling agents.

Specific examples thereof include, but are not limited to, dimethyl silicone oils and methyl phenyl silicone oils, and polymers or oligomers including a perfluoroalkyl group in their side chain.

The content thereof is suitably from 0 to 1 part by weight based on 100 parts by weight of the binder resin.

The uppermost surface layer of the image bearing member is provided to improve the mechanical strength, abrasion resistance property, gas resistance property, cleaning property of the image bearing member.

The uppermost surface layer contains a resin having a mechanical strength greater than the photosensitive layer, and a filler with optional components.

Resins for use in the uppermost surface layer are transparent to the writing light for image formation, and preferably excellent in insulation property, mechanical strength, and adhesiveness. Specific examples of such resins for use in the uppermost surface layer include, but are not limited to, ABS resins, ACS resins, olefin-vinyl monomer copolymers, chlorinated polyether, aryl resins, phenolic resins, polyacetal, polyamide, polyamideimide, polyallylsulfone, polybutylene, polybutylene terephthalate, polycarbonate, polyethersulfone, polyethylene, polyethylene terephthalate, polyimide, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins.

These polymers can be thermoplastic resins. Also, thermocuring resins can be manufactured from the resins by cross-linking with a cross-linking agent having, for example, an acryloyloxy group, a carboxyl group, hydroxyl group, and amino group having multiple functional groups to improve the mechanical strength of the resins. Thereby, the mechanical strength of the uppermost surface layer increases and the attrition of the image bearing member due to friction with a cleaning blade can be significantly reduced.

When a filler (particulate) is dispersed in the uppermost surface layer, the cleaning blade easily deteriorates. Therefore, application of boron nitride to the image bearing member prior to its use for image formation is effective.

In addition, when a protective agent such as metal soap is attached to an image bearing member, if a filler is present on the uppermost surface layer thereof, an even protective layer film of metal soap, etc. is hardly formed. However, if boron nitride is present on the cleaning blade before image formation starts, the shaking of the cleaning blade is prevented, and thus the posture thereof is stabilized so that a uniform film is easily formed even when a filler is present.

There is no specific limit to the selection of filler. Specific examples thereof include, but are not limited to, metal particulates, or particulates of metal oxides.

Specific examples of the metal oxides include, but are not limited to, alumina, titanium oxide, tin oxide, potassium titanate, $TiO_2$, TiN, zinc oxide, indium oxide, and anthimony oxide.

Fluorine resins such as polytetrafluoroethylene, silicone resins, or a mixture in which inorganic material is dispersed in these resins can be added to improve the anti-abrasion property.

Among these, alumina is particularly preferred.

The content of the filler in the uppermost surface layer is preferably from 5 to 50% by weight, and more preferably from 10 to 30% by weight.

When the content of the filler is too large, a rise in the residual voltage, or deterioration of transparency of the uppermost surface layer to the writing light easily occur. When the content of the filler is too small, the abrasion property may not be sufficiently improved.

The uppermost surface layer preferably has a charge transport power.

Such a charge transport power to the uppermost surface layer is added by, for example, a method in which the polymer for us in the uppermost surface layer is mixed with the charge transport material specified above and a method in which a polymer having a charge transport power is used in the uppermost surface layer. The latter method is preferable because image bearing members manufactured by the latter method are highly sensitive while a voltage increase after irradiation is reduced and a residual voltage rise is also reduced.

Since the mechanical strength is significantly different between the photosensitive layer and the uppermost surface layer in general. Therefore, when the uppermost surface layer is abraded and disappears, the photosensitive layer also disappears soon. Therefore, the surface layer is desired to have a sufficient thickness, which is from 0.1 to 12 μm, preferably from 1 to 10 μm and more preferably from 2 to 8 μm.

When the thickness is too thin, the uppermost surface layer easily partially disappears by abrasion with the cleaning blade so that the abrasion of the image bearing member tends to progress from the disappeared portion. When the thickness is too thick, the photosensitivity tends to deteriorate, the voltage after irradiation tends to rise, and the residual voltage easily rises. Particularly, when a resin having a charge transport power is used, the cost of the resin tends to increase.

Image Forming Apparatus and Image Formation Method

The image forming apparatus of the present disclosure include the image bearing member described above, a charging device, an irradiation device, a development device, a transfer device, a cleaning device, a protective agent applicator, and a fixing device with optional devices.

A combination of the charging device and the irradiation device are also referred to as a latent electrostatic image formation device.

The image formation method related to the present disclosure includes a development process, an irradiation process, a development process, a transfer process, a cleaning process, a protective layer formation process, and a fixing process with optional processes.

A combination of the charging process and the irradiation process are also referred to as a latent electrostatic image formation process.

The image formation method related to the present disclosure is suitably performed by the image forming apparatus of the present disclosure. The charging process is performed by the charging device. The irradiation process is performed by the irradiation device. The development process is performed by the development device. The transfer process is performed by the transfer device. The cleaning process is performed by the cleaning device. The protective layer formation process is performed by the protective agent application device. The fixing process is suitably performed by the fixing device. The other optional processes are performed by the corresponding optional devices.

Charging Process and Charging Device

In the charging process, the charging device charges the surface of the image bearing member.

The charging system that charges the image bearing member using a charging device employed in the image forming apparatus of the present disclosure is a contact or vicinity type and preferably uses an AC charging system in which an AC voltage is overlapped with a DC voltage.

However, an image bearing member is charged with repetitive positive and negative discharging several hundreds to several thousands of times per second depending on frequency when the AC charging system is used. Thus, the image bearing member is easily and heavily damaged and degraded in the AC charging system in comparison with a DC charging system in which an image bearing member is charged with positive discharging only once while the image bearing member passes through the charging device. Therefore, boron nitride present between the cleaning blade and the image bearing member is effective to prevent deterioration of the image bearing member in comparison with the case in which a DC charging is used.

There is no specific limit to the charging device and any known charging device can be selected. For example, a known contact type charger having an electroconductive or semi-electroconductive roll, brush, film, rubber blade, etc. can be used.

Irradiation Process and Irradiation Device

The irradiation process is a process of forming latent electrostatic images on the surface of the charged image bearing member by irradiating the surface by the irradiation device.

There is no specific limit to the selection of the irradiation device.

Specific examples of such irradiation devices include, but are not limited to, any known irradiation devices such as a photocopying optical system, a rod lens array system, a laser optical system, and a liquid crystal shutter optical system.

As to the present disclosure, the rear side irradiation system in which an image bearing member is irradiated from the rear side can be also employed.

Development Process and Development Device

The development process is a process of forming a visualized image by developing the latent electrostatic image with toner or a development agent.

The visualized image is formed by, for example, developing the latent electrostatic image with toner or a development agent by the development device.

There is no specific limit to the development device as long as the development device develops latent electrostatic image with the toner or the development agent and any known development device can be used. For example, a development agent which accommodates and applies the toner or the development agent to the latent electrostatic image in a contact or non-contact manner is suitably used.

Toner

The toner has an average circularity of preferably from 0.93 to 1.00 and more preferably from 0.95 to 0.99, which is the average of the circularity SR represented by the following relationship 2.

The average circularity is an indicator of the concavo-convex degree of toner particles and toner particles having perfect sphere have an average circularity of 1.00. As the surface form of a toner particle becomes complex, the toner particle has a small average circularity value.

Circularity $SR$=(length of the circumference of a circle having the same area as that of the projected image of a toner particle)/(length of the circumference of the projected image of the toner particle) Relationship 2.

When the average circularity is from 0.93 to 1.00, the surface of the toner particle is smooth and the contact area between toner particles, and toner particles and the image bearing member is small so that the transferability of the toner is good.

In addition, since such toner particles do not have an angled portion, the stirring torque of the development agent in the development device is small and driving of the stirring is stable, which leads to no production of abnormal images.

In addition, there are no angular toner particles which form a dot. Therefore, when the toner particles are pressed against a recording medium during the transfer process, the pressure is uniformly applied to the toner particles, which prevents formation of hollow portions.

In addition, the toner particle is not angular, the toner particle itself hardly grinds, damages or abrades the surface of the image bearing member.

The circularity SR can be measured by a flow type particle image analyzer FPIA-1000 manufactured by SYSMEX CORPORATION.

The specific measuring procedure is as follows: a surfactant serving as a dispersant, preferably 0.1 to 0.5 ml of an alkylbenzenesulfonic acid salt is added to 100 to 150 ml of water from which solid impurities have been removed; 0.1 to 0.5 g of a sample to be measured is added the solution; the liquid suspension in which the sample is dispersed is subjected to an ultrasonic dispersion treatment for about 1 to 3 minutes such that the concentration of the particles is 3,000 to 10,000 particles per microlitter; and the form and particle size of the toner are measured using the instrument mentioned above.

The toner preferably has a weight average particle diameter (D4) of from 3 to 10 μm and more preferably from 4 to 8 μm.

In this range, the dot representability is excellent because toner particles have a particle diameter sufficiently small in comparison with a minute latent dot.

When the weight average particle diameter (D4) of the toner is too small, the transfer efficiency tends to deteriorate, or the cleaning property of the blade also tends to deteriorate. A weight average particle diameter of the toner that is too large tends to cause prevention of scattering of characters and lines to be difficult.

The toner has a ratio (D4/D1) of the weight average particle diameter (D4) to the number average particle diameter (D1) of preferably from 1.00 to 1.40 and more preferably from 1.00 to 1.30. As the ratio (D4/D1) approaches to 1, the particle size distribution of the toner becomes sharp. In the range of from 1.00 to 1.40, since selective development depending on the toner particle diameter does not occur, the image quality is stable.

In addition, since the particle size distribution of the toner is sharp, the distribution of the amount of friction charge is also sharp, which leads to prevention of occurrence of fogging.

Furthermore, when the toner particle is within a small range with regard to size, toner particles are orderly and densely arranged to develop an image so that the dot representability is excellent.

The weight average particle diameter (D4) and the particle size distribution of the toner particles can be measured by Coulter counter method, etc. Coulter Counter TA-II and Coulter Multisizer II (both are manufactured by Beckman Coulter, Inc.), etc. can be used as the measuring equipment in Coulter counter method.

First, add 0.1 to 5 ml of a surface active agent (preferably alkyl benzene sulfonate salt) as a dispersant to 100 to 150 ml of an electrolytic aqueous solution, which is about 1% NaCl aqueous solution prepared by using primary NaCl and pure water, for example, ISOTON-II (manufactured by Beckman Coulter, Inc.) can be used; Add 2 to 20 mg of a measuring sample; Conduct dispersion treatment for the electrolytic aqueous solution in which the measuring sample is dispersed for about 1 to 3 minutes by an ultrasonic dispersion device; Measure the volume and the number of the toner particles or the toner by the equipment mentioned above with an aperture of 100 μm; and calculate the volume distribution and the number distribution. The weight average particle diameter (D4) and the number average particle diameter (D1) of the toner can be obtained based on the obtained distribution.

The whole range is a particle diameter of from 2.00 to not greater than 40.30 μm and the number of the channels is 13. Each channel is: from 2.00 to not greater than 2.52 μm; from 2.52 to not greater than 3.17 μm; from 3.17 to not greater than 4.00 μm; from 4.00 to not greater than 5.04 μm; from 5.04 to not greater than 6.35 μm; from 6.35 to not greater than 8.00 μm; from 8.00 to not greater than 10.08 μm; from 10.08 to not greater than 12.70 μm; from 12.70 to not greater than 16.00 μm, from 16.00 to not greater than 20.20 μm; from 20.20 to not greater than 25.40 μm; from 25.40 to not greater than 32.00 μm; and from 32.00 to not greater than 40.30 μm.

The toner having such a significantly round form is preferably manufactured by cross-linking and/or elongating reaction of toner compositions containing a polyester prepolymer having a functional group having a nitrogen atom, a polyester, a coloring agent, and a releasing agent in an aqueous medium under the presence of resin particulates.

The toner prepared in this reaction can reduce the occurrence of hot offset by hardening the surface of the toner, which reduces contamination of the fixing device and its reflection on images.

An example of the polyester prepolymer having a functional group containing a nitrogen atom is a polyester prepolymer (A) having an isocyanate group and an example of the compound that elongates or cross-links with the prepolymer is an amine (B).

The polyester prepolymer (A) mentioned above can be prepared by, for example, reacting a polyester having an active hydrogen group, which is a polycondensation product of a polyol (1) and a polycarboxylic acid (2), with a polyisocyanate (3).

Specific examples of the active hydrogen group contained in the polyester mentioned above include, but are not limited to, hydroxyl groups (alcohol hydroxyl groups and phenol hydroxyl groups), amino groups, carboxylic groups, and mercarpto groups. Among these, alcohol hydroxyl groups are particularly preferred.

Examples of the polyol (1) are diol (1-1) and polyol (triol or higher polyol) (1-2) and using diol (1-1) or a mixture of diol (1-1) with a small amount of (1-2) is preferred.

Specific examples of the diols (1-1) include, but are not limited to, alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); and adducts of the bisphenols mentioned above with an alkylene oxide (e.g., ethylene oxide, propylene oxide and butylene oxide); etc.

Among these compounds, alkylene glycols having from 2 to 12 carbon atoms and adducts of a bisphenol with an alkylene oxide are preferable. More preferably, adducts of a bisphenol with an alkylene oxide, or mixtures of an adduct of a bisphenol with an alkylene oxide and an alkylene glycol having from 2 to 12 carbon atoms are used.

Specific examples of the polyols (TO) having three or more hydroxyl groups include, but are not limited to, glycerin, trimethylol ethane, trimethylol propane, pentaerythritol and sorbitol); polyphenols having three or more hydroxyl groups (trisphenol PA, phenol novolak and cresol novolak); and adducts of the polyphenols having three or more hydroxyl groups mentioned above with an alkylene oxide.

Suitable polycarboxylic acids (2) include, but are not limited to, dicarboxylic acids (2-1) and polycarboxylic acids (2-2) having three or more carboxyl groups. Among these, using the dicarboxylic acid (2-1) alone or a mixture of the dicarboxylic acid with a small amount of polycarboxylic acid (2-2) is preferred.

Specific examples of the dicarboxylic acids (2-1) include, but are not limited to, alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc.

Among these compounds, alkenylene dicarboxylic acids having from 4 to 20 carbon atoms and aromatic dicarboxylic acids having from 8 to 20 carbon atoms are particularly preferable.

Specific examples of the polycarboxylic acids (2-2) having three or more hydroxyl groups include, but are not limited to, aromatic polycarboxylic acids having from 9 to 20 carbon atoms (e.g., trimellitic acid and pyromellitic acid). In addition, compounds prepared by reaction between anhydrides or lower alkyl esters (e.g., methyl esters, ethyl esters or isopropyl esters) of the polycarboxylic acids mentioned above and polyols (1) can be used as the polycarboxylic acid (2).

A suitable mixing ratio (i.e., an equivalence ratio [OH]/[COOH]) of a polyol (1) to a polycarboxylic acid (2) is from 2/1 to 1/1, preferably from 1.5/1 to 1/1, and more preferably from 1.3/1 to 1.02/1.3.

Specific examples of the polyisocyanates (3) include, but are not limited to, aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisosycantes (e.g., tolylene diisocyanate and diphenylmethane diisocyanate); aromatic aliphatic diisocyanates (e.g., $\alpha,\alpha,\alpha',\alpha'$-tetramethyl xylylene diisocyanate); isocyanurates; blocked polyisocyanates in which the polyisocyanates mentioned above are blocked with phenol derivatives thereof, oximes or caprolactams; etc. These can be used alone or in combination.

A suitable mixing ratio (i.e., [NCO]/[OH]) of the polyisocyanate (3) to a polyester having a hydroxyl group is from 5/1 to 1/1, preferably from 4/1 to 1.2/1 and more preferably from 2.5/1 to 1.5/1 in equivalent ratio.

When the [NCO]/[OH] ratio is too large, the low temperature fixability of the toner tends to deteriorate. When the molar ratio of [NCO] is too small, the urea content of urea-modified polyesters in the modified polyesters tends to be small, which leads to deterioration of the hot offset resistance.

The content of the constitutional component of a polyisocyanate (3) in the polyester prepolymer (A) having a polyisocyanate group at its end portion is from 0.5 to 40% by weight, preferably from 1 to 30% by weight and more preferably from 2 to 20% by weight.

A content that is too low easily degrades the hot offset resistance of the toner and disadvantageous in terms of having a good combination of high temperature storage and low temperature fixing property. In contrast, when the content is too high, the low temperature fixing property tends to deteriorate.

The number of isocyanate groups included in the prepolymer (A) per molecule is normally not less than 1, preferably from 1.5 to 3, and more preferably from 1.8 to 2.5.

When the number of isocyanate groups is too small, the molecular weight of urea-modified polyester tends to be small and the hot offset resistance easily deteriorates.

Specific examples of the amines (B) include, but are not limited to, diamines (B1), polyamines (B2) having three or more amino groups, amino alcohols (B3), amino mercaptans (B4), amino acids (B5), and blocked amines (B6) in which the amines (B1-B5) mentioned above are blocked.

Specific examples of the diamines (B1) include, but are not limited to, aromatic diamines (e.g., phenylene diamine, diethyltoluene diamine, and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine, and hexamethylene diamine); etc. Specific examples of the polyamines (B2) having three or more amino groups include, but are not limited to, diethylene triamine, and triethylene tetramine. Specific examples of the amino alcohols (B3) include, but are not limited to, ethanol amine and hydroxyethyl aniline.

Specific examples of the amino mercaptan (B4) include, but are not limited to, aminoethyl mercaptan and aminopropyl mercaptan.

Specific examples of the amino acids (B5) include, but are not limited to, amino propionic acid and amino caproic acid. Specific examples of the blocked amines (B6) include, but are not limited to, ketimine compounds which are prepared by reacting one of the amines (B1) to (B5) mentioned above with a ketone such as acetone, methyl ethyl ketone and methyl isobutyl ketone; oxazoline compounds, etc.

Among these, (B1) and a mixture of (B1) with a small amount of (B2) are preferred.

Furthermore, the molecular weight of the urea-modified polyesters can be adjusted by using a molecular weight control agent when manufacturing toner.

Specific preferred examples of the molecular weight control agent include, but are not limited to, monoamines (e.g., diethyl amine, dibutyl amine, butyl amine and lauryl amine) having no active hydrogen group, and blocked amines (i.e., ketimine compounds) prepared by blocking the monoamines mentioned above.

The mixing ratio of the isocyanate group to the amines (B), i.e., the equivalent ratio ([NCO]/[NHx]) of the isocyanate group [NCO] contained in the prepolymer (A) to the amino group [NHx] contained in the amines (B), is preferably from 1/2 to 2/1, more preferably from 1.5/1 to 1/1.5, and furthermore preferably from 1.2/1 to 1/1.2. When the mixing ratio is too large or too small, the molecular weight of the resultant urea-modified polyester (i) decreases, resulting in deterioration of the hot offset resistance of the resultant toner.

In the present disclosure, the urea-modified polyester (i) may contain a urethane bonding in addition to the urea bonding.

The molar ratio of the content of the urea bonding to the content of the urethane bonding is preferably from 100/0 to 10/90, more preferably from 80/20 to 20/80 and further preferably from 60/40 to 30/70. When the molar ratio of the urea bonding is too small, the anti-hot offset property tends to deteriorate.

By the reaction specified above, modified polyesters for use in the toner, for example, the urea-modified polyester (i) is manufactured.

This urea-modified polyester (i) is manufactured by the one-shot method or a prepolymer method.

The weight average molecular weight of the urea-modified polyester (i) is preferably 10,000 or greater, more preferably from 20,000 to 10,000,000 and furthermore preferably from 30,000 to 1,000,000.

When the weight average molecular weight is too small, the anti-hot offset property tends to deteriorate.

The number average molecular weight of the urea-modified polyester is not particularly limited when an unmodified polyester (ii), which is described later, is used. The number average molecular weight is controlled to have the weight average molecular weight in the range specified above.

When the polyester (i) is singly used, the number average molecular weight is preferably 20,000 or lower, preferably from 1,000 to 10,000 and further preferably from 2,000 to 8,000.

When the number average molecular weight is too large, the low temperature fixability of the resultant toner tends to deteriorate, and in addition the gloss of full color images degrades when the toner is used in a full color image forming apparatus.

In the present disclosure, a combination of the urea-modified polyester (i) with an unmodified polyester (ii) as the component of a binder resin can be used as well as the urea-modified polyester (i) alone. This combinational use is preferable to a single use of the polyester (i) in terms of improvement of the low temperature fixability of a toner and the gloss property when the toner is used in a full-color image forming apparatus.

Examples of the polyester (ii) are polycondensation products of the polyol (1) having the same polyester component specified for the polyester (i) and the polycarboxylic acid (2) and preferred examples are the same as in the case of the polyester (i).

In addition, a polyester modified by a bonding (e.g., urethane bonding) other than urea bonding can be used as the polyester (ii) in addition to unmodified polyesters.

The polyester (i) and the polyester (ii) that are at least partially compatible in each other are preferable in terms of the low temperature fixing property and the anti-hot offset property.

Therefore, the polyester (ii) preferably has a component similar to the polyester component of the polyester (i).

The weight ratio of the polyester (i) to the polyester (ii) is from 5/95 to 80/20, preferably from 5/95 to 30/70, more preferably from 5/95 to 25/75 and particularly preferably from 7/93 to 20/80 when the polyester (ii) is contained.

A ratio of the polyester (i) that is too small, for example, less than 5%, tends to degrades the hot offset resistance and prevent to have a good combination of the high temperature storage and the low temperature fixing property.

The peak molecular weight of the polyester (ii) is preferably from 1,000 to 30,000 and more preferably from 1,500 to 10,000 and further preferably from 2,000 to 8,000.

When the peak molecular weight is too small, the high temperature storage tends to deteriorate. When the peak molecular weight is too large, the low temperature fixing property tends to deteriorate. The hydroxyl value of the polyester (ii) is preferably 5 mgKOH/g or higher, more preferably from 10 to 120 mgKOH/g, and further preferably from 20 to 80 mgKOH/g.

A hydroxyl value that is too small may be disadvantageous in terms of having a good combination of the high temperature preservabiltiy and the low temperature fixing property. The acid value of the polyester (ii) is preferably from 1 to 30 mgKOH/g, and more preferably from 5 to 20 mgKOH/g.

The polyester (ii) having an acid value tends to cause the resultant toner to have a negative charging property.

The glass transition temperature (Tg) of the binder resin is preferably from 50 to 70° C., and more preferably from 55 to 65° C.

A toner that has an excessively low glass transition temperature easily causes blocking when the toner is preserved at a high temperature. When the glass transition temperature is too high, the low temperature fixing property tends to deteriorate.

The toner for use in the present disclosure tends to have a relatively good high temperature storage while having a low glass transition temperature due to the presence of the urea-modified polyester resins in comparison with a known polyester based toner.

With respect to the storage elastic modulus of the toner binder, the temperature (TG') at which the storage elastic modulus is 10,000 dyne/cm$^2$ when measured at a frequency of 20 Hz is not lower than 100° C., and preferably from 110 to 200° C. When the temperature (TG') is too low, the anti-hot offset property tends to deteriorate.

With respect to the viscosity of the binder resin, the temperature (Tη) at which the viscosity is 10,000 poise when measured at a frequency of 20 Hz is preferably not higher than 180° C., and more preferably from 90 to 160° C.

By contrast, when the temperature (Tη) is too high, the low temperature fixability of the toner tends to deteriorate. In order to achieve a good combination of the low temperature fixability and the hot offset resistance, the TG' is preferably higher than the Tη.

Specifically, the difference (TG'−Tη) is preferably not less than 0° C., more preferably not less than 10° C., and furthermore preferably not less than 20° C.

The difference particularly has no specific upper limit. The temperature difference (TG'−Tη) between TG' and Tη of the binder resin is preferably 0 to 100° C., more preferably 10 to 90° C., and furthermore preferably 20 to 80° C. to have a good combination of the low temperature fixing property and the high temperature storage.

The binder resin (toner binder) is manufactured by the following method, etc.

Heat the polyol (1) and the polycarboxylic acid (2) to 150 to 280° C. under the presence of known esterification catalysts such as tetrabuthoxy titanate, dibutyl tin oxide, etc.; remove produced water with a reduced pressure, if necessary, to obtain a polyester having a hydroxyl group; react the polyester with the polyisocyanate (3) at 40 to 140° C. to obtain the prepolymer (A) having an isocyanate group; and furthermore, conduct reaction between the prepolymer (A) and the amine (B) at 0 to 140° to obtain a urea-modified polyester. During the reaction of the polyisocyanate (3) and the prepolymer (A) and the amine (B), an optional solvent can be used.

Examples of such solvents are inert compounds to the isocyanate (3) and specific examples thereof include, but are not limited to, inert compounds to the isocyanate (3) such as aromatic solvents (toluene, xylene); ketones (acetone, methylethyl ketone, methylisobutyl ketone); esters (ethyl acetate); amides (dimethylformamide, dimethylacetamide); and ethers (tetrahydrofuran).

When the polyester (ii) which is not modified by urea bonding is used in combination, the polyester (ii) is prepared by the same method as for the polyester having a hydroxyl group and dissolved in and mixed with the solution of the polyester (i) after the reaction.

The toner for use in the present disclosure can be manufactured by the following method but is not limited thereto.

The toner can be prepared by reacting a dispersion body formed of the prepolymer (A) having an isocyanate group with the amine (B) in an aqueous medium or using a preliminarily manufactured urea modified polyester (i).

The dispersion body formed of the urea-modified polyester (i) or the prepolymer (A) in an aqueous medium can be stably formed by, for example, a method in which a composition of toner material containing the urea-modified polyester (i) and the prepolymer (A) is added to the aqueous medium and dispersed by shearing force.

The prepolymer (A) and other toner compositions (also referred to as toner material) such as a coloring agent, a coloring agent master batch, a releasing agent, a charge control agent, and an unmodified polyester resin can be mixed in an aqueous medium when forming a dispersion body. However, a method in which toner material is preliminarily mixed and then the mixture is added to and dispersed in an aqueous medium is preferable.

In addition, in the present disclosure, a coloring agent, a releasing agent, and a charge control agent, etc. are not necessarily mixed when particles are formed in an aqueous medium but can be added after particles are formed in an aqueous medium. For example, after particulates containing no coloring agent are formed, a coloring agent is added thereto by a known dying method.

Suitable aqueous media is not limited to water only and mixtures of water with a solvent which can be mixed with water are also suitably used. Specific examples of such solvents include, but are not limited to, alcohols (e.g., methanol, isopropanol and ethylene glycol), dimethylformamide, tetrahydrofuran, cellosolves (e.g., methyl cellosolve), lower ketones (e.g., acetone and methyl ethyl ketone), etc.

The content of the aqueous medium is preferably from 50 to 2,000 parts by weight, and more preferably from 100 to 1,000 parts by weight to 100 parts of the toner component including the urea-modified polyester (i) and the prepolymer (A).

When the ratio of the aqueous medium is too small, the dispersion of the toner component in the aqueous medium is not satisfactory, and thereby the resultant toner particles do not have a desired particle diameter. By contrast, a ratio of the aqueous medium that is too large is not preferred in terms of the economy.

A dispersion agent can be optionally used. The particle size distribution is sharp and dispersion is stabilized when a dispersion agent is used.

There is no specific limit to the dispersion method. Specific examples thereof include, but are not limited to, a low speed shearing method, a high speed shearing method, a friction method, a high pressure jet method, and an ultrasonic method.

Among these methods, the high speed shearing method is preferable to obtain a dispersion body having a particle diameter of from 2 to 20 μm.

When a high speed shearing type dispersion machine is used, there is no specific limit to the rotation speed, but the rotation speed is preferably from 1,000 to 30,000 rpm, and more preferably from 5,000 to 20,000 rpm. There is no specific limit to the dispersion time. The dispersion time is preferably from 0.1 to 5 minutes in the batch method.

The temperature during the dispersion process is preferably from 0 to 150° C., and more preferably from 40 to 98° C. A high temperature is preferable during the dispersion process because the viscosity of the dispersion body containing the urea-modified polyester (i) and the prepolymer (A) is low in a high temperature, which is advantageous to perform easy dispersion.

In the process in which the urea-modified polyester (i) is synthesized from the prepolymer (A), the amine (B) can be added to an aqueous medium before the toner component is dispersed therein, or to a liquid dispersion in which the toner component is dispersed in an aqueous medium to start reaction at the particle interface. In the latter case, the urea-modified polyester is preferentially formed at the surface portions of the toner particles.

In the latter case, the urea-modified polyester is preferentially formed at the surface portions of the toner particles. Thus, a gradient of the concentration of the urea-modified polyester can be made in the thickness direction of the toner particle.

In the reaction, a dispersion agent is preferably used.

There is no specific limit to the dispersion agent and any known dispersion agent can be suitably used. Specific examples thereof include surface active agents, inorganic compound dispersion agents hardly soluble in water, and polymeric protective colloids.

These can be used alone or in combination. Among these, surface active agents are preferred.

For example, anionic surface active agents, cationic surface active agents nonionic surface active agents, and ampholytic surface active agents can be preferably used.

Specific examples of anionic surface active agents include, but are not limited to, alkylbenzene sulfonic acid salts, α-olefin sulfonic acid salts, and phosphoric acid salts. Among these, an anionic surface active agent having a fluoroalkyl group is preferably used.

Specific examples of the anionic surface active agents having a fluoroalkyl group include, but are not limited to, fluoroalkyl carboxylic acids having 2 to 10 carbon atoms and their metal salts, disodium perfluorooctane sulfonylglutamate, sodium 3-{ω-fluoroalkyl (having 6 to 11 carbon atoms)oxy}-1-alkyl(having 3 to 4 carbon atoms) sulfonate, sodium 3-{ω-fluoroalkanoyl(having 6 to 8 carbon atoms)-N-ethylamino}-1-propanesulfonate, fluoroalkyl(having 11 to 20 carbon atoms) carboxylic acids and their metal salts, perfluoroalkylcarboxylic acids and their metal salts, perfluoroalkyl(having 4 to 12 carbon atoms)sulfonate and their metal salts, perfluorooctanesulfonic acid diethanol amides, N-propyl-N-(2-hydroxyethyl)perfluorooctanesulfone amide, perfluoroalkyl (having 6 to 10 carbon atoms) sulfoneamidepropyltrimethylammonium salts, salts of perfluoroalkyl(having 6 to 10 carbon atoms)-N-ethylsulfonyl glycin, and monoperfluoroalkyl(having 6 to 16 carbon atoms) ethylphosphates.

Specific examples of the marketed products of such surfactants having a fluoroalkyl group include, but are not limited to, SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; and FUTARGENT F-100 and F150 manufactured by Neos Company limited.

Specific examples of the cationic surface active agents include, but are not limited to, amine salt type surface active agents and quaternary ammonium salt type anionic surface active agents.

Specific examples of the amine salt type surface active agents include, but are not limited to, alkyl amine salts, amino alcohol fatty acid derivatives, polyamine fatty acid derivatives, and imidazoline.

Specific examples of the quaternary ammonium salt type cationic surface active agents include alkyl trimethyl ammonium salts, dialkyl dimethyl ammonium salts, alkyl dimethyl benzyl ammonium salts, pyridinium salts, alkyl isoquinolinium salts, and benzetonium chloride.

Among these, primary, secondary and tertiary aliphatic amines having a fluoroalkyl group, aliphatic quaternary ammonium salts such as perfluoroalkyl (having 6 to 10 carbon atoms) sulfonamide propyltrimethy lammonium salts, benzalkonium salts, benzetonium chloride, pyridinium salts and imidazolinium salts.

Specific examples of the marketed products of the cationic surface active agents include, but are not limited to, SURFLON S-121 (manufactured by Asahi Glass Co., Ltd.), FRORARD FC-135 (manufactured by Sumitomo 3M Ltd.), UNIDYNE DS-202 (manufactured by Daikin Industries, Ltd.), MEGAFACE F-150 and F-824 (manufactured by Dainippon Ink and Chemicals, Inc.), ECTOP EF-132 (manufactured by Tohchem Products Co., Ltd.) and FUTARGENT F-300 (manufactured by Neos Company Limited).

Specific examples of the nonionic surface active agents include, but are not limited to, fatty acid amide derivatives, and polyalohol derivatives.

Specific examples of amopholytic surface active agents include, but are not limited to, alanine, dodecyldi(amino ethyl)glycine, di(octyl amonoethyl)glycine, and N-alkyl-N,N-dimethyl ammonium betaine.

An inorganic compound such as tricalcium phosphate, calcium phosphate, titanium oxide, colloidal silica, and hydroxyapatite can also be used as the inorganic compound dispersant hardly soluble in water.

Specific examples of the polymeric protective colloids include, but are not limited to, acids, (meth)acrylic monomer having a hydroxyl group, vinyl alcohol or ethers thereof, esters of vinyl alcohol and a compound having a carboxylic group, amide compounds or methylol compounds thereof, chlorides, homopolymers or copolymers having a nitrogen atom or a heterocyclic ring thereof, polyoxyethylene based compounds and celluloses.

Specific examples of the acids include, but are not limited to, acrylic acid, methacrylic acid, α-cyanoacrylic acid, α-cyanomethacrylic acid, itaconic acid, crotonic acid, fumaric acid, maleic acid and maleic anhydride. Specific examples of (meth)acrylic monomers having a hydroxyl group include, but are not limited to, β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylate, diethyleneglycolmonomethacrylate, glycerinmonoacrylate, glycerinmonomethacrylate, N-methylol acryl amide, and N-methylol methacryl amide.

Specific examples of vinyl alcohols mentioned above or its ethers include vinyl methyl ether, vinyl ethyl ether and vinyl propyl ether.

Specific examples of the esters mentioned above of vinyl alcohol and a compound having a carboxylic group include, but are not limited to, vinyl acetate, vinyl propionate and vinyl butyrate.

Specific examples of the amide compounds mentioned above or their methylol compounds include, but are not limited to, acrylamide, methacrylamide and diacetone acrylamide acid and their methylol compounds.

Specific examples of the chlorides mentioned above include, but are not limited to, acrylic acid chloride and methacrylic acid chloride.

Specific examples of homopolymers or copolymers mentioned above having a nitrogen atom or a heterocyclic ring thereof include, but are not limited to, vinyl pyridine, vinyl pyrrolidone, vinyl imidazole and ethylene imine.

Specific examples of the polyoxyethylene mentioned above include, but are not limited to, polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters.

Specific examples of the celluloses mentioned above include, but are not limited to, methyl cellulose, hydroxyethyl cellulose and hydroxypropyl cellulose.

A dispersion stabilizer can be optionally used in preparation of the dispersion liquid mentioned above.

Specific examples of the dispersion stabilizers include, but are not limited to, compounds such as calcium phosphate which are soluble in an alkali or an acid.

When such a dispersion stabilizer is used, calcium phosphate can be removed from particulates by a method of washing with water or a method of decomposing with enzyme after dissolving calcium phosphate with an acid such as hydrochloric acid.

When the dispersion liquid mentioned above is prepared, a catalyst for elongation and/or cross-linkage reaction can be used.

Specific examples thereof include, but are not limited to, dibutyltin laurate and dioctyltin laurate.

In addition, a solvent in which the urea-modified polyester (i) and the prepolymer (A) can be used to decrease the viscosity of the toner component.

Such a solvent is preferable because it is effective to cause the particle size distribution to be sharp.

Also, a volatile solvent is preferable because the solvent can be easily removed from liquid dispersion after the particles are formed.

There is no specific limit to the selection of the solvent. Specific examples of such solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These can be used alone or in combination.

Among these solvents, aromatic solvents such as toluene and xylene; and halogenated hydrocarbons such as methylene chloride, 1,2-dichloroethane, chloroform, and carbon tetrachloride are preferably used. The aromatic solvents such as Toluene and xylene are more preferable.

The addition amount of such a solvent is from 0 to 300 parts by weight, preferably from 0 to 100, and more preferably from 25 to 70 parts by weight, based on 100 parts by weight of the prepolymer (A).

When such a solvent is used, the solvent is removed therefrom upon application of heat thereto under a normal or reduced pressure condition after the elongation reaction and/or a cross-linking reaction.

The cross-linking time and/or the elongation time is determined depending on the reactivity determined according to the combination of the isocyanate group structure of the prepolymer (A) and the amine (B) and is preferably from 10 minutes to 40 hours, and more preferably from 2 to 24 hours.

The reaction temperature is preferably from 0 to 150° C. and more preferably from 40 to 98° C.

Any known catalyst can be optionally used in the elongation reaction and/or cross linking reaction.

Specific examples thereof include, but are not limited to, dibutyltin laurate, and dioctyltin laurate.

In order to remove the organic solvent from the thus prepared emulsion dispersion body, a method is used in which the temperature of the emulsion is gradually raised to completely evaporate and remove the organic solvent in the droplets dispersed in the emulsion.

Alternatively, a drying method in which the emulsion is sprayed in a dry atmosphere to evaporate and remove not only the organic solvent but also the remaining aqueous medium in the droplets in the emulsion dispersion body to form toner particulates can be used.

The dry atmosphere can be prepared by heating gases, for example, air, nitrogen, carbon dioxide and combustion gases. The temperature of the heated gases is preferred to be higher than the highest boiling point of all of the solvents in the emulsion dispersion body.

A short time drying treatment with a drying device such as a spray dryer, a belt dryer, a rotary kiln, etc. is sufficient to obtain desired quality.

When the thus prepared toner particles have and maintain a wide particle size distribution after the washing and drying treatment of the particles, the particle size distribution can be adjusted by a classification treatment to obtain a desired particle size distribution.

The classification treatment can be performed in a liquid dispersion using a cyclone, a decanter, or a centrifugal to remove fine particles therefrom. Classification can be performed after the toner particles are dried but preferably in the liquid including the particles in terms of the efficiency. The toner particles having an undesired particle diameter can be returned to the kneading process for reuse even when the toner particles are in a wet condition.

Removing the dispersion agent from the liquid dispersion as much as possible is preferable and is preferably conducted together with the classification process.

The thus prepared toner powder particles can be mixed with other fine particles such as release agent particles, charge control agent particles, fluidizing agent particles and coloring agent particles. Such fine particles can be fixed on the surface of the toner particles by applying a mechanical impact thereto while the particles and toner particles are integrated. Thus, the fine particles can be prevented from being detached from the toner particles.

Specific examples of such mechanical impact application methods include, but are not limited to, methods in which a mixture is mixed with a highly rotated blade and methods in which a mixture is put into a jet air to collide the particles against each other or a collision plate.

Specific examples of such mechanical impact applicators include, but are not limited to, ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

In addition, known pigments and dyes for used in coloring agents for toner can be used and specific examples thereof include, but are not limited to, carbon black, lamp black, black iron oxide, indigo, Nigrosine dyes, aniline blue, phthalocyanine blue, phthalocyanine green, Hansa Yellow GR, rhodamine 6C lake, Calco oil blue, chrome yellow, Quinacridone Red, Benzidine yellow, and rose Bengal. These can be used alone or in combination.

The toner optionally contains magnetic components of iron oxides such as ferrite, magnetite, maghematite, metals such as iron, cobalt, and nickel, or alloyed metal of these metals and other metals alone or mixed with each other to have magnetic characteristics in the toner itself.

These magnetic components can be used as coloring agent components.

The number average particle diameter of the coloring agent in the toner for use in the present invention is preferably from 0.5 μm or smaller, more preferably from 0.4 μm or smaller, and furthermore preferably from 0.3 μm or smaller. When the number average particle diameter is excessively large, the dispersion property of the pigment tends to be insufficient so that desirable transparency might not be obtained.

Coloring agent particles having a number average particle diameter smaller than 0.1 μm is sufficiently small in comparison with a half wavelength of optical light and is thus considered to have no adverse impact on the reflectivity or absorption characteristics of light. Therefore, coloring agent particles having a number average particle diameter smaller than 0.1 μm contributes to improve color reproducibility and transparency for a transparent sheet having a fixed image thereon.

On the other hand, when coloring agent particles having ab excessively large number average particle diameter, for example, greater than 0.5 μm, are contained in a large amount, the incident light tends to hardly transmit or be easily scattered so that the lightness and the colorness of projected images of transparent sheets tend to deteriorate.

Furthermore, the coloring agent is easily detached from the surface of the toner particle, which leads to problems such as fogging, contamination of the drum, and bad cleaning performance. The content ratio of coloring agents having a number average particle diameter greater than 0.7 μm is preferably not greater than 10% by number and more preferably not greater than 5% by number.

In addition, when the coloring agent is mixed and kneaded with part or all of binder resin and a preliminarily added moistening liquid, the binder resin and the coloring agent are sufficiently attached to each other before using them. Thereafter, the coloring agent is effectively dispersed in the toner particles in the toner manufacturing process and the dispersion particle diameter of the coloring agent decreases so that suitable transparency is obtained.

The binder resins specified above used as the binder resins for toner are used as the binder resins for use in preliminary kneading and mixing but the binder resins for use in preliminary kneading and mixing are not limited thereto.

A specific method of preliminarily mixing and kneading the mixture of the binder resin and a coloring agent together with a moistening liquid is to: mix a binder resin, a coloring agent, moistening liquid by a blender such as HENSCEL MIXER; and mix and knead the obtained mixture with a kneader such as a two-roll or a three-roll at a temperature lower than the melting point of the binder resin to obtain a sample.

In addition, typical known liquid can be used as the moistening liquid considering the solubility of the binder resin and the wettability of the coloring agent. Organic solvents such as acetone, toluene, and butanone, and water are preferred in terms of the dispersion property of the coloring agent. Among these, the usage of water is particularly preferred in consideration of the environment, and maintenance of dispersion stability of the coloring agent in the toner manufacturing process thereafter.

According to this method, the particle diameter of the coloring agent particles contained in the obtained toner decreases and in addition the uniformity of the dispersion status of the particles increases. Therefore, the color representability for a projected image on a transparent sheet is further improved.

In the toner, the releasing agent is preferably contained in addition to the binder resin and the coloring agent.

There is no specific limit to the selection of such a releasing agent and any known releasing agent can be suitably used. Specific examples of the release agent (wax) include, but are not limited to, polyolefin waxes such as polyethylene waxes and polypropylene waxes; long chain hydrocarbons such as paraffin waxes and SAZOL waxes; waxes including a carbonyl group, etc.

Among these waxes, the waxes including a carbonyl group are particularly preferable.

Specific examples of the waxes including a carbonyl group include, but are not limited to, polyalkane acid esters such as carnauba wax, montan waxes, trimethylolpropane tribehenate, pentaerythritol tetrabehenate, pentaerythritol diacetate dibehenate, glycerin tribehenate, and 1,18-octadecanediol distearate; polyalkanol esters such as trimellitic acid tristearyl, and distearyl maleate; polyalkylamide such as trimellitic acid tristearylamide; dialkyl ketone such as distearyl ketone, etc.

Among these waxes, polyalkane acid esters are particularly preferable.

The releasing agent preferably has a melting point of from 40 to 160° C., more preferably from 50 to 120° C., and furthermore preferably from 60 to 90° C.

When the melting point of the releasing agent is too low, the high temperature storage of the toner tends to deteriorate. In contrast, when the melting point is too high, a cold offset problem, i.e., an offset phenomenon that occurs at a low fixing temperature, tends to occur.

The releasing agent preferably has a melt viscosity of from 5 to 1,000 cps and more preferably from 10 to 100 cps at a temperature 20° C. higher than the melting point of the releasing agent.

When the melt viscosity is too high, the effect of improving the hot offset resistance and low temperature fixability is reduced.

The content of the releasing agent in the toner is preferably from 0 to 40% by weight and more preferably from 3 to 30%.

Also, the toner can optionally contain a charge control agent to improve the charging property and quicken the rise thereof.

A charge control agent formed of colored material changes color of the toner. Therefore, the charge control agent is preferably made of transparent material or material having a white color or close thereto.

There is no specific limit to the selection of the charge control agent. Specific examples of the charge control agent include, but are not limited to, known charge control agents such as triphenylmethane dyes, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid and metal salts of salicylic acid derivatives.

Specific examples of the marketed products of the charge control agents include, but are not limited to, BONTRON P-51 (quaternary ammonium salt), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; quinacridone, azo pigments and polymers having a functional group such as a sulfonate group, a carboxyl group, and a quaternary ammonium group.

The addition amount of the charge control agent is determined depending on the species of the binder resin used, whether or not an additive is added and the toner manufacturing method (including the dispersion method) used, and thus is not unambiguously defined. However, the content of the charge control agent is preferably from 0.1 to 10 parts by weight, and preferably from 0.2 to 5 parts by weight, based on 100 parts by weight of the binder resin included in the toner.

When the addition amount is too large, the toner tends to have an excessively large amount of charge, which reduces the effect of the charge control agent. Therefore, the electrostatic attraction force between a developing roller and the toner increases, resulting in deterioration of the fluidity of the toner and a decrease in the image density.

The charge control agent can be dissolved or dispersed in an organic solvent after the charge control agent is kneaded together with a master batch pigment and resin. In addition, the charge control agent can be directly dissolved or dispersed in an organic solvent when the toner component is dissolved or dispersed in an organic solvent. Alternatively, the charge control agent may be fixed on the surface of the toner particles after the toner particles are prepared.

In addition, resin particulates can be optionally added to stabilize dispersion when the toner component is dispersed in an aqueous medium in the toner manufacturing process.

Any resins that form an aqueous dispersion body can be used as the resin particulates. Specific examples of these resins include, but are not limited to, thermoplastic resins or thermosetting (thermocuring) resins such as vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These can be used alone or in combination. Among these resins, vinyl resins, polyurethane resins, epoxy resins, polyester resins, and mixtures thereof are preferably used because an aqueous dispersion body including fine spherical particulates can be easily prepared.

Specific examples of the vinyl resins include, but are not limited to, polymers, which are prepared by polymerizing a vinyl monomer or copolymerizing vinyl monomers, such as styrene-(meth)acrylate resins, styrene-butadiene copolymers, (meth)acrylic acid-acrylate copolymers, styrene-acrylonitrile copolymers, styrene-maleic anhydride copolymers and styrene-(meth)acrylic acid copolymers.

Inorganic particulates are suitable as an external additive to assist the fluidity, the developability and the charging property of toner particles.

Specific examples of such inorganic particulates include, but are not limited to, silica, alumina, titanium oxide, barium titanate, magnesium titanate, calcium titanate, strontium titanate, zinc oxide, tin oxide, quartz sand, clay, mica, sandlime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

The inorganic particulate preferably has a primary particle diameter of from 5 nm to 2 μm, and more preferably from 5 nm to 500 nm.

In addition, the specific surface area of such inorganic particulates measured by a BET method is preferably from 20 to 500 $m^2/g$.

The content of the external additive is preferably from 0.01 to 5% by weight, and more preferably from 0.01 to 2.0% by weight, based on total weight of the toner.

In addition, other polymer parituclates such as polymers and copolymers of styrene, methacrylates, acrylates or the like prepared by a soap-free emulsion polymerization method, a suspension polymerization method or a dispersion polymerization method and polymer particles of polycondensation or thermocuring resins such as silicone resins, benzoguanamine resins and nylon resins can also be used as the external additive.

Also, fluidizers can be optionally added to the toner.

These fluidizers can be hydrophobized by surface treatment to prevent deterioration of the fluidity and charge properties of the toner under high humidity conditions.

Specific examples of the fluidizers include, but are not limited to, silane coupling agents, silylation agents, silane coupling agents including a fluoroalkyl group, organic titanate coupling agents, aluminum coupling agents, silicone oils, and modified silicone oils.

The toner for use in the present invention may include a cleaning improver to remove the toner (development agent) remaining on an image bearing member such as a photoreceptor and an intermediate transfer body. Specific examples of the cleaning improvers include, but are not limited to, zinc stearate, calcium stearate and metal soaps of stearic acid; polymer particulates such as polymethyl methacrylate particulates and polystyrene particulates, which are prepared by a soap-free emulsion polymerization method or the like, etc.

The polymer particulates preferably have a relatively narrow particle size distribution and the volume average particle diameter thereof is preferably from 0.01 to 1 μm.

Quality toner images can be formed with the stable developability as described above by using such toner.

In addition, the image forming apparatus of the present disclosure can be used not only for the polymerization toner having a suitable structure to obtain quality images but also pulverized toner having irregular forms. The working life of the image forming apparatus is significantly prolonged even when such pulverized toner having irregular forms is used.

There is no specific limit to selection of the material forming such pulverized toner as long as it can be used in electrophotography.

Any known binder resin can be suitably used for manufacturing the pulverized toner. Specific examples of the binder resins for use in the pulverized toner include, but are not limited to, styrene polymers and substituted styrene homopolymers such as poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; homopolymers of acrylic esters or copolymers thereof such as polymethyl acrylate, polybutyl acrylate, polymethyl methacrylate, and polybutyl methacrylate; polyvinyl derivatives such as polyvinyl chloride and polyvinyl acetate; polyester-based polymers, polyurethane based polymers, polyamide based polymers, polyimide based polymers, polyol based polymers, epoxy based polymers, terpene based polymers, aliphatic or alicyclic hydro carbon resins and aromatic oil resins.

These can be used alone or in combination. Among these, styrene-acrylic based copolymers, polyester based resins, and polyol based resins are preferable in terms of electric characteristics and cost and polyester based resins and polyol based resins are more preferable in terms of the fixing characteristics.

The pulverization toner is manufactured by: preliminarily mixing these resin components with the coloring agent component, the wax component, the charge control components, if desired; mixing and kneading them at a temperature around the melting point of the resin component; and cooling down the mixture followed by pulverization and classification process. The external additive specified above can be optionally admixed with the toner.

The development device is either of dry development type or wet development type and of a single color development type or a multi-color development type. The development device suitably includes, for example, a stirrer that triboelectrically charges the toner or the development agent, and a rotatable magnet roller.

In the development device, the toner and a carrier are mixed and stirred to triboelectrically charge the toner. The toner is then held on the surface of the rotating magnet roller in a filament manner to form a magnet brush. Since the magnet roller is provided in the vicinity of the image bearing member, part of the toner forming the magnet brush borne on the surface of the magnet roller is transferred to the surface of the image bearing member by electric attraction force. As a result, the latent electrostatic image is developed with the toner to form a visualized toner image on the surface of the image bearing member.

The development agent accommodated in the development device is a single component development agent (i.e., toner) or a two component development agent (i.e., toner and carrier).

Transfer Process and Transfer Device

The transfer process mentioned above is a process in which the visualized image mentioned above is transferred to a recording medium. It is preferred that the visualized image is primarily transferred to an intermediate transfer body and thereafter secondarily transferred to the recording medium. Further, it is more preferred use a two-color toner, preferably a full color toner in the processes in which the visualized image is primarily transferred to an intermediate transfer body to form a complex transfer image and the complex transfer image is thereafter secondarily transferred to the recording medium.

The transfer process can be performed by, for example, charging the latent electrostatic image bearing member (photoreceptor) with a transfer charging device and by the transfer device.

The transfer device preferably has a primary transfer device to form a complex transfer image by transferring a visualized image to an intermediate transfer body and a secondary transfer device to transfer the complex transfer image to a recording medium.

There is no specific limit to the intermediate transfer body and any known transfer body can be suitably selected. For example, a transfer belt is preferably used.

An intermediate transfer system using an intermediate transfer body can be suitably used. A toner image formed on the image bearing member is primarily transferred to the intermediate transfer system to overlap color images and the overlapped color image is transferred from the intermediate transfer body to the recording medium.

Intermediate Transfer Body

The intermediate transfer body is preferably electroconductive with a volume resistance of from $1.0\times10^{5}$ to $1.0\times10^{11}$ Ω·cm.

A volume resistance that is too low may cause discharging, which leads to disturbance of formation of a toner image when the toner image is transferred from the image bearing member to the intermediate transfer body. When the volume resistance is too large, the charges to the toner image tend to remain on the intermediate transfer body which may appear on the next images as an accidental image after the toner image is transferred from the intermediate transfer body to a recording medium such as paper.

The intermediate transfer medium is preferably electroconductive with a surface resistance of from $1.0\times10^{8}$ to $1.0\times10^{13}$ Ω/sq. A surface resistance that is too low tends to cause problems such that toner images are disturbed, and transfer dust may be produced. A surface resistance that is too high tends to cause a problem such that performance of the primary transfer deteriorates.

Plastic etc., having a belt form or a cylinder form that is manufactured by, for example, mixing and kneading metal oxide such as tin oxide or indium oxide, or electroconductive particles or electroconductive polymers alone or in combination with a thermoplastic resins followed by extraction can be used as the intermediate transfer body. An intermediate transfer medium having an endless form can be manufactured by optionally adding the electroconductive particles or electroconductive polymers to a liquid resin containing cross-linking reactive monomers or oligomers and centrifugal molding while heating.

A component excluding the charge transport material from the material for the surface layer for use in the surface layer of the photoreceptor is used and the resistance thereof is adjusted using an electroconductive material in combination on a suitable basis when the surface layer is provided to the intermediate transfer medium.

Plastic having a belt form or a cylinder form that is manufactured by, for example, mixing and kneading metal oxide such as tin oxide or indium oxide, or electroconductive particles or electroconductive polymers alone or in combination with a thermoplastic resins followed by extraction can be used as the intermediate transfer body. An intermediate transfer medium having an endless form can be manufactured by optionally adding the electroconductive particles or electroconductive polymers to a liquid resin containing cross-linking reactive monomers or oligomers and centrifugal molding while heating.

A component excluding the charge transport material from the material for the surface layer for use in the surface layer of the photoreceptor is used and the resistance thereof is adjusted using an electroconductive material in combination on a suitable basis when the surface layer is provided to the intermediate transfer medium.

The transfer device (the primary transfer body, the secondary transfer body) preferably has a transfer unit which peeling-charges the visualized image formed on the image bearing member (photoreceptor) to the side of the recording medium.

One or more transfer units may be used. Specific examples of the transfer units include, but are not limited to, a corona transfer unit using corona discharging, a transfer belt, a transfer roller, a pressure transfer roller, and an adhesive transfer unit.

There is no specific limit to the recording medium and any known recording medium (recording paper) can be suitably used.

Protective Layer Formation Process and Protective Layer Formation Device

The process of forming a protective layer is a process in which a protective agent is added to the surface of an image bearing member by a protective layer formation device.

When a protective layer formation device that forms a protective layer by applying a protective agent to the surface of the image bearing member is provided, the image bearing member is protected from AC charging by metal soap contained in the protective agent in addition to the effect of boron nitride held between the image bearing member and the cleaning blade. Therefore, supplying metal soap to the image bearing member is greatly preferable.

In addition, since boron nitride is held between the image bearing member and the cleaning blade, the posture of the cleaning blade is kept so that the metal soap is prevented from slipping through the cleaning blade. Therefore, there is no concern about contamination of the charging roller.

The protective agent includes metal soap, boron nitride and other optional components.

When a mixture of metal soap and boron nitride is used as the protective agent, the lubricant property between the image bearing member and the blade are furthermore improved in comparison with when boron nitride is not contained. In addition, preferably, this improved lubricant property is sustained for an extremely extended period of time.

The content of boron nitride is preferably 30% by weight or less, and more preferably 10% or less based on the total amount of metal soap and boron nitride in terms of the cost.

When the content is too large, the amount of boron nitride is attached to the image bearing member excessively. thereby causing problems.

The metal soap is preferably a mixture of zinc palmitate and zinc stearate.

The weight ratio of zinc stearate and zinc palmitate in the mixture is preferably from 75:25 to 40:60, and more preferably from 66:34 to 40:60.

When such a mixture of zinc palmitate and zinc stearate is used and the application process of zinc stearate having a bar form applied to the surface of the image bearing member is observed, the zinc stearate is scraped and finely-powdered by a brush and extended by a blade. However, as the linear speed of the image bearing member increases, the extension of the zinc stearate tends to fall behind and does not keep pace with the linear speed.

However, by adding zinc palmitate having a smaller molecular weight than zinc stearate to zinc stearate, the protective agent formed of the mixture of both stearates is extended by a blade and covers the image bearing member even when the linear speed of the image bearing member increases.

Zinc stearate and zinc palmitate are both metal salts of fatty acid. With regard to the aliphatic portion thereof, the numbers of carbon atoms in stearic acid and in palmitic acid are 18 and 16, respectively. Thus, the structures of zinc stearate and zinc palmitate are similar to each other and compatible with each other well so that both compounds tend to behave as significantly same materials.

In addition, since zinc palmitate has a lower melting point than zinc stearate, the protective agent containing both compounds is easily extended by a blade when zinc palmitate contained in the protective agent surpasses a particular amount.

Thus, the protective agent layer on the image bearing member is desired to be thick to increase the protection effect on the image bearing member by the protective agent.

Zinc stearate is said to be stable when it is attached the surface of the image bearing member by two molecules instead of at random attachment. Thus, when zinc stearate is applied to the surface of the image bearing member, the thickness of zinc stearate thereon is saturated by 2 molecules of zinc sterate. When zinc palmitate having a slightly shorter molecule length than zinc stearate is contained in at least a particular amount, the height of the molecule layer is not constant and thus the protecitive agent layer has thicker portions and thinner portions.

The following molecule slips into the thinner portion to form a molecule layer. Consequently, a protective agent layer having a thickness greater than 2 molecule thickness of zinc stearate, which results in improvement on the protection effect on the image bearing member. In addition, the protective agent preferably contains alumina because the mixture of boron nitride, zinc stearate, and zinc palmitate that is supplied excessively on the image bearing member is ground by the alumina.

The content of alumina is preferably from 2 to 15% by weight, more preferably from 3 to 10% by weight, and more preferably from 3 to 10% by weight, and 4 to 8% by weight based on the weight of the mixture of zinc stearate, and zinc palmitate.

When alumina is excessively contained based on the weight of the mixture of zinc stearate, and zinc palmitate, alumina tends to damage the image bearing member. When the content of alumina is excessively small based on the weight of the mixture of zinc stearate, alumina may not sufficiently grind boron nitride and the mixture of zinc stearate, and zinc palmitate on the image bearing member.

The alumina preferably has an average particle diameter of from 0.05 to 0.5 μm, more preferably from 0.1 to 0.4 μm, and furthermore preferably from 0.2 to 0.3 μm.

When the average particle diameter of alumina is too small, alumina may not sufficiently grind boron nitride and the mixture of zinc stearate, and zinc palmitate on the image bearing member. When the average particle diameter of alumina is too large, alumina tends to damage the image bearing member.

The protective layer formation device preferably has a protective agent applicator blade.

The cleaning blade just possibly supplies the protective layer but the cleaning blade removes the toner so that the protective agent may be mixed with the protective agent on the cleaning blade. Therefore, the simple use of the cleaning blade is not suitable to form a film of the protective agent on the image bearing member. Therefore, it is preferable to separate functions of removing the toner and supplying and applying the protective agent to the image bearing member by providing two blades of the toner cleaning blade, and the protective agent supply and application blade to efficiently remove the toner, and supply and apply the protective agent to the image bearing member.

In addition, boron nitride or a mixture of boron nitride and metal soap is attached to the protective agent supply and application blade.

Since the lubricant property between the image bearing member and the protective agent supply and application blade is improved because of boron nitride attached to the protective agent supply and application blade, both of the protective agent supply and application blade and the image bearing member have prolonged working lives.

In addition, slipping through of toner is prevented by boron nitride, thereby preventing contamination of the charging roller.

Boron nitride improves the lubricant property between the image bearing member and the protective agent supply and application blade and reduces minute vibration of the cleaning blade. This makes the posture of the protective agent supply and application blade stable, which leads to reduction of the production of abnormal images having streaks ascribable to metal soap powder that has slipped through the cleaning blade and attached to the charging roller. In addition, attrition of the cleaning blade is limited by the reduction of the minute vibration of the cleaning blade.

The protective agent supply and application blade in the protective layer formation device is preferably in contact with the image bearing member against the rotation direction of the surface of the image bearing member.

When the protective agent supply and application blade that supplied the protective agent to the image bearing member contacts the image bearing member against the rotation direction of the surface of the image bearing member, an excessive attachment of boron nitride to the image bearing member is avoided.

The protective agent supply and application blade in the protective layer formation device is preferably in contact with the image bearing member while the protective agent supply and application blade and the image bearing member forms an obtuse angle.

A protective agent supply and application blade that has a front end having an obtuse angle improves the cleaning property, thereby preventing the toner, the metal soap, and boron nitride from slipping through the blade. This reduces an excessive attachment of boron nitride on the image bearing member.

In addition, since the toner and the protective agent that hardly slip through the blade, contamination of the charging roller is also reduced, which is greatly preferable.

The obtuse angle is preferably from 95 to 170 degree, and more preferably from 100 to 150 degree because the flexibility of the contact portion of the cut face is high.

A protective agent solidified to have a bar form is preferably used in the present disclosure.

The protective agent is easily supplied to the image bearing member by a simple mechanism when such a protective agent bar is used. In addition, a suitable amount of the protective agent is uniformly supplied to the surface of the image bearing member.

The method of supplying the protective agent to the image bearing member from the protective agent bar is described with reference to specific embodiments.

In the present disclosure, the protective agent bar is preferably molded by a compact molding method in which powder of the protective agent is compressed for molding.

A protective agent bar that is formed by the compact molding has a different hardness depending on the degree of compression.

Since the true specific gravity of the protective agent and the amount placed in the molding form are known beforehand, compacting is adjusted such that desired thickness reflecting the degree of compacting is obtained so that the protective agent can be manufactured with good reproducibility.

The degree of compacting the protective agent block is from 88 to 98% and preferably from 90 to 95% based on the true specific gravity of the protective agent.

When the compacting degree of the protective agent block is too low, the mechanical strength of the protective agent block tends to be weak so that cracking occurs when handling the protective agent block.

A compacting degree of the protective agent block that is too large requires a pressing machine to have a high power and produces partially melted portions, which causes the protective agent to have greatly different hardness depending on portions thereof.

Fine powder can be made from a protective agent block manufactured by compacting molding in the range of from 88 to 98% of the true specific gravity of the protective agent even when a brush is pressed against the protective agent block under a pressure weaker than in the case of a protective agent block manufactured by melting molding. Therefore, the brush does not deteriorate over a long period of time for the protective agent block manufactured by compacting molding so that the protective agent can be stably supplied to the image bearing member, which is preferable. In addition, when powder of boron nitride or alumina is mixed, a protective agent bar that maintains the mixed status can be manufactured by the compact molding method as long as mixing is sufficiently performed in the powder state.

Fixing Process and Fixing Device

The fixing process is a process in which a visualized image transferred to a recording medium is fixed by the fixing device and can be performed every time color toner is transferred to the recording medium or at one time after color toner is accumulated.

There is no specific limit to the fixing device and any known fixing device can be suitably selected.

Known pressure and heating devices are preferably used and formed of, for example, a combination of a heating roller and a pressure roller or a combination of a heating roller, a pressure roller and an endless belt.

The pressure and heating roller is preferably heated to a temperature range of from 80 to 200° C.

In the fixing process for use in the present disclosure, for example, any known optical fixing device and the fixing process can be used together with or in place of the fixing device and the fixing process described above.

The discharging process is a process in which a discharging bias is applied to the image bearing member to discharge the image bearing member and is suitably performed by a discharging device.

There is no specific limit to the discharging device and any known discharging device. For example, a discharging lamp, can be suitably selected as long as it can apply a discharging bias to the image bearing member.

The cleaning process is a process in which the toner remaining on the image bearing member is removed and can be performed by the cleaning device.

The cleaning device is preferably provided on the downstream side of the transfer device and the upstream side of the protective agent application device relative to the rotation direction of the image bearing member.

There is no specific limit to the selection of the cleaning device and any known cleaner can be selected as long as it can remove the toner remaining on the image bearing member. Preferred specific examples of such cleaners include, but are not limited to, a magnetic brush cleaner, an electroconductive roller cleaner, a blade cleaner, a brush cleaner, and a web cleaner.

A recycle process can be used in which the toner removed in the cleaning process is returned to the development device.

There is no specific limit to the recycling device and any known transfer device can be used.

Another embodiment of the present disclosure is described with reference to the accompanying drawings.

FIG. 1 is a diagram illustrating an example of the process cartridge for use in the image forming apparatus of the present disclosure.

A process cartridge 100 includes an image bearing member 60, a charging roller 40 that charges the image bearing member 60, a development device 50 that develops a latent electrostatic image formed by irradiating the charged image bearing member 60 with a development agent containing toner to form a toner image, a cleaning device 10 that cleans the surface of the image bearing member 60 from which the toner image is transferred to a transfer medium (not shown), a protective agent supplying device 20 that applies a protective agent containing metal soap to the cleaned image bearing member 60, and optionally a second blade (e.g., protective agent layer regulator) 30 that regulates the layer thickness of the protective agent supplied to the image bearing member 60.

The cleaning device 10 includes a cleaning blade 11, a supporter 12 that supports the cleaning blade 11, and a pressure unit 13 that presses the cleaning blade 11 to the image bearing member 60 having a drum form via the supporter 12.

A lubricant containing boron nitride is attached to the front end of the cleaning blade 11 which contacts with the image bearing member 60.

Boron nitride improves the lubricity between the cleaning blade 11 and the image bearing member 60 and reduces minute shaking of the cleaning blade 11.

As a result, the lubricant is thought to prevent production of abnormal images having streaks caused by metal soap which is described later and the toner that have passed through the cleaning blade 11 and attached to the charging roller 40.

In addition, abrasion of the cleaning blade 11 is restrained by the reduction of the minute vibration of the cleaning blade 11.

At this point of time, the cleaning blade 11 contacts the image bearing member against the rotation direction thereof, thereby preventing excessive attachment of the lubricant to the surface of the image bearing member 60.

Boron nitride is hardly detached from the cleaning blade while the cleaning blade 11 is in use. Therefore, once boron nitride is attached to the cleaning blade 11 before prior to the start of its use, it is possible to prevent deterioration of the image quality even when the cleaning blade 11 is used for an extended period of time.

Boron nitride has a primary particle diameter or secondary particle diameter of about 10 μm, and preferably from about 2 to about 8 μm.

Surface treated boron nitride is suitable to improve the hydrophobic property.

In addition, since the image bearing member 60 immediately after the start of its use does not have toner on the surface of the image bearing member, using a lubricant that contains metal soap is suitable considering that the friction force between the image bearing member 60 and the cleaning blade 11 tends to increase.

Therefore, the lubricity between the cleaning blade 11 and the image bearing member 60 is improved furthermore.

As the cleaning blade is used, the metal soap is detached but the toner is present on the surface of the image bearing member 60. Therefore, the lubricity between the cleaning blade 11 and the image bearing member 60 is maintained.

There is no specific limit to the selection of metal soap. Specific examples thereof include, but are not limited to, zinc stearate, magnesium stearate, iron stearate, calcium stearate, zinc laurate, zinc palmitate, and zinc oleate. These can be used alone or in combination.

The metal soap preferably has a primary particle diameter or secondary particle diameter of from about 0.1 to about several micrometer.

The ratio of the weight of the boron nitride to the total weigh of the boron nitride and the metal soap is 10% or greater, preferably from 30 to 90%, and more preferably from 50 to 80%.

When the ratio is too small, the lubricant property between the cleaning blade 11 and the image bearing member 60 tends to be insufficient.

The average attachment amount of the boron nitride in the area where the lubricant is attached is from 0.01 to 1 mg/cm$^2$, and preferably from 0.05 to 0.2 mg/cm$^2$.

When the average attachment amount of the boron nitride is too small, the lubricant property between the cleaning blade 11 and the image bearing member 60 tends to be insufficient, which leads to failing to demonstrate the effect of preventing the minute shaking of the cleaning blade.

To the contrary, when the average attachment amount of the boron nitride is too large, since boron nitride is excessively present between the cleaning blade 11 and the image bearing member 60, boron nitride is not held on the cleaning blade 11, resulting in discharging thereof in a large amount together with the toner.

The area where the lubricant is attached is 3 mm or less, and preferably from 1 mm or less from the front end of the cleaning blade 11. A lubricant that is attached to the area too distant from the front end of the cleaning blade 11 tends to fail to demonstrate the effect of the lubricant.

Any lubricant that contains boron nitride can be used and such a lubricant may contain optional compounds. Specific examples of the optional compounds include, but are not limited to, fluorine containing resins such as polytetrafluoroethylene (PTFE), polyperfluoroalkyl ether (PFA), copolymers of perfluoroethylene-perfluoro propylene (FEP), copolymers of polyvinylidene fluoride (PVdF), and ethylene-tetrafluoroethylene (ETFE); silicone resins such as polymethyl silicone, and polymethyl phenyl silicone; acrylic resins; ethylene acrylic resins; inorganic compounds such as mica, molybdenum disulfide, tungsten disulfide, china clay, montmorillonite, calcium fluoride, and graphite; and lubricant materials such as toner.

Surface treated inorganic compounds can be suitably used to improve the hydrophobic property.

Electrostatic force between boron nitride and the cleaning blade 11 is used to attach the lubricant to the cleaning blade 11.

To be specific, for example, a lubricant is attached to the cleaning blade 11 by tracing the surface of the cleaning blade 11 after powder of the lubricant is attached to a brush, a sponge, a roller, etc., or inserting the cleaning blade 11 into a container accommodating powder of the lubricant.

In addition, it is also suitable to dip the cleaning blade into a container that contains water and a lubricant, and then pull it out followed by drying.

Since boron nitride floats on water, boron nitride attaches to the cleaning blade 11 by the electrostatic force when the cleaning blade 11 is pulled out from the water.

In addition, when the cleaning blade 11 contacts the image bearing member 60, boron nitride is firmly and steadily attached to the cleaning blade 11.

In place of water, other liquids can be used. Specific examples thereof include, but are not limited to, alcohols such as methanol, ethanol, and isopropanol; ketones such as acetone, methylethylketone, and cyclohexanone; amides such as N,N-dimethyl formaldehyde, and N,N-dimethyl acetamide; sulphoxides such as dimethyl sulphoxide; ethers such as teterahydrofuran, dioxane, and ethylene glycol monomethylether; esters such as methyl acetate, and ethyl acetate; and aromatic hydrocarbons such as toluene, xylene, and ligroin.

There is no specific limit to the material forming the cleaning blade 11. Specific examples thereof include, but are not limited to, elastic materials such as urethane rubber, hydrine rubber, silicone rubber, and fluorine rubber. These can be used alone or in combination.

In addition, fillers such as organic fillers and inorganic fillers can be dispersed in the cleaning blade 11 to adjust the hardness thereof.

Furthermore, with regard to the cleaning blade 11, the area where the cleaning blade 11 and the image bearing member 60 are contact with each other can be treated such as coating or dipping with a material having a low friction coefficient.

The thickness of the cleaning blade 11 is from about 0.5 to about 5 mm, and preferably from about 1 to about 3 mm. The length of the cleaning blade 11 is from about 1 to about 15 mm, and preferably from about 2 to about 10 mm.

There is no specific limit to the method of fixing the cleaning blade 11 to the supporter 12. The cleaning blade 11 can be attached or fused to the supporter 12.

The linear pressure to press the cleaning blade 11 against the image bearing member 60 is from 5 to 80 gf/cm, and preferably from 10 to 60 gf/cm.

The front end of the cleaning blade 11 that contacts the image bearing member 60 has a right angle, or an obtuse angle.

Figure 2A:
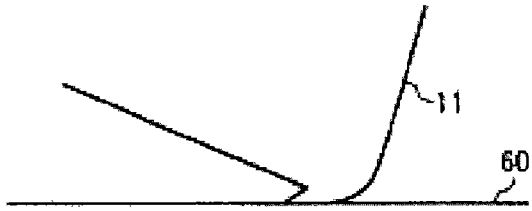
FIG. 2A and FIG. 2B are diagrams illustrating a state of a cleaning blade in contact with the image bearing member.

When the cleaning blade having a front end having a right angle that contacts the image bearing member as illustrated in FIG. 2A is used, the front end of the cleaning blade 11 is easily drawn in by the rotation of the image bearing member 60.

Figure 2B:
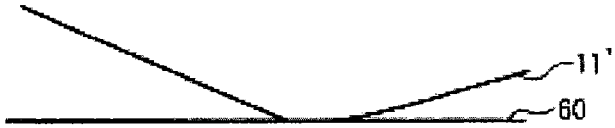

Conversely, when a cleaning blade having a front end having an obtuse angle as illustrated in FIG. 2B is used, the front end of the cleaning blade 11 is hardly pulled in by the rotation of the image bearing member 60 so that the image bearing member 60 is thought to be stably cleaned.

The protective agent applicator 20 includes a protective agent bar 21 of a protective agent containing metal soap with a cylindrical form, a square pole form, a hexagonal cylinder form, etc., a supporting guide 22 that supports in order to support the protective agent bar 21 and prevent shaking thereof in any direction, a brush 23 including a metal core 23*b* to which a fiber 23*a* is planted, and a pressure unit 24 such as a spring that transfers the protective agent to the brush 23 by pressing the protective agent bar 21 to the brush 23. The brush 23 applies the protective agent to the surface of the image bearing member 60 that has been transferred from the protective agent bar 21 to the fiber 23*a*.

As described above, the protective agent bar 21 is pressed against the brush 23 to transfer the protective agent from the protective agent bar 21 to the brush 23. The amount of supplying the protective agent can be varied by changing the pressure force.

The brush 23 is rotated at a faster linear speed than the image bearing member 60 and abrasively traces the surface of the image bearing member 60 with the tips of the brush 23. Thus, the protective agent held on the surface of the brush 23 is applied to the surface of the image bearing member 60.

In addition, the protective agent is applied to the surface of the image bearing member 60 and furthermore regulated to form a thin layer to easily hold the protective agent on the surface of the image bearing member 60.

Therefore, production of abnormal images caused by attachment of the protective agent to the charging roller 40 can be reduced.

There is no specific limit to the selection of the metal soap contained in the protective agent. Specific examples thereof include, but are not limited to, zinc stearate, magnesium stearate, iron stearate, calcium stearate, zinc laurate, zinc palmitate, and zinc oleate. These can be used alone or in combination.

Among these, metal soap containing zinc palmitate and zinc stearate is preferable.

When metal soap is zinc stearate is used as metal soap, as the linear speed of the image bearing member 60 increases, metal soap tends to be difficult to form a thin layer by regulation on the surface of the image bearing member 60.

However, if a mixture of zinc stearate and zinc palmitate is used, metal soap forms a thin layer by regulation on the surface of the image bearing member 60 even when the linear speed of the image bearing member 60 increases. This is because in addition to a high compatibility between zinc stearate and zinc palmitate, zinc palmitate has a lower melting point than zinc stearate.

The weight ratio of zinc stearate and zinc palmitate is from 75:20 to 40:60, and preferably from 66:34 to 40:60.

The protective agent furthermore contains boron nitride and the weight ratio of the boron nitride to the total weight of the boron nitride and the metal soap is preferably 30% or less, and more preferably 10% or less.

Therefore, the lubricity between the cleaning blade 11 or a blade 31 described later and the image bearing member 60 is sustained for an extended period of time.

When the weight ratio is too high, the amount of boron nitride attached to the surface of the image bearing member 60 tends to increase excessively, causing a problem.

In addition, the protective agent preferably contains alumina.

Because of this alumina, metal soap and boron nitride excessively applied to the surface of the image bearing member 60 can be abraded.

The content of alumina in the protective agent is from 2 to 15 5 by weight, preferably from 3 to 10% by weight, and more preferably from 4 to 8% by weight based on metal soap.

When the content of the alumina in the protective agent to metal soap is too small, the metal soap or the boron nitride may not be sufficiently abraded. When the content of the alumina in the protective agent to metal soap is too large, alumina tends to damage the image bearing member 60.

The average particle diameter of the alumina is from 0.05 to 0.5 μm, preferably from 0.1 to 0.4 μm, and more preferably from 0.2 to 0.3 μm.

When the average particle diameter of the alumina is too small, the metal soap or the boron nitride may not be sufficiently abraded. When the average particle diameter of the alumina is too large, the alumina tends to damage the image bearing member 60.

There is no specific limit to the method of forming the protective agent bar 21. There are, for example, a fusion molding method in which a protective agent is melted and then placed into a mold followed by drying, and a compression molding method in which powder of a protective agent is compressed.

There is no specific limit to the brush 23. For example, a roll brush formed by winding a tape having pile fabric made from the fiber 23*a* around a metal core in a spiral manner can be used.

There is no specific limit to the material for use in the fiber 23*a* of the brush 23 and any flexible material can be suitably selected. Specific examples thereof include, but are not limited to, polyolefin based resins (e.g., polyethylene and polypropylene); polyvinyl based resin or polyvinylidene based resins (e.g., polystyrene, acrylic resin, polyacrylonitrile, polyvinylacetate, polyvinyl alcohol, polyvinyl butyral, polyvinyl chloride, polyvinyl carbazole, polyvinyl ether, and polyvinyl ketone); copolymers of polyvinyl chloride and vinyl acetate; copolymers of styrene and acrylic acid; styrene-butadiene resins; fluorine resins (e.g., polytetrafluoroethylene, polyvinyl fluoride, polyvinylidene fluoride, polychloro trifluoroethylene); polyester; nylon; acrylic resins: rayon; polyurethane; polycarbonate: phenol resin; and amino resin (e.g., urea-formaldehyde resin, melamine resin, benzoguanamine resin, urea resin and polyamide resin). These can be used alone or in combination.

Dien based rubber, styrene-butadiene rubber (SBR), ethylene propylene rubber, isoplene rubber, nitrile rubber, urethane rubber, silicone rubber, hydrin rubber, norbornene rubber, etc, can be mixed in the fiber 23*a* to adjust the degree of flexibility.

The diameter of the fiber 23*a* is from 10 to 50 μm and preferably from 20 to 300 μm.

When the diameter of the fiber 23*a* is too small, the application speed of the protective agent may be insufficient. When the diameter of the fiber 23*a* is too large, the protective agent tends to be unevenly coated.

The length of the fiber 23*a* is from 1 to 15 mm and preferably from 3 to 10 mm.

When the length of the fiber 23*a* is too short, the metal core 23*b* and the image bearing member 60 tend to contact each other. When the length of the fiber 23*a* is too long, the protective agent may not be sufficiently supplied to the surface of the image bearing member 60.

The density of the planted fiber 23*a* is from $1\times10^4$ to $3\times10^5$ fibers/inch$^2$(=$1.5\times10^7$ to $4.5\times10^8$ fibers/m$^2$). A density that is too small may cause uneven application of the protective agent.

When the brush 23 has a density greater than $3\times10^5$ fibers/inch$^2$, the diameter of the brush 23 is reduced for use.

The fiber 23*a* can be formed by bundle of fibers in which several to several hundreds of minute fibers are bundled in terms of stability and even application of a protective agent.

For example, the fiber 23*a* can be formed of a bundle of 50 fibers including 333 decitex=6.7 decitex×50 filaments (=300 denil=6 denil×50 filaments).

The fiber 23*a* can be formed of simple fibers having a diameter of from 28 to 43 μm and preferably from 30 to 40 μm in terms of application efficiency. When the diameter of the simple fiber is too small, the application efficiency of the protective agent may deteriorate. When the diameter of the simple fiber is too large, the image bearing member 60 may be easily damaged.

In addition, such single fibers are preferably planted to the metal core 23*b*. The brush 23 is preferably manufactured by electrostatic implanting using static electricity.

The electrostatic implanting is a method in which the metal core 23*b* on which an adhesive is coated is charged and then the simple fiber is flown by the electrostatic force followed by curing of the adhesive.

The density of the simple fiber is from $5\times10^4$ to $6\times10^5$ fibers/inch$^2$.

In addition, considering the surface form and the environmental stability, there is no limit to selection of the covering layer component as long as the component has flexibility. Specific examples thereof include, but are not limited to, polyolefin resins such as polyethylene, polypropylene, chlorinated polyethylene, and chlorosulfonated polyethyelene; polyvinyl or polyvinylidene resins such as polystyrene, acrylic resins (e.g., polymethyl methacrylate), polyacrylonitrile, polyvinyl acetate, polyvinyl alcohol, polyvinyl butyral, polyvinyl chloride, polyvinyl carbazole, polyvinyl ether, and polyvinyl ketone; copolymers of vinyl chloride and vinyl acetate; silicone resins or modified products by, e.g., alkyd resins, polyester resins, epoxy resins, or polyurethane resins; fluorine containing resins such as perfluoroalkyl ether, polyfluorovinyl, polyfluorovinylidene, and polychloro trifluoroethylene; polyamides; polyesters; polyurethanes; polycarbonates; amino resins such as urea and formaldehyde resins; epoxy resins; and complex resins thereof.

Instead of applying powder of a protective agent to the surface of the image bearing member 60 using the protective agent applicator 20, the powder of the protective agent can be supplied to the surface of the image bearing member 60.

In this case, a container that accommodated powder of the protective agent and a protective agent transfer device that transfers the powder of the protective agent are provided and used.

There is no specific limit to selection of the protective agent transfer device. Specific examples thereof include, but are not limited to, a pump, and augur.

The protective agent layer regulator 30 includes a cleaning blade 31, a supporter 32 that supports the cleaning blade 31, and a pressure unit 33 that presses the cleaning blade 31 to the image bearing member 60 having a drum form via the supporter 32.

A lubricant containing boron nitride is attached to the front end of the cleaning blade 31 which is brought into contacts with the image bearing member 60. Boron nitride improves the lubricity between the cleaning blade 31 and the image bearing member 60 and reduces minute shaking of the cleaning blade 31. As a result, the protective agent can forms a evenly thin layer.

In addition, abrasion of the cleaning blade 31 is restrained by the reduction of the shaking of the cleaning blade 31.

At this point of time, the cleaning blade 31 contacts the image bearing member 60 against the rotation direction thereof, thereby preventing excessive attachment of the lubricant to the surface of the image bearing member 60.

Boron nitride is hardly detached from the cleaning blade 31 while the cleaning blade 31 is in use. Therefore, once boron nitride is attached to the cleaning blade 31 before prior to the start of its use, it is possible to use the cleaning blade 31 for an extended period of time.

Surface treated boron nitride is suitable to improve the hydrophobic property.

Boron nitride has a primary particle diameter or secondary particle diameter of about 10 μm, and preferably from about 2 to about 8 μm.

In addition, since the image bearing member 60 immediately after the start of its use does not have toner on the surface of the image bearing member, using a lubricant that contains metal soap is suitable considering that the friction force between the image bearing member 60 and the cleaning blade 31 tends to increase. Therefore, the lubricity between the cleaning blade 31 and the image bearing member 60 is improved furthermore. While the cleaning blade 31 is used, the metal soap is detached but the toner is present on the surface of the image bearing member 60. Therefore, the lubricity between the cleaning blade 31 and the image bearing member 60 is sustained.

There is no specific limit to the selection of metal soap. Specific examples thereof include, but are not limited to, zinc stearate, magnesium stearate, iron stearate, calcium stearate, zinc laurate, zinc palmitate, and zinc oleate. These can be used alone or in combination.

The metal soap preferably has a primary particle diameter or secondary particle diameter of from about 0.1 to about several micrometer.

The ratio of the weight of the boron nitride to the total weigh of the boron nitride and the metal soap is 10% or greater, preferably from 30 to 90%, and more preferably from 50 to 80%.

When the ratio is too small, the lubricant property between the cleaning blade 31 and the image bearing member 60 tends to be insufficient.

The average attachment amount of the boron nitride in the area where the lubricant is attached is from 0.01 to 1 mg/cm$^2$, and preferably from 0.05 to 0.2 mg/cm$^2$.

When the average attachment amount of the boron nitride is too small, the lubricant property between the cleaning blade 31 and the image bearing member 60 tends to be insufficient, which leads to failing to demonstrate the effect of preventing the minute shaking of the cleaning blade 31.

To the contrary, when the average attachment amount of the boron nitride is too large, since boron nitride is excessively present between the cleaning blade 31 and the image bearing member 60, boron nitride is not held on the cleaning blade 31, resulting in discharging thereof in a large amount together with the toner.

The area where the lubricant is attached is 3 mm or less, and preferably from 1 mm or less from the front end of the cleaning blade 31.

A lubricant that is attached to the area too distant from the front end of the cleaning blade 31 tends to fail to demonstrate the effect of the lubricant.

Any lubricant that contains boron nitride can be used and such a lubricant may contain optional compounds. Specific examples of the optional compounds include, but are not limited to, fluorine containing resins such as polytetrafluoroethylene (PTFE), polyperfluoroalkyl ether (PFA), copolymers of perfluoroethylene-perfluoro propylene (FEP), copolymers of polyvinylidene fluoride (PVdF), and ethylene-tetrafluoroethylene (ETFE); silicone resins such as polymethyl silicone, and polymethyl phenyl silicone; acrylic resins; ethylene acrylic resins; inorganic compounds such as mica, molybdenum disulfide, tungsten disulfide, china clay, montmorillonite, calcium fluoride, and graphite; and lubricant materials such as toner.

Surface treated inorganic compounds can be suitably used to improve the hydrophobic property.

Electrostatic force between boron nitride and the cleaning blade 31 is used to attach the lubricant to the cleaning blade 31.

To be specific, for example, a lubricant is attached to the cleaning blade by tracing the surface of the cleaning blade 31 after powder of the lubricant is attached to a brush, a sponge, a roller, etc., or inserting the cleaning blade 31 into a container accommodating powder of the lubricant.

In addition, it is also suitable to dip the cleaning blade into a container that contains water and a lubricant, and then pull it out followed by drying.

Since boron nitride floats on water, boron nitride attaches to the cleaning blade 31 by the electrostatic force when the cleaning blade 31 is pulled out from the water. In addition, when the cleaning blade 31 contacts the image bearing member 60, boron nitride is firmly and steadily attached to the cleaning blade 31.

In place of water, other liquids can be used. Specific examples thereof include, but are not limited to, alcohols such as methanol, ethanol, and isopropanol; ketones such as acetone, methylethylketone, and cyclohexanone; amides such as N,N-dimethyl formaldehyde, and N,N-dimethyl acetamide; sulphoxides such as dimethyl sulphoxide; ethers such as teterahydrofuran, dioxane, and ethylene glycol monomethylether; esters such as methyl acetate, and ethyl acetate; and aromatic hydrocarbons such as toluene, xylene, and ligroin.

There is no specific limit to the material forming the cleaning blade 31. Specific examples thereof include, but are not limited to, elastic materials such as urethane rubber, hydrine rubber, silicone rubber, and fluorine rubber. These can be used alone or in combination.

In addition, fillers such as organic fillers and inorganic fillers can be dispersed in the cleaning blade 31 to adjust the hardness thereof.

The cleaning blade 31 can be subject to coating or impregnation treatment using material having a low friction coefficient with regard to the contact point with the image bearing member 1.

The cleaning blade 31 has a thickness of from about 0.5 to about 5 μm and preferably from about 1 to about 3 μm.

The length of the cleaning blade 31 is from about 1 to about 15 mm, and preferably from about 2 to about 10 mm.

There is no specific limit to the method of fixing the cleaning blade 31 to the supporter 32. The cleaning blade 31 can be attached or fused to the supporter 32.

The linear pressure to press the cleaning blade 31 against the image bearing member 60 is from 5 to 80 gf/cm, and preferably from 10 to 60 gf/cm.

The front end of the cleaning blade 31 that contacts the image bearing member 60 is a right angle. As in the case of the cleaning blade 11, the front end of the cleaning blade 31 that contacts the image bearing member 60 can have an obtuse angle.

Conversely, when a cleaning blade having a front end having an obtuse angle is used, the front end of the cleaning blade is hardly pulled in by the rotation of the image bearing member 60 so that the layer of the protective agent is thought to be stably thin-regulated.

In place of the protective agent layer regulator 30, a device including an elastic metal blade such as a spring board having a surface layer can be also used.

The thickness of the elastic metal blade is from about 0.05 to about 3 mm, and preferably from about 0.1 to about 1 mm.

The elastic metal blade can be subject to treatment such as bending work to cause the blade significantly parallel to the spindle after attachment to prevent distortion of the blade.

There is no specific limit to the material forming the surface layer. For example, materials such as fluorine resins such as PFA, PTFE, FEP, and PVdF, fluorine rubber, and silicone-based elastomers such as methylphenyl silicone elastomers can be used.

In addition, fillers such as organic fillers and inorganic fillers can be dispersed in the surface layer to adjust the hardness thereof.

There is no specific limit to the selection of forming the surface layer. For examples, a coating method, or a dipping method can be used.

In addition, the surface layer can be formed on the surface of the elastic blade via a coupling agent, a primer component, etc., and optionally can be thermo-cured.

In addition, the surface layer can be abraded.

The charging roller 40 is disposed in contact with the image bearing member 60 or in the vicinity thereof with a gap of from 20 to 100 μm and applies an overlapped bias in which an AC voltage is overlapped with a DC voltage to the image bearing member 60.

The image bearing member 60 is easily degraded by discharging occurring more than several hundreds of times per second between the image bearing member 60 and the charging roller 40.

In addition, since the protective agent applied to the image bearing member 60 is also easily degraded by discharging, it is preferable to apply a constant amount of the protective agent to the image bearing member 60.

The charging roller 40 includes an electroconductive substrate on which a resin layer and a surface layer are laminated in that sequence and the surface has a dynamic ultra minute hardness of from 0.04 to 0.5.

Any electroconductive substrate that serves as an electrode and a supporting material of the charging roller 40 can be suitably used. For example, there can be used metal or alloyed metal such as aluminum, alloy of copper, and stainless steel, electroplated iron with chrome, nickel, etc., and resins to which electroconductive resins are added.

The elastic layer is formed of rubber material and an electroconductive agent and has a volume resistance of from $1\times10^6$ to $1\times10^9$ Ω·cm.

There is no specific limit to the selection of the rubber material. Specific example thereof include, but are not limited to, thermoplastic elastomers based on polyesters or olefins, polystyrene and styrene based thermoplastic resins such as copolymers of styrene and butadiene, copolymers of styrene and acrylonitrile, copolymers of styrene, butadiene and acrylonitrile, isoplene rubber, chloroplene rubber, epichlorohydrin rubber, butyl rubber, urethane rubber, silicone rubber, fluorine rubber, styrene-butadiene rubber, butadiene rubber, nitrile rubber, ethylene propylene rubber, copolymer rubber of epichlorohydrin-ethyleneoxide, copolymer rubber of epichlorohydrin-ethyleneoxide-arylglycidyl ether, three-dimension copolymer rubber of ethylene-propylne-dien (EPDM), copolymer rubber of acrylonitrile-butadiene, and natural rubber. Blended rubber material of those can be also used.

Among these rubber materials, silicone rubber, ethylene propylene rubber, copolymer rubber of epichlorohydrin-ethyleneoxide, copolymer rubber of epichlorohydrin-ethyleneoxide-arylglycidyl ether, copolymer rubber of acrylonitrile-butadiene, are preferably used.

Foamed products of the rubber materials are also suitable.

Electron conductive agents and ion conductive agents are used as the conductive agents.

There is no specific limit to the selection of the electron conductive agents. Specific examples of the electron conductive agents include, but are not limited to, carbon blacks such as Ketjen black and acethylene black, pyrolytic carbon, graphite, electroconductive metals or alloyed metals such as aluminum, copper, nickel, stainless steel or alloyed metals, electroconductive metal oxides such as tin oxide, indium oxide, titanium oxide, solid dispersion of tin oxide and antimony oxide, solid dispersion of tin oxide and indium oxide, and insulation material having an electroconductive-treated surface.

The content of the electron conductive agents in the elastic layer is from 1 to 30% by weight, and preferably from 15 to 25% by weight based on the resin.

In addition, there is no specific limit to the selection of the ion electroconductive agents. Specific examples of the ion electroconductive agents include, but are not limited to, perchlorates or chlorates of tetraethyl ammonium, lauryl trimethyl ammonium, and perchlorates or chlorates of alkali metals or alkali earth metals such as lithium and magnesium.

The content of the ion electroconductive agent in the elastic layer is from 0.1 to 5.0% by weight, and preferably from 0.5 to 3.0% by weight based on the resin.

The surface layer contains a resin and optionally the electroconductive agents specified above, and particulates.

Specific examples of the resins include, but are not limited to, polyamides, polyurethanes, polyviniylidene fluorides, copolymers of tetrafluoroethylene, polyesters, polyimides, silicone resins, acrylic resins, polyvinylbutyral, ethylene tetrafluoroethylene copolymers, melamine resins, fluorine-containing rubber, epoxy resins, polycarbonates, polyvinylalcohol, cellulose, polyvinylidene chloride, polyvinyl chloride, polyethylene, and ethylene-vinyl caetate copolymers. These can be used alone or in combination.

Among these, polyamide, polyvinylidene fluoride, copolymers of tetrafluoroethylene, polyesters and polyimides are preferred in terms of the releasing property of toner.

The resin has a number average molecular weight of from $1\times10^3$ to $1\times10^5$ and preferably from $1\times10^3$ to $1\times10^5$.

There is no limit to the selection of the particulates. Specific examples of the particulates include, but are not limited to, metal oxides and complex metal oxides such as silica, aluminum oxide, and barium titanate, and resins such as polyfluoroethylene and polyvinylidene fluoride. These can be used alone or mixed for use.

The development device 50 includes a development roller 51 that bears and transfers a development agent containing toner, and stirring and transfer screws 52 and 53 that transfers the development agent while stirring.

The development roller 51 partially protrudes from the opening of the casing of the development device 50.

A two-component development agent including toner and carrier or a single component development agent without a carrier can be used as the development agent.

A method of developing latent electrostatic image with a two-component development agent is described next.

The toner replenished from a toner bottle (not shown) into the development device 50 is transferred and stirred with carrier by the development agent stirring and transfer screws 52 and 53 to the development roller 51 where the toner is borne.

This development roller 51 is formed of a magnet roller that generates a magnetic field, and a development sleeve concentrically rotating around the magnet roller.

The carrier in the development agent forms a filament on the development roller 51 by the magnetic force generated by the magnet roller and the filament is transferred to the development area facing the image bearing member 60.

The surface of the development roller 51 moves in the same direction as the surface of the image bearing member 60 at a speed higher than that of the surface of the image bearing member 1 in the development area.

The carrier forming the filament on the development roller 51 supplies toner attached to the surface of the carrier to the surface of the image bearing member 60 while abrasively sliding the surface of the image bearing member 60.

A development bias is applied to the development roller 51 by a power source (not shown) to form a development electric field in the development area.

The toner is attached to the latent electrostatic image formed on the image bearing member 60 to develop the latent electrostatic image and form a toner image on the image bearing member 60.

The image bearing member 60 has a photosensitive layer on the electroconductive substrate.

The photosensitive layer is classified into a single layer type in which a charge generation material and a charge transport material are present in a mixed manner, a sequential layer laminate type in which a charge transport layer is formed on a charge generation layer, and a reverse layer laminate type in which a charge generation layer is formed on a charge transport layer.

Optionally, a surface layer is provided on the photosensitive layer, and an undercoating layer is provided between the photosensitive layer and the electroconductive substrate.

The electroconductive substrate can be formed by using any material having a volume resistance of not greater than $10^{10}$ Ω·cm. For example, there can be used plastic or paper having a film form or cylindrical form covered with metal such as aluminum, nickel, chrome, nichrome, copper, gold, silver, and platinum, or a metal oxide such as tin oxide and indium oxide by depositing or sputtering. Also a board formed of aluminum, an aluminum alloy, nickel, and a stainless metal can be used. Furthermore, a tube which is manufactured from the board mentioned above by a crafting technique such as extruding and extracting and surface-treatment such as cutting, super finishing and grinding is also usable.

The diameter of the electroconductive substrate having a drum form is from 20 to 150 iron and preferably from 28 to 70 mm.

When the diameter is too small, it may be difficult to physically arrange around the image bearing member 60 members for use in each process of charging, irradiation, development, transfer, and cleaning.

A diameter that is too large results in size increase of the image forming apparatus.

Figure 5:
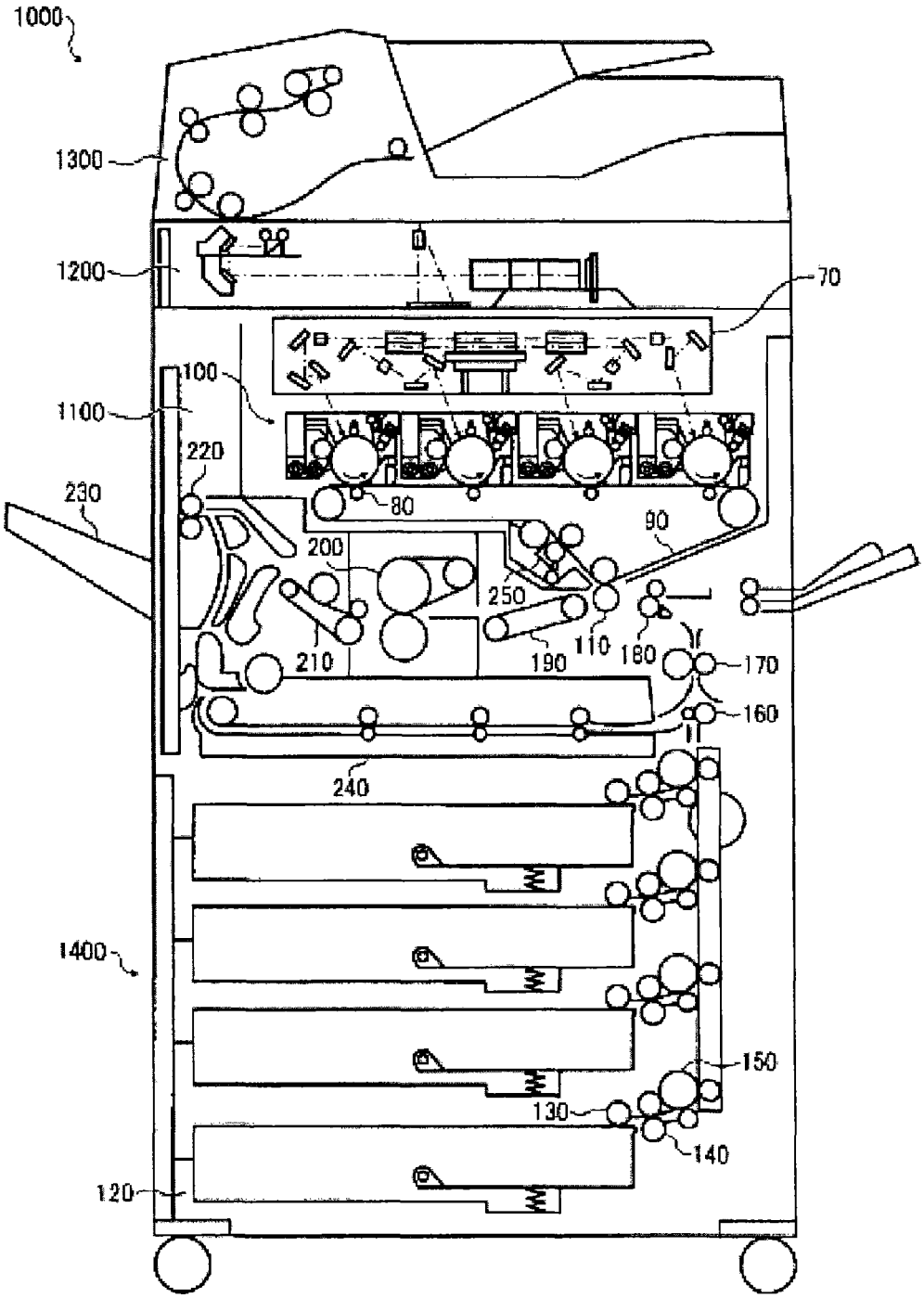
FIG. 5 is a schematic diagram illustrating an example of the image forming apparatus of the present disclosure.

In particular, an image forming apparatus 1000 illustrated in FIG. 5 employs a tandem system having multiple image bearing members 60 so that the diameter of the electroconductive substrate is preferably 70 mm at most and more preferably 60 mm at most.

In addition, the electroconductive substrate may be an endless nickel belt, or an endless stainless belt.

Materials for use in the undercoating layer are, for example, a resin, a mixture mainly formed of a white pigment or a resin, an oxidized metal film formed by chemically or electrochemically oxidizing the surface of the electroconductive substrate. Among these, a mixture mainly formed of a white pigment and a resin is preferable.

The undercoating layer can be of a single layer structure, or a laminate structure.

There is no specific limit to the selection of the resin. Specific examples of the resins include, but are not limited to, thermoplastic resins such as polyamide, polyvinylalcohol, casein, methylcellulose and thermocuring reins such as acryl, phenol, melamine, alkyd, unsaturated polyesters, and epoxy. These can be used alone or in combination.

Specific examples of the white pigments include, but are not limited to, metal oxides such as titanium oxide, aluminum oxide, zirconium oxide, and zinc oxide. Among these, titanium oxide is particularly preferable in terms of charge infusion prevention from the electroconductive substrate.

There is no specific limit to the selection of the charge generation material. Specific examples of the charge generation material include, but are not limited to, azo pigments such as monoazo-based pigments, bisazo-based pigments, trisazo-based pigments, and tetrakisazo-based pigments; organic-based pigments and dyes such as triaryl methane-based dye, thiazine-based dye, oxazine-based dye, xanthene-based dye, cyanine-based dye, styryl-based dye, pyrylium-based dye, quinacridone-based pigment, indigo-based pigment, perylene-based pigment, polycyclic quinone-based pigment, bisbenzimidazole-based pigment, indanthrone-based pigment, squarylium-based pigment, and phthalocyanine-based pigment; and inorganic material such as selenium, selenium-arsenic, selenium-tellurium, cadmium-sulfide; zinc oxide; titanium oxide, and amorphous silicone. These can be used alone or in combination.

There is no specific limit to the selection of the charge transport material. Specific examples of the charge transport material include, but are not limited to, anthracene derivatives, pyrene derivatives, carbazole derivatives, tetrazole derivatives, metallocene derivatives, phenothiazine derivatives, pyrazolline derivatives, hydrazone derivatives, styryl derivatives, styryl hydrazone derivatives, enamine compounds, butadiene compounds, distyryl compounds, oxazole compounds, oxadiazole compounds, thiazole compounds, imidazole compounds, triphenyl amine derivatives, phenylene diamine derivatives, aminostilbene derivatives, and triphenyl amine derivatives. These can be used alone or in combination.

There is no specific limit to the selection of the resin for use in the photosensitive layer. Specific examples of such resins include, but are not limited to, thermoplastic resins such as polyvinyl chloride, polyvinylidene chloride, copolymers of vinyl chloride and vinyl acetate, copolymers of vinyl chloride-vinyl acetate-maleic anhydride, copolymers of ethylene-vinyl acetate, polyvinyl butyral, polyvinyl acetal, polyester, phenoxy resins, (meth)acrylic resin, polystyrene, polycarbonate, polyarylate, polysulfone, polyether sulfone, and ABS resins; thermocuring resins such as phenol resins, epoxy resins, urethane resins, melamine resins, isocyanate resins, alkyd resins, silicone resins, and thermocyring acryl resins, and photoconductive resins such as polyvinyl carbazole, polyvinyl anthracene and polyvinyl pyrene. These can be used alone or in combination.

In addition, an agent such as a plasticizer, an anti-oxidant and a leveling agent can be optionally added to each layer.

There is no specific limit to the selection of the plasticizers. Specific examples of the plasticizers include, but are not limited to, dibutyl phthalate, and dioctyl phthalate.

The addition amount of the plasticizer is from 0 to 30% by weight based on the binder resin.

There is no specific limit to the selection of anti-oxidants. Specific examples thereof include, but are note limited to, monophenol-based compounds such as 2,6-di-t-butyl-p-cresol, butylized hydroxyl anisole, 2,6-di-t-butyl-4-ethylphenol, stearyl-β-(3,5-di-t-butyl-4-hydroxyphenyl)propionate, and 3-t-butyl-4-hydroxynisole; bisphenol based compounds such as 2,2'-methylene-bis-(4-methyl-6-t-butylphenol), 2,2'-methylene-bis-(4-ethyl-6-t-butylphenol), 4,4'-thiobis-(3-methyl-6-t-butylphenol), and 4,4'-butylidenebis-(3-methyl-6-t-butylphenol); phenol based polymers such as 1,1,3-tris-(2-methyl-4-hydroxy-5-t-butylphenol)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl) propionate]methane, bis[3,3'-bis(4'hydroxy-3'-t-butylphenyl)butylic acid]glycol ester, and tocophenols; paraphenylene diamines such as N-phenyl-N'isopropyl-p-phenylene diamine, N,N'-di-sec-butyl-p-phenylene diamine, N-phenyl-N-sec-butyl-p-phenylene diamine, N,N'-di-isopropyl-p-phenylene diamine, and N,N'-dimethyl-N,N'-di-t-butyl-p-phenylene diamine; hydroquinone-2,5-di-t-octyl hydroquinone, 2,6-didodecyl hydroquinone, 2-dodecyl hydroquinone, 2-dodecyl-5-chloro hydroquinone, 2-t-octyl-5-methyl hydroquinone, and 2-(2-octadecenyl)-5-methyl hydroquinone; organic sulfides such as dilauryl-3,3-thiodipropionate, distearyl-3,3'-thiodipropionate, and ditetradecyle-3,3□f-thiodipropionate; and organic phosphorous compounds such as triphenyl phosphine, tri(nonylphenyl) phosphine, tri(dinonylphenyl)phosphine, tricresyl phosphine, and tri(2,4-dibutylphenoxy)phosphine.

There is no specific limit to the selection of the leveling agents. Specific examples thereof include, but are not limited to, dimethyl silicone oils and methyl phenyl silicone oils, and polymers or oligomers including a perfluoroalkyl group in their side chain. The addition amount of the leveling agent is from 0 to 1% by weight based on the binder resin.

The surface layer contains a resin and preferably contains a charge transport material, and a resin having a charge transport power.

The surface layer has a thickness of from 0.01 to 12 μm, preferably from 1 to 10 μm, and more preferably from 2 to 8 μm.

When the surface layer is too thin, the surface layer may easily disappear due to friction with the cleaning blade 11. When the surface layer is too thick, the sensitivity of the image bearing member tends to deteriorate, or the voltage after irradiation tends to rise, or the residual voltage easily rises.

The surface layer contains a polycarbonate that is transparent to the writing light of image formation and excellent in insulation property, mechanical strength, and adhesiveness. In addition, the surface layer optionally contains other resins. Specific examples thereof include, but are not limited to, ABS resins, ACS resins, olefin-vinyl monomer copolymers, chlorinated polyether, aryl resins, phenolic resins, polyacetal, polyimide, polyamideimide, polyallylsulfone, polybutylene, polybutylene terephthalate, polyethersulfone, polyethylene, polyethylene terephthalate, polyimide, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, and epoxy resins.

The resins contained in the surface layer may be thermoplastic resins, but preferably resins formed by curing thermocuring resins using a curing agent having multiple acryloyl group, carboxyl group, hydroxyl group, amino group, etc. Therefore, the mechanical strength of the surface layer increases, thereby reducing the abrasion between the cleaning blade and the surface layer.

The surface layer preferably has fillers dispersed therein to improve the mechanical strength.

Specific examples of the fillers include, but are not limited to, inorganic fillers such as alumina, titanium oxide, potassium titanate, titanium nitride, zinc oxide, indium oxide, and antimony oxide; fluorine-containing resins such as polytetrafluoroethylene and organic fillers such as silicone resins.

A mixture in which an inorganic filler is dispersed in an organic filler is also suitable.

The method of forming images using a process cartridge 100 is described next.

Since the image bearing member 60 from which a toner image is transferred to a transfer medium has remaining of partially degraded protective agent, toner, etc. on the surface of the image bearing member 60, the cleaning device 10.

A protective agent is applied to the surface of the cleaned image bearing member 60 by the protective agent applicator 20.

The image bearing member 60 to the surface of which the protective agent is applied is charged by the charging roller 40 and then irradiated to form a latent electrostatic image.

The latent electrostatic image formed on the image bearing member 60 is developed by the development device 50 to form a toner image followed by transfer to a transfer medium.

Figure 3:
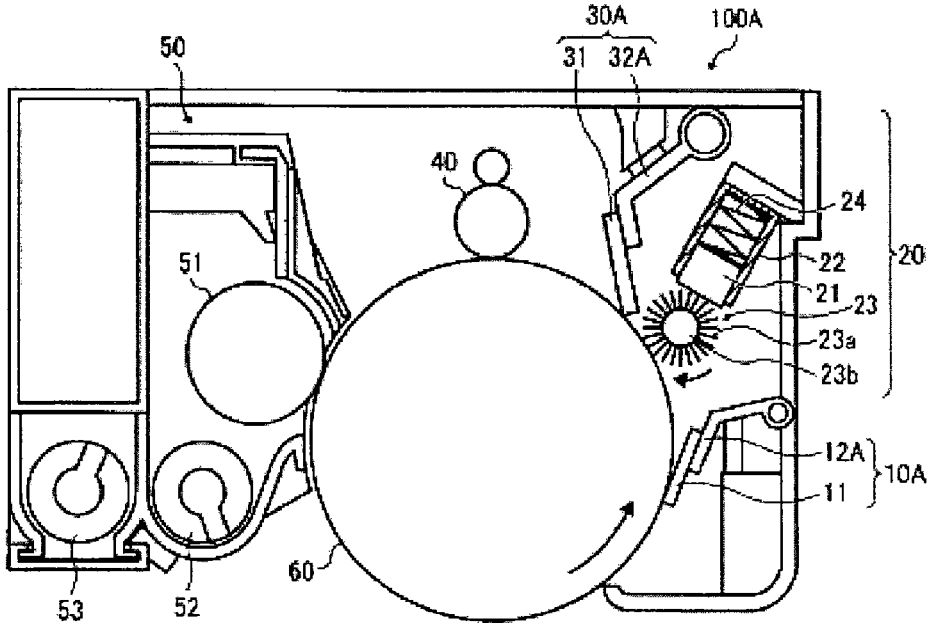
FIG. 3 is a schematic diagram illustrating a variation of the process cartridge illustrated in FIG. 1.
Figure 4:
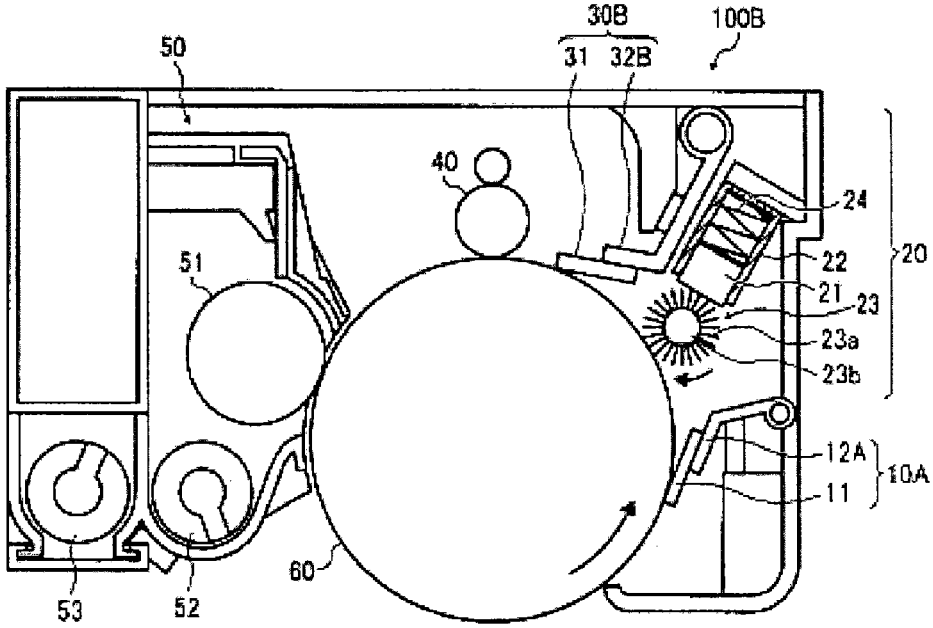
FIG. 4 is a schematic diagram illustrating another variation example of the process cartridge illustrated in FIG. 1.

FIG. 3 and FIG. 4 are diagrams illustrating variations of the process cartridge 100.

A process cartridge 100A illustrated in FIG. 3 has the same structure as the process cartridge 100 illustrated in FIG. 1 except that a cleaning device 10A having a supporter 12A instead of the supporter 12 is provided instead of the cleaning device 10 and a protective agent layer regulator 30A having a supporter 32A instead of the supporter 32 are provided instead of the protective agent layer regulator 30.

A process cartridge 100B illustrated in FIG. 4 has the same structure as the process cartridge 100A illustrated in FIG. 3 except that a protective agent layer regulator 30B is provided which has a supporter 32B in which the blade 31 is set to encounter the image bearing member 60 along the rotation direction thereof.

FIG. 5 is a diagram illustrating an example of the image forming apparatus for use in the present disclosure.

An image forming apparatus 1000 includes an image formation unit (printer unit) 1100, a document reader unit (scanner unit) 1200 disposed on the image formation unit 1100, an automatic document feeder (ADF) 1300 disposed on the document reader unit 1200, and a paper feeder unit 1400 provided below the image formation unit 1100 and has a function of photocopying.

In addition, the image forming apparatus 1000 has a communication function with an outer device and thus can be used as a printer or a scanner when connected with a home computer, etc. provided outside the image forming apparatus 100. Furthermore, the image forming apparatus 100 connected with the telephone communication or optical line can be used as a facsimile machine.

Four of the process cartridges 100 are provided which are detachably attachable to the image formation unit 1100 to form yellow toner images, magenta toner images, cyan toner images, and the black toner images.

Each color toner image is sequentially transferred to an intermediate transfer belt 90 suspended over multiple rollers using transfer rollers 80 and overlapped to form full color toner images.

An irradiator 70 employing laser scanning system emits laser beams and irradiates the image bearing members 60 in the four process cartridges with the laser beams.

In addition, the full color toner image formed on the intermediate transfer belt 90 is transferred to a sheet of paper using a transfer roller 110.

An intermediate transfer drum can be used instead of the intermediate transfer belt 90.

The behavior of the image forming apparatus 1000 is described next.

A series of the image formation processes are described using a negative-positive process. The four process cartridges are the same and thus the behavior of one of the four is representatively described.

The image bearing member 60 is discharged by a discharging lamp (not shown), and then negatively charged by the charging roller 40.

On the charged image bearing member 60, a latent electrostatic image is formed with the laser beams emitted by the irradiator 70.

The laser beam emitted from a laser beam source (e.g., semiconductor laser) is deflected by an optical deflection device including a polygon mirror having a polygonal column that rotates at a high speed and scans the surface of the image bearing member 60 in the rotation axis direction (main scanning direction) of the image bearing member 60 via a scanning image focusing optical system having a scanning lens, mirrors, etc. The absolute value of the voltage at the irradiated portion is smaller than that of the non-irradiated portion.

The thus formed latent electrostatic image is developed by the development device 50 to obtain a toner image.

When the latent electrostatic image is developed, a voltage application mechanism (not shown) applies a development bias of a suitable DC voltage or an AC voltage in which an AC voltage is overlapped with the suitable DC voltage to the development sleeve of the development roller 51.

The toner images formed on the image bearing members 60 of the process cartridges for respective colors are sequentially transferred to and overlapped on the intermediate transfer belt 90 by using the transfer rollers 80.

Paper is fed from one paper feeder cassette 120 selected among the multiple banks of paper feeder cassettes 120 in the paper feeder 1400 by using a paper feeder mechanism including a paper feeder roller 130 and a separation roller 140 and transferred via transfer rollers 150, 160, and 170 and a pair of registration rollers 180.

In addition, the full color toner image formed on the intermediate transfer belt 90 is transferred to the paper using the transfer roller 110.

A transfer bias having a polarity reversed to that of the toner charging is preferably applied to the transfer rollers 80 and 110.

The paper to which the full color toner image is transferred is transferred by using a transfer device to a fixing device 200 where the full color toner image is fixed upon application of heat and pressure.

The paper on which the full color toner image is fixed by heat and pressure is discharged to a discharging tray 230 by a transfer device 210 and a discharging roller 220.

In addition, this image forming apparatus 1000 has a duplex mode. In the duplex mode, the image forming apparatus 1000 switches the transfer path on the downstream side of the fixing device 200, reverses the paper on which the image on one side is fixed back to front via a duplex transfer device 240 and continue transferring the paper by the transfer roller 170 and the registration roller 180.

In addition, the full color toner image formed on the intermediate transfer belt 90 is transferred to the paper using the transfer roller 110. The paper to which the full color toner image is transferred is fixed upon application of heat and pressure in the same manner as described above by the fixing device 200 and discharged to the discharging tray 230.

The toner remaining on the image bearing member 60 from which the toner image has been transferred is removed by the cleaning device 10.

The toner remaining on the intermediate transfer belt 90 from which the toner image has been transferred is removed by a cleaning device 250.

The image forming apparatus 1000 can dispense with the intermediate transfer belt 90.

If this is the case, a transfer belt that bears and transfers the paper is used instead of the intermediate transfer belt 90 and the toner image formed on the image bearing member 60 of the process cartridge 100 corresponding to each color is sequentially transferred to the paper.

The intermediate transfer belt 90 is described next.

The intermediate transfer belt 90 preferably has a volume resistance of from $1\times10^{5}$ to $1\times10^{11}$ Ωcm.

A volume resistance that is too low may cause a phenomenon known as transfer dust by which formation of a toner image is disturbed due to discharging occurring during transfer of the toner image from the image bearing member 60 to the intermediate transfer belt 90. When the volume resistance is too large, the charges of the full color toner image tend to remain on the intermediate transfer belt 90 which may appear on the following images as an accidental image after the toner image is transferred from the intermediate transfer belt 90 to a recording medium such as paper.

The intermediate transfer belt 90 preferably has a surface resistance of from $1\times10^{8}$ to $1\times10^{13}$ Ω/sq.

A surface resistance of the intermediate transfer belt 90 that is too small may result in disturbed toner image, or cause occurrence of transfer dust. To the contrary, a surface resistance of the intermediate transfer belt 90 that is too large may make the transfer of the toner image from the image bearing member 60 to the intermediate transfer belt 90 difficult.

There is no specific limit to the selection of the intermediate transfer belt 90. Such an intermediate transfer belt can be formed by mixing and kneading a metal oxide such as tin oxide, and indium oxide, electroconductive particles such as carbon black, and electroconductive polymer with a thermoplastic resin followed by extrusion, or optionally adding electroconductive particles and an electroconductive polymer to a liquid containing a thermocuring monomer and oligomer followed by centrifugal molding.

The intermediate transfer belt 90 optionally has a protective layer.

Such a protective layer can be formed by using a product formed by adding an optional electroconductive material to adjust the resistance to the protective layer for the image bearing member 60 from which the charge transport materials specified above are subtracted.

The toner is described next.

The toner preferably has an average circularity of from 0.93 to 1.00.

Such toner has a smooth surface and an excellent transfer property because the contact area between the toner particles and between the toner particles and the image bearing member 60 is small.

In addition, since such toner particles rarely have angled portions, the stirring torque of the development agent in the development device 50 is small and driving of the stirring is stable, which prevents production of abnormal images.

Furthermore, since only few of the toner particles that form dots have angled portions, image omission during transfer hardly occurs when a toner image is transferred to a transfer medium such as paper.

In addition, since the toner particle is not angular, the toner particle itself hardly grinds, damages or abrades the surface of the image bearing member 60.

The toner preferably has a weight average particle diameter of from 3 to 10 μm.

In this range, the dot representability is excellent because such toner particles have a particle diameter sufficiently small in comparison with a minute dot of a latent electrostatic image.

When the weight average particle diameter of the toner is too small, the transfer efficiency tends to deteriorate, or the cleaning property of the blade also tends to deteriorate. A weight average particle diameter of the toner that is too large causes prevention of scattering of characters and lines to be difficult.

The toner preferably has a ratio of the weight average particle diameter to the number average particle diameter of from 1.0 to 1.4.

Such a toner has an excellent image stability because the selective development depending on the particle diameter hardly occurs.

In addition, the distribution of the friction charge becomes sharp, thereby reducing the occurrence of fogging.

Furthermore, dots for a latent electrostatic image are developed orderly and densely, which leads to excellent dot reproducibility.

The particle size distribution and the average circularity of the toner are measured by a Flow Particle Image Analyzer (FPIA-2100, manufactured by SYSMEX CORPORATION).

There is no specific limit to such methods of manufacturing toner. A method is suitable which includes dissolving or dispersing a toner material containing a polyester prepolymer (A) having an isocyanate group, an amine (B), a coloring agent, a releasing agent, and a charge control agent with optional polyester C in an organic solvent, dispersing the toner material containing organic solvent in an aqueous medium containing resin particles, and then reacting the polyester prepolymer (A) having an isocyanate group with the amine (B) followed by removing the organic solvent.

The thus manufactured toner is capable of reducing the occurrence of hot offset.

There is no specific limit to the method of stably dispersing a liquid in which the toner material is dissolved or dispersed in the organic solvent in the aqueous medium. For example, a method is suitably used which includes adding the liquid in which the toner material is dissolved or dispersed in the organic solvent to the organic solvent and applying a shearing force thereto.

A dispersion device is used to apply such a shearing force. Specific examples of such dispersion devices include, but are not limited to, a low speed shearing type dispersion device, a high speed shearing type dispersion device, an abrasion type dispersion device, a high pressure jet type dispersion device, and an ultrasonic dispersion device. Among these, the high speed shearing type dispersion device is preferable because it can control the particle diameter of the dispersion body in a range of from 2 to 20 μm.

When a high speed shearing type dispersion machine is used, the rotation speed is from 1,000 to 30,000 rpm, and preferably from 5,000 to 20,000 rpm. The dispersion time is from 0.1 to 5 minutes in the batch system.

In addition, the temperature during dispersion is from 0 to 150° C., and preferably from 40 to 98° C. under pressure.

A liquid in which the polyester prepolymer (A) having an isocyanate group is dissolved or dispersed in the organic solvent, and a liquid in which other materials are dissolved or dispersed in the organic solvent can be mixed in the aqueous medium. However, it is preferable to disperse in the aqueous medium the liquid in which preliminarily mixed toner material is dissolved or dispersed in the organic solvent.

It is also suitable that the liquid in which a toner material excluding the amine (B), the coloring agent, the releasing agent, and the charge control agent is dissolved or dispersed in the organic solvent is dissolved or dispersed in the aqueous medium first and then organic solvent first and thereafter the amine (B), the coloring agent, the releasing agent, and the charge control agent are added.

To be specific, a liquid in which a toner material excluding the amine (B) is dissolved or dispersed in the organic solvent is dispersed in then aqueous medium first and then a liquid in which the amine (B) is dissolved or dispersed in the organic solvent is added thereto to react with the polyester prepolymer (A) having an isocyanate group.

It is also suitable that a liquid in which a toner material excluding the coloring agent is dissolved or dispersed in the organic solvent is dispersed in the aqueous medium followed by dying.

Any volatile organic solvent is suitably used. Specific examples of the organic solvents include, but are not limited to, aromatic based dolvents such as toluene, xylene, and benzene; halogenated hydrocarbons such as carbon tetrachloride, methylene chloride, 1,2-dichloroethane, 1,1,2-trichloroethane, trichloroethylene, chloroform, monochlorobenzene, and dichloroethylidene; esters such as methyl acetate, and ethyl acetate; ketones such as methylethyl ketone and methylisobuthyl ketone. These can be used alone or in combination. Among these, toluene, xylene, benzene, methylene chloride, 1,2-dichloroethane, chloroform, and carbon tetrachloride are preferable and toluene and xylene are particularly preferable.

The amount of the organic solvent is from 0 to 300 parts by weight, preferably from 0 to 100 parts by weight, and more preferably from 25 to 70 parts by weight based on 100 parts by weight of the polyester prepolymer (A) having an isocyanate group.

Specific examples of the aqueous medium include, but are not limited to, water, and a solvent mixture of water and a water-soluble solvent.

Specific examples of such aqueous solvents include, but are not limited to, alcohols (e.g., methanol, isopropanol and ethylene glycol), dimethylformamide, tetrahydrofuran, cellosolves (e.g., methyl cellosolve), lower ketones (e.g., acetone and methyl ethyl ketone).

The amount of the aqueous medium is from 50 to 2,000 parts by weight and preferably from 100 to 1,000 parts by weight based on 100 parts by weight of the toner material.

When the amount of the aqueous medium is too small, the liquid in which the toner material is dissolved or dispersed in the organic solvent may not be stably dispersed, thereby failing to obtain toner particles having a desired particle diameter. By contrast, an amount of the aqueous medium that is too large is not preferable due to the economical reason.

There is no specific limit to selection of the resin forming the resin particles. Specific examples thereof include, but are not limited to, vinyl resins, polyurethane resins, epoxy resins, polyester resins, polyamide resins, polyimide resins, silicone resins, phenolic resins, melamine resins, urea resins, aniline resins, ionomer resins, and polycarbonate resins. These can be used alone or in combination.

Among these resins, vinyl resins, polyurethane resins, epoxy resins, and polyester resins are preferably used because fine spherical particulates can be easily prepared.

Specific examples of the vinyl resins include, but are not limited to, styrene-(meth)acrylate copolymers, styrene-butadiene copolymers, (meth)acrylic acid-acrylate copolymers, styrene-acrylonitrile copolymers, styrene-maleic anhydride copolymers and styrene-(meth)acrylic acid copolymers.

The aqueous medium may contain a dispersion agent.

Therefore, the liquid in which the toner material is dissolved in the organic solvent is stably dispersed and a toner having a sharp particle size distribution is obtained.

There is no specific limit to the selection of the dispersion agent. Specific examples of the dispersion agents include, but are not limited to, anionic surface active agents such as alkylbenzene sulfonic acid salts, α-olefin sulfonic acid salts, and phosphoric esters; cationic surface active agents of amine salts (e.g., alkyl amine salts, aminoalcohol fatty acid derivatives, polyamine fatty acid derivatives and imidazoline); cationic surface active agents of quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surface active agents such as fatty acid amide derivatives, polyhydric alcohol derivatives; and ampholytic surface active agents such as alanine, dodecylbis(aminoethyl)glycin, bis(octylaminoethyle)glycin, and N-alkyl-N,N-dimethylammonium betaine.

A surface active agent having a fluoroalkyl group is effective even in an extremely small amount.

Specific examples of the anionic surface active agents having a fluoroalkyl group include, but are not limited to, fluoroalkyl carboxylic acids having from 2 to 10 carbon atoms and their metal salts, disodium perfluorooctanesulfonylglutamate, sodium 3-{ω-fluoroalkyl(C6-C11)oxy}-1-alkyl(C3-C4)sulfonate, sodium 3-{ω-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the marketed products of such anionic surface active agents having a fluoroalkyl group include, but are not limited to, SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; and FUTARGENT F-100 and F150 manufactured by Neos Company limited.

Specific examples of the cationic surface active agents having a fluoroalkyl group include, but are not limited to, primary and secondary aliphatic amino acids, secondary amino acids, aliphatic quaternary ammonium salts (for example, perfluoroalkyl(C6-C10)sulfoneamidepropyltrimethyl ammonium salts), benzalkonium salts, benzetonium chloride, pyridinium salts, and imidazolinium salts.

Specific examples of the marketed products of the cationic surface active agents having a fluoroalkyl group include, but are not limited to, SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); and FUTARGENT F-300 (from Neos).

Specific examples of inorganic dispersion agents hardly soluble in water include, but are not limited to, tricalcium phosphate, calcium carbonate, titanium oxide, colloidal silica, and hydroxyapatite.

When calcium phosphate is selected, the salt of calcium phosphate can be removed by, for example, a method of dissolving the calcium salt by using an acid such as hydrochloric acid followed by washing with water.

The aqueous medium may contain a protective colloid polymer.

Specific examples of the protective colloid polymers include, but are not limited to, acids (e.g., acrylic acid, methacrylic acid, α-cyanoacrylic acid, α-cyanomethacrylic acid, itaconic acid, crotonic acid, fumaric acid, maleic acid and maleic anhydride); (meth)acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide); ethers of vinyl alcohols (e.g., vinyl methyl ether, vinyl ethyl ether and vinyl propyl ether); esters of vinyl alcohols (e.g., vinyl acetate, vinyl propionate and vinyl butyrate); (meth)acrylic amides (e.g, acrylamide, methacrylamide and diacetoneacrylamide) and their methylol compounds; and acid chlorides (e.g., acrylic acid chloride and methacrylic acid chloride), and monomers having a nitrogen atom or a heterocyclic ring having a nitrogen atom (e.g., vinyl pyridine, vinyl pyrrolidone, vinyl imidazole and ethylene imine).

Specific examples of the other protective colloid polymers include, but are not limited to, polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds, for example, methyl cellulose, hydroxyethyl cellulose and hydroxypropyl cellulose.

Such a dispersion agent may remain on the surface of toner particles. However, it is preferable to wash and remove the dispersion agent in terms of the charging property of the toner particles.

The reaction time of the prepolymer (A) having an isocyanate group and the amine (B) is typically from 10 minutes to 40 hours, and preferably from 2 to 24 hours.

In addition, the reaction temperature is from 0 to 150° C., and preferably from 40 to 98° C.

Any known catalyst can be optionally used during the reaction.

Specific examples thereof include, but are not limited to, dibutyltin laurate and dioctyltin laurate.

The polyester prepolymer (A) having an isocyanate group can be prepared by, for example, reacting a polyester having an hydroxyl group, which is a polycondensation product of a polyol (1) and a polycarboxylic acid (2), with a polyisocyanate (3).

The polyester having a hydroxyl group is obtained by heating the polyol (1) and the polycarboxylic acid (2) to 150 to 280° C. under the presence of known esterification catalysts such as tetrabuthoxy titanate, dibutyl tin oxide, etc.; and removing produced water with a reduced pressure, if necessary.

In addition, the polyester prepolymer (A) having an isocyanate group is obtained by reacting a polyester having a hydroxyl group with the polyisocyanate (3) in a temperature range of from 40 to 140° C.

A polyester having a hydroxyl group and the polyisocyanate (3) can be reacted in an organic solvent. The polyester prepolymer (A) having an isocyanate group and the amine (B) can be also reacted in an organic solvent.

Specific examples of such organic solvents include, but are not limited to, inert compounds to an isocyanate group such as aromatic solvents (e.g., toluene, and xylene); ketones (e.g., acetone, methylethyl ketone, and methylisobutyl ketone); esters (e.g., ethyl acetate); amides (e.g., dimethylformamide, and dimethylacetamide); and ethers (e.g., tetrahydrofuran).

Specific examples of the polyol (1) include, but are not limited to, diol (1-1), polyols (triol or higher polyol) (1-2) and using diol (1-1) or a mixture of diol (1-1) with a small amount of (1-2) is preferable.

Specific examples of the diols (1-1) include, but are not limited to, alkylene glycols such as ethylene glycol, 1,2-propylene glycol, 1,3-propylene glycol, 1,4-butanediol and 1,6-hexanediol; alkylene ether glycols such as diethylene glycol, triethylene glycol, dipropylene glycol, polyethylene glycol, polypropylene glycol and polytetramethylene ether glycol; alicyclic diols such as 1,4-cyclohexane dimethanol and hydrogenated bisphenol A; adducts of alicyclic diols with an alkylene oxide such as ethylene oxide, propylene oxide, and butylene oxide; bisphenols such as bisphenol A, bisphenol F, and bisphenol S; and adducts of bisphenols with an alkylene oxide such as ethylene oxide, propylene oxide, and butylene oxide.

Among these, an alkylene glycol or an adduct of a bisphenol with an alkylene oxide having 2 to 12 carbon atoms are preferable. An adduct of a bisphenol with an alkylene oxide and a mixture of an adduct of a bisphenol with an alkylene oxide and an alkylene glycol having 2 to 12 carbon atoms are more preferable.

Specific examples of the polyols (1-2) having three or more alcohol groups include, but are not limited to, glycerin, trimethylol ethane, trimethylol propane, pentaerythritol and sorbitol); polyphenols having three or more phenolic groups (trisphenol PA, phenol novolak and cresol novolak); and adducts of the polyphenols having three or more alcohol groups with an alkylene oxide.

Specific examples of suitable polycarboxylic acids (2) include, but are not limited to, dicarboxylic acids (2-1) and polycarboxylic acids (2-2) having three or more carboxyl groups. Among these, using the dicarboxylic acid (2-1) alone or a mixture of the dicarboxylic acid (2-1) with a small amount of polycarboxylic acid (2-2) is preferable.

Specific examples of the dicarboxylic acids (2-1) include, but are not limited to, alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid, naphthalene dicarboxylic acids; etc.). Among these compounds, alkenylene dicarboxylic acids having from 4 to 20 carbon atoms and aromatic dicarboxylic acids having from 8 to 20 carbon atoms are preferably used.

Specific examples of the polycarboxylic acids (2-2) having three or more hydroxyl groups include, but are not limited to, aromatic polycarboxylic acids having 9 to 20 carbon atoms (e.g., trimellitic acid and pyromellitic acid).

In addition, instead of polycarboxylic acid (2), anhydrides of polycarboxylic acid (2) or lower alkyl esters (e.g., methyl esters, ethyl esters or isopropyl esters) can be used.

When the polyol (1) and the polycarboxylic acid (2) are poly-condensed, the equivalent ratio of the hydroxyl group of the polyol to the carboxylic group of the polycarboxylic acid is preferably from 1 to 2, more preferably from 1 to 1.5, and more preferably from 1.02 to 1.3.

Specific examples of the polyisocyanates (3) include, but are not limited to, aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisosycantes (e.g., tolylene diisocyanate and diphenylmethane diisocyanate); aromatic aliphatic diisocyanates (e.g., α,α,α',α'-tetramethyl xylylene diisocyanate); and isocyanurates.

Instead of the polyisocyanate (3), blocked polyisocyanates in which the polyisocyanates (3) are blocked with phenol derivatives, oximes or caprolactams etc. are suitably used.

When the polyester having a hydroxyl group is reacted with the polyisocyanate (3), the equivalent ratio of the isocyanate group to the hydroxyl group is preferably from 1 to 5, more preferably from 1.2 to 4, and more preferably from 1.5 to 2.5.

When the equivalent ratio is too small, the content of the urea linkage in a urea-modified polyester decreases, which may lead to deterioration of hot offset resistance. When the equivalent ratio is too large, the low temperature fixing property tends to degrade.

The content of the composition deriving from the polyisocyanate (3) in the polyester prepolymer (A) having an isocyanate group is from 0.5 to 40% by weight, preferably from 1 to 30% by weight, and more preferably from 2 to 20% by weight.

A content that is too low may degrade the hot offset resistance of the toner and be disadvantageous in terms of having a good combination of the high temperature preservability and low temperature fixability. By contrast, when the content is too high, the low temperature fixing property of the toner easily deteriorates.

The content of the isocyanate group per molecule of the polyester prepolymer (A) having an isocyanate group is 1 group or greater, preferably from 1.5 to 3 groups, and more preferably from 1.8 to 1.5 molecules.

When the content is too small, the molecular weight of a urea-modified polyester resin decreases, which may cause deterioration of the hot offset resistance.

Specific examples of the amines (B) include, but are not limited to, diamines (B1), polyamines (B2) having three or more amino groups, amino alcohols (B3), amino mercaptans (B4), amino acids (B5).

Among these, a mixture of diamine (B1) and polyamines (B2) having three or more amino groups is preferable.

Specific examples of the diamines (B1) include, but are not limited to, aromatic diamines (e.g., phenylene diamine, diethyltoluene diamine, and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine, and hexamethylene diamine); etc.

Specific examples of the polyamines (B2) having three or more amino groups include, but are not limited to, diethylene triamine, and triethylene tetramine.

Specific examples of the amino alcohols (B3) include, but are not limited to, ethanol amine and hydroxyethyl aniline.

Specific examples of the amino mercaptan (B4) include, but are not limited to, aminoethyl mercaptan and aminopropyl mercaptan.

Specific examples of the amino acids (B5) include, but are not limited to, amino propionic acid and amino caproic acid.

Blocked ketimine compounds in which the amine (B) is blocked with ketone such as acetone, methylethylketone, methylisobutylketone, etc., and blocked oxazoline compounds in which the amine (B) is blocked with andehyde can be used instead of the amine (B).

The molecular weight of the polyester can be controlled by optionally using a molecular-weight control agent when the prepolymer reacts with the amine.

Specific examples of the molecular weight control agent include, but are not limited to, monoamines (e.g., diethyl amine, dibutyl amine, butyl amine and lauryl amine), and blocked amines (i.e., ketimine compounds) prepared by blocking a monoamine with a ketone.

When the polyester prepolymer (A) having an isocyanate group is reacted with the amine (B), the equivalent ratio of the isocyanate group to the amine group is from 0.5 to 2, preferably from 2/3 to 1.5, and more preferably from 5/6 to 1.2.

When the equivalent ratio is too small, the molecular weight of a urea-modified polyester resin decreases, which may lead to deterioration of hot offset resistance.

The urea-modified polyester may have a urethane linkage.

The equivalent ratio of the urethane linkage to the urea linkage is from 0 to 9, more preferably from 0.25 to 4, and more preferably from 2/3 to 7/3. When this ratio is too large, the hot offset resistance may deteriorate.

The low temperature fixing property and the gloss of an image output by a full color image forming apparatus can be improved by using a urea-modified polyester and the polyester (C).

The polyester (C) is obtained by polycondensing the polyol (1) and the polycarboxylic acid (2). The polyester (C) is modified by urethane linkage.

The urea-modified polyester and the polyester (C) that are at least partially compatible in each other are preferable in terms of the low temperature fixing property and the hot offset resistance.

The weight ratio of the polyester (C) to the urea-modified polyester is from 5/95 to 80/20, preferably from 5/95 to 30/70, more preferably from 5/95 to 25/75 and particularly preferably from 7/93 to 20/80.

When the weight ratio is too low, the hot offset resistance may deteriorate and it is difficult to have a good combination of the high temperature storage and the low temperature fixing property.

The polyester (C) has a peak molecular weight of from $1\times10^3$ to $3\times10^4$, preferably from $1\times10^3$ to $1\times10^4$, and more preferably from $2\times10^3$ to $8\times10^3$.

When the peak molecular weight is too small, the high temperature storage tends to deteriorate. When the peak molecular weight is too large, the low temperature fixing property tends to deteriorate.

The polyester (C) has a hydroxyl value of 5 mgKOH/g or greater, preferably from 10 to 120 mgKOH/g, and more preferably from 20 to 80 mgKOH/g.

A hydroxyl value that is too small may be disadvantageous in terms of having a good combination of the high temperature storage and the low temperature fixing property.

The polyester (C) has an acid value of from 1 to 3 mgKOH/g, and preferably from 5 to 20 mgKOH/g.

Therefore, the polyester (C) tends to be negatively charged.

Urea-modified polyester (D) can be suitably used instead of the polyester prepolymer (A) having an isocyanate group and the amine (B).

The urea-modified polyester (D) is obtained by reacting the polyester prepolymer (A) having an isocyanate group and the amine (B) in a temperature range of from 0 to 140° C.

The weight average molecular weight of the urea-modified polyester (D) is 10,000 or higher, preferably from 20,000 to 10,000,000 and more preferably from 30,000 to 1,000,000.

When the weight average molecular weight is too small, the hot offset resistance tends to deteriorate.

When the polyester (C) is not used in combination, the number average molecular weight of the urea-modified polyester (D) is 20,000 or lower, preferably from 1,000 to 10,000, and more preferably from 2,000 to 8,000.

When the number average molecular weight is too large, the low temperature fixability, and the gloss of a full color images may degrade.

When the polyester (C) is not used in combination, the number average molecular weight of the urea-modified polyester (D) is not particularly limited.

The glass transition temperature of the binder resin is preferably from 50 to 70° C., and more preferably from 55 to 65° C.

When the glass transition temperature is too low, blocking of the toner may occur when preserved in a high temperature environment. When the glass transition temperature is too high, the low temperature fixing property may deteriorate.

The toner containing the polyester (C) and the urea-modified polyester (D) tends to have a good high temperature storage even when the glass transition temperature is low.

With regard to the storage elastic modulus of the binder resin, the temperature (TG') at which the storage elastic modulus is 10,000 dyne/cm$^2$ when measured at a frequency of 20 Hz is not lower than 100° C., and preferably from 110 to 200° C.

When the temperature (TG') is too low, the hot offset resistance tends to deteriorate.

The temperature Tη at which the binder resin has a viscosity of 1,000 poise measured at a frequency of 20 Hz is 180° C. or lower and preferably from 90 to 160° C.

In addition, when Tη is too high, the low temperature fixing property tends to deteriorate.

The temperature difference (TG'−Tη) between TG' and Tη of the binder resin is 0° C. or greater, preferably 10° C. or greater, and more preferably 20° C. or greater to have a good combination of the low temperature fixing property and the hot offset resistance.

The temperature difference (TG'−Tη) between TG' and Tη of the binder resin is 0 to 100° C., preferably 10 to 90° C., and more preferably 20 to 80° C. to have a good combination of the low temperature fixing property and the high temperature storage.

There is no specific limit to the selection of the coloring agent. Specific examples of the coloring agent include, but are not limited to, carbon black, lamp black, black iron oxide, indigo, Nigrosine dyes, aniline blue, phthalocyanine blue, phthalocyanine green, Hansa Yellow GR, rhodamine 6C lake, Calco oil blue, chrome yellow, Quinacridone Red, Benzidine yellow, and rose Bengal. These can be used alone or in combination.

Magnetic components can be used to manufacture a magnetic toner.

Specific examples of the magnetic components include, but are not limited to iron oxides such as ferrite, magnetite, maghematite, metals such as iron, cobalt, and nickel, alloyed metals thereof with other metals or mixtures thereof.

The number average particle diameter of the coloring agent in the toner is 0.5 μm or smaller, preferably 0.4 μm or smaller, and 0.3 μm or smaller. When the number average is too large, transparency may not be obtained.

The content ratio of coloring agents having a number average particle diameter greater than 0.7 μm is preferably not greater than 10% by number and more preferably not greater than 5% by number.

When the content is too large, the coloring agent may be detached from the surface of the toner, thereby causing fogging, contaminating the image bearing member 60, or causing poor cleaning performance.

In addition, the coloring agent is preferably mixed and kneaded with at least part of the binder resin together with moistening liquid.

Therefore, the binder resin and the coloring agent are sufficiently attached and the dispersion particle diameter of the coloring agent in the toner is sufficiently small, thereby improving the transparency.

When the coloring agent is preferably mixed and kneaded with at least part of the binder resin together with moistening liquid, these are mixed with a blender such as a HENSCE MIXER, and then mixed and kneaded by an kneading machine such as a two-roll, and a three-roll at a temperature lower than the melting point of the at least part of the binder resin.

There is no specific limit to the moistening liquid. Specific examples thereof include, but are not limited to, organic solvents such as acetone, toluene, and butanone, and water.

Among these, water is preferable in terms of sustaining the dispersion stability of the coloring agent.

Any known releasing agent can be suitably used. Specific examples of the release agent (wax) include, but are not limited to, polyolefin waxes such as polyethylene waxes and polypropylene waxes; long chain hydrocarbons such as paraffin waxes and SAZOL waxes; waxes including a carbonyl group, etc.

Among these waxes, the waxes including a carbonyl group are preferable.

Specific examples of the waxes including a carbonyl group include, but are not limited to, polyalkane acid esters such as carnauba wax, montan waxes, trimethylolpropane tribehenate, pentaerythritol tetrabehenate, pentaerythritol diacetate dibehenate, glycerin tribehenate, and 1,18-octadecanediol distearate; polyalkanol esters such as trimellitic acid tristearyl, and distearyl maleate; polyalkane acid amides such as ethylene diamine dibehebylamide; polyalkylamide such as trimellitic acid tristearylamide; dialkyl ketone such as distearyl ketone, etc.

Among these waxes, polyalkane acid esters are preferable.

The melting point of the releasing agent is from 40 to 160° C., more preferably from 50 to 120° C., and particularly preferably from 60 to 90° C.

When the melting point of the releasing agent is too low, the high temperature storage of the toner tends to deteriorate. By contrast, when the melting point is too high, a cold offset problem, i.e., an offset phenomenon that occurs at a low fixing temperature, tends to occur.

The releasing agent preferably has a melt viscosity of from 5 to 1,000 cps and more preferably from 10 to 100 cps at a temperature 20° C. higher than the melting point of the releasing agent.

When the melt viscosity is too high, the hot offset resistance and the low temperature fixing property may be reduced.

The content of the releasing agent in the toner is from 0 to 40% by weight and preferably from 3 to 30% by weight.

Any known charge control agent can be used. Specific examples thereof include, but are not limited to, triphenylmethane dyes, chelate pigments of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing surface active agents, metal salts of salicylic acid, metal salts of salicylic acid derivatives, quinacridone, and azo-based pigments.

Specific examples of the other charge control agents include, but are not limited to, polymers having a functional group such as a sulfonate group, a carboxyl group, or a quaternary ammonium group.

Specific examples of the marketed products of the charge control agents include, but are not limited to, BONTRON P-51 (quaternary ammonium salt), E-82 (metal complex of oxynaphthoic acid), E-84 (metal complex of salicylic acid), and E-89 (phenolic condensation product), all of which are manufactured by Orient Chemical Industries Co., Ltd.; TP-302 and TP-415 (molybdenum complex of quaternary ammonium salts), which are manufactured by Hodogaya Chemical Co., Ltd.; COPY CHARGE PSY VP2038 (quaternary ammonium salt), COPY BLUE PR (triphenyl methane derivative), COPY CHARGE NEG VP2036 and NX VP434 (quaternary ammonium salt), all of which are manufactured by Hoechst AG; LRA-901, and LR-147 (boron complex), which are manufactured by Japan Carlit Co., Ltd.

The content of the charge control agent in the toner is from 0.1 to 10% by weight, and more preferably from 0.2 to 5% by weight.

When the content is too large, the electrostatic attractive force with the development roller 50 tends to increase, or the fluidity of the development agent tends to decrease, or the image density tends to deteriorate.

The charge control agent can be mixed and kneaded with at least part of the binder resin followed by dissolution and dispersion in the organic solvent.

In order to remove the organic solvent, for example, there are a drying method in which the temperature of the system is gradually raised to evaporate and remove the organic solvent, and a method in which the reaction liquid is sprayed in a dry atmosphere to remove the organic solvent.

When spraying the reaction liquid into the dry atmosphere, a drying device such as a spray dryer, a belt dryer, a rotary kiln, etc. can be suitably used. The dry atmosphere can be prepared by heating gases such as air, nitrogen, carbon dioxide and combustion gases to a temperature equal to or higher than boiling point of the organic solvents.

The resultant can be subject to classification after the organic solvent is removed.

The classification can be conducted using a cyclone, a decanter, a centrifugal, etc. to remove fine particles.

At this point, the powder obtained by drying can be also classified.

The obtained mother particles can be mixed with other particles of a coloring agent, a release agent, a charge control agent, a fluidizer, a cleaning property improver, etc. Such mixed fine particles can be fixed on the surface of the mother toner particles by applying a mechanical impact thereto.

Specific examples of such mechanical impact application methods include, but are not limited to, a method in which an impact is applied to the mixture by using a blade rotating at a high speed, a method in which the mixture is put into a jet air to cause particles to collide against each other or into a collision plate.

Specific examples of such mechanical impact applicators include, but are not limited to, ONG MILL (manufactured by Hosokawa Micron Co., Ltd.), modified I TYPE MILL (manufactured by Nippon Pneumatic Mfg. Co., Ltd.) in which the pressure of pulverization air is reduced, HYBRIDIZATION SYSTEM (manufactured by Nara Machine Co., Ltd.), KRYPTRON SYSTEM (manufactured by Kawasaki Heavy Industries, Ltd.), automatic mortars, etc.

Any known fluidizer can be suitably used. Specific examples of such fluidizers include, but are not limited to, inorganic particles of silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc., and resin particles of polystyrene, (meth)acrylate copolymers, silicone, benzoguanamine, nylon, etc.

The primary particle diameter of the fluidizer is from 5 nm to 2 μm and preferably from 5 to 500 nm.

In addition, the specific surface area of the fluidizer measured by the BET method is preferably from 20 to 500 $m^2/g$.

The content of the fluidizer in the toner is from 0.01 to 5% by weight and preferably from 0.01 to 2.0% by weight.

It is preferable to use inorganic particles which are surface-treated by a surface preparation agent such as silane coupling agents, silyl agents, silane coupling agents having a fluorine alkyl group, organic titanate coupling agents, aluminum-based coupling agents, silicone oil, and modified-silicone oil.

Thereby, the fluidity and the chargeability are sustained in a high moisture environment.

Any known cleaning property improver can be suitably used. Specific examples thereof include, but are not limited to, aliphatic metal salts such as zinc stearate, and calcium stearate; resin particles such as polymethacrylate particles and polystyrene particles.

The resin particles have a volume average particle diameter of from 0.01 to 1 μm.

Pulverized toner is also suitably used as the toner of the present disclosure.

Such pulverized toner is manufactured by, for example, a method including optionally mixing a toner material containing a binder resin, a coloring agent, a releasing agent, and a charge control agent, mixing and kneading at a temperature equal to or lower than the melting point of the binder resin, and then cooling-down, pulverizing and classifying the mixture.

Any known binder resin can be suitably used. Specific examples of the binder resins for use in the toner include, but are not limited to, styrene polymers and substituted styrene homopolymers such as poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; homopolymers of acrylic esters or copolymers thereof such as polymethyl acrylate, polybutyl acrylate, polymethyl methacrylate, and polybutyl methacrylate; polyvinyl derivatives such as polyvinyl chloride and polyvinyl acetate; polyester-based polymers, polyurethane based polymers, polyamide based polymers, polyimide based polymers, polyol based polymers, epoxy based polymers, terpene based polymers, aliphatic or alicyclic hydro carbon resins and aromatic oil resins. These can be used alone or in combination.

Among these, styrene-acrylic based copolymers, polyester based resins, and polyol based resins are preferable in terms of electric characteristics and polyester based resins and polyol based resins are more preferable in terms of the fixing characteristics.

Similarly to the mother particles described above, the obtained mother particles can be mixed with other particles of a coloring agent, a release agent, a charge control agent, a fluidizer, a cleaning property improver, etc. Such mixed fine particles can be fixed on the surface of the mother toner particles by applying a mechanical impact thereto.

Having generally described (preferred embodiments of) this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Manufacturing Example 1

Manufacturing of Protective Agent Bar 1

A powder mixture of zinc stearate and zinc palmitate, both of which have an average particle diameter of 17 μm is placed in an aluminum mold having an inner size of 8 mm×350 mm, and compressed by using a hydraulic press until the mixture is compressed to 95% of the true specific gravity to obtain a bar having a thickness of 7 mm.

The both ends of the manufactured bar in the longitudinal direction are severed and the bottom face is cut to obtain [Protective agent bar 1] having a dimension of 7 mm×8 mm×310 mm. Double-faced adhesive tape is attached to the bottom of manufactured [Protective agent bar 1] to fix it to a metal support.

Manufacturing Example 2

Manufacturing of Protective Agent Bar 2

Boron nitride (BN, having an average particle diameter of 5 μm) is mixed and stirred with a mixture of zinc stearate and zinc palmitate, both of which have an average particle diameter of 17 μm such that the content of boron nitride is an amount of 3% by weight. The powder obtained after stirring is placed into an aluminum die having an inside dimension of 8 mm×350 mm and pressed by a hydraulic pressing machine to 95% of the true specific gravity to manufacture a protective agent bar having a thickness of 7 mm. The both ends of the manufactured bar in the longitudinal direction are severed and the bottom face is cut to obtain [Protective agent bar 2] having a dimension of 7 mm×8 mm×310 mm.

Double-faced adhesive tape is attached to the bottom of manufactured [Protective agent bar 2] to fix it to a metal support.

Manufacturing Example 3

Manufacturing of Protective Agent Bar 3

Boron nitride (BN, having an average particle diameter of 5 μm) is mixed and stirred with a mixture of zinc stearate and zinc palmitate, both of which have an average particle diameter of 17 μm such that the content of boron nitride is an amount of 30% by weight. The powder obtained after stirring is placed into an aluminum die having an inside dimension of 8 mm×350 mm and pressed by a hydraulic pressing machine to 95% of the true specific gravity to manufacture a protective agent bar having a thickness of 7 mm. The both ends of the manufactured bar in the longitudinal direction are severed and the bottom face is cut to obtain [Protective agent bar 3] having a dimension of 7 mm×8 mm×310 mm. Double-faced adhesive tape is attached to the bottom of manufactured [Protective agent bar 3] to fix it to a metal support.

Manufacturing Example 4

Manufacturing of Protective Agent Bar 4

Boron nitride (BN, having an average particle diameter of 5 μm) is mixed and stirred with a mixture of zinc stearate and zinc palmitate, both of which have an average particle diameter of 17 μm such that the content of boron nitride is an amount of 35% by weight. The powder obtained after stirring is placed into an aluminum die having an inside dimension of 8 mm×350 mm and pressed by a hydraulic pressing machine to 95% of the true specific gravity to manufacture a protective agent bar having a thickness of 7 mm.

The both ends of the manufactured bar in the longitudinal direction are severed and the bottom face is cut to obtain [Protective agent bar 4] having a dimension of 7 mm×8 mm×310 mm. Double-faced adhesive tape is attached to the bottom of manufactured [Protective agent bar 4] to fix it to a metal support.

Manufacturing Example 5

Manufacturing of Protective Agent Bar 5

Powder of boron nitride (BN, having an average particle diameter of 5 μm) and powder of spherical alumina particles having an average particle diameter of 0.3 μm are mixed and stirred with a mixture of zinc stearate and zinc palmitate, both of which have an average particle diameter of 17 μm such that the contents thereof are shown in table 1. The powder obtained after stirring is placed into an aluminum die having an inside dimension of 8 mm×350 mm and pressed by a hydraulic pressing machine to 95% of the true specific gravity to manufacture a protective agent bar having a thickness of 7 mm.

The both ends of the manufactured bar in the longitudinal direction are severed and the bottom face is cut to obtain [Protective agent bar 5] having a dimension of 7 mm×8 mm×310 mm. Double-faced adhesive tape is attached to the bottom of the protective agent bar 5 to fix it to a metal support.

The weight ratio of zinc stearate and zinc palmitate, and the weight ratio of the metal soap (=zinc stearate and zinc palmitate) and boron nitride, and the ratio of alumina to the metal soap are shown in Table 1.

TABLE 1

| Protective agent No. | Ratio (Weight %) of zinc stearate and zinc palmitate in metal soap: Zinc stearate | Zinc palmitate | Ratio of metal soap and boron nitride (metal soap/boron nitride) | Ratio of alumina to weight of metal soap | Memo |
|---|---|---|---|---|---|
| 1 | 55 | 45 | — | — | Used in Examples 13 to 17 and Comparative Examples 6 and 7 |
| 2 | 66 | 34 | 97/3 | — | Used in Examples 18 to 20 |
| 3 | 40 | 60 | 70/30 | — | Used in Examples 21 and 23 |
| 4 | 50 | 50 | 65/35 | — | Used in Examples 22 |
| 5 | 40 | 60 | 70/30 | 4% by weight | Used in Examples 24 |

Manufacturing Example 6

Manufacturing of Image Bearing Member

Liquid applications of an undercoating layer, a charge generation layer, a charge transport layer and a surface layer are sequentially applied to an aluminum drum (electroconductive substrate) having a diameter of 40 mm, and then dried to manufacture an image bearing member having an undercoating layer having a thickness of 3.6 μm, a charge generation layer having a thickness of 0.14 μm, a charge transport layer having a thickness of 23 μm, and a surface layer having a thickness of 3.5 μm.

The surface layer is applied by a spraying method and the other layers are applied by a dip coating method.

| Liquid Application for Undercoating Layer | |
|---|---|
| Alkyd resin (Beckozole 1307-60-EL, manufactured by Dainippon Ink and Chemicals, Inc.) | 6 parts |
| Melamine resin (SuperBeckamine G-821-60, manufactured by Dainippon Ink and Chemicals, Inc.) | 4 parts |
| Titanium Oxide | 40 parts |
| Methylethylketone | 20 parts |

| Liquid Application for Charge Generation Layer | |
|---|---|
| Y type oxotitanyl phthalocyanine pigment | 2 parts |
| Polyvinyl butyral (S-LEC BM-S, manufactured by Sekisui Chemical Co., Ltd.) | 0.2 parts |
| Tetrahydrofuran | 50 parts |

| Liquid Application for Charge Transport Layer | |
|---|---|
| Bisphenol A type polycarbonate (PANLITE K1300, manufactured by Teijin Chemicals Ltd.) | 10 parts |
| Charge transport material having a low molecular weight represented by the following chemical structure (1) | 10 parts |
| Chemical structure (1) | |

-continued

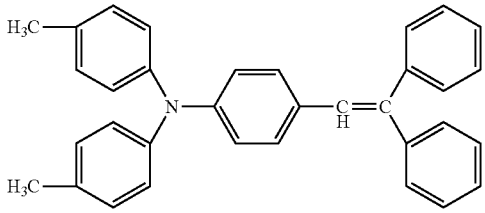

| | |
|---|---|
| Methylene chloride | 100 parts |

| Liquid Application for Surface Layer | |
|---|---|
| Polycarbonate | 10 parts |
| Charge transport material having a low molecular weight represented by the Chemical structure (1) illustrated above | 7 parts |
| Alumina particulate (particle center diameter: 0.3 μm): | 6 parts |
| Dispersion helping agent (BYK-P104, manufactured by BYK Chemie Japan) | 0.08 parts |
| Tetrahydrofuran | 700 parts |
| Cyclohexanone | 200 parts |

Example 1

Manufacturing of Image Bearing Member 1

The image bearing member manufactured in Manufacturing Example 6 is beaten by a cloth having a fine opening (MICROWIPE MU2000, manufactured by MCC CO., Ltd.), which wraps boron nitride (BN, having an average particle diameter of 5 μm) to cause the powder of boron nitride attached to the surface of the image bearing member. Thus, [Image bearing member 1] is manufactured.

The force of beating the image bearing member is 65 g and multiple image bearing members are manufactured on which the powder of BN is attached under the same condition.

With regard to [Image bearing member 1], the attachment amount of boron nitride and the variance thereof in the longitudinal direction of the image bearing member 1 are obtained according to ICP optical emission spectrochemical analysis.

ICP optical emission spectrochemical analysis is conducted as follows: Peel the photosensitive layer from the image bearing member 1 to prepare an analysis sample; The analysis sample is peeled to have a strip having a size of 5 can in the longitudinal direction and one round in the circumferential direction; Six strips of analysis samples are obtained from one image bearing member; Place the six strips of the photosensitive layer, nitric acid, and sulfuric acid into six corresponding containers with airtight stoppers; Irradiate the containers with microwave to heat and decompose the strips of photosensitive layer followed by constant volume by ultrapure water to obtain a sample solution; Determine quantity of boron in the sample solution with an ICP optical emission spectrochemical analyzer (SPS 5100 type, manufactured by SII NanoTechnology Inc.); Divide the conversion value of boron nitride obtained by the quantified boron with the length (5 cm) along the longitudinal direction to obtain the attachment amount (mg/cm) of boron nitride per unit of length; and Calculate the average of the attachment amount (mg/cm) of boron nitride of the six strips of analysis samples.

The attachment amount (average) (mg/cm) of boron nitride attached to the image bearing member is shown in Table 2.

In addition, to obtain the variance of boron nitride in the longitudinal direction, the average of the attachment amount of boron nitride attached to the six strips of analysis samples is calculated. Then, the difference (absolute value) of the obtained average value and each measured value is calculated and divided by the average value to obtain the variance using the following relationship.

The maximum among the variances obtained for the six strips of analysis samples is shown in Table 2.

$$\text{Variance}(\%)=(|\text{Actual value}-\text{Average}|)/\text{Average}\times 100 \quad \text{Relationship 3}$$

Example 2

Manufacturing of Image Bearing Member 2

A mixture of boron nitride having an average particle diameter of 5 μm and a metal soap (a mixture of zinc stearate and zinc palmitate, both of which have an average particle diameter of 17 μm), is stirred and pressed by a hydraulic press once to mold a bar by the same manufacturing method as described in [Protective agent bars 2 to 4]. The bar is pulverized to obtain powder. The image bearing member manufactured in Manufacturing Example 6 is beaten by a cloth having a fine opening (MICROWIPE MU2000, manufactured by MCC CO., Ltd.), which wraps the powder of boron nitride and the metal soap to cause the powder attached to the surface of the image bearing member. Thus, [Image bearing member 2] is manufactured.

The force of beating the image bearing member is 25 g.

The powder obtained after pressing once and pulverization is analyzed by an ICP optical emission spectrochemical analyzer (SPS 5100 type, manufactured by SII NanoTechnology Inc.) and the weight ratio of the metal soap (mixture of zinc stearate and zinc palmitate) and boron nitride is found to be 70/30 (metal soap/boron nitride).

The attachment amount (average) (mg/cm) of boron nitride attached to the image bearing member and the maximum of the variance of the six analysis samples are calculated.

The attachment amount (average) (mg/cm) of boron nitride and the maximum among the variances are shown in Table 2.

Examples 3 to 7

Manufacturing of Image Bearing Members 3 to 7

[Image bearing members 3 to 7] are manufactured in the same manner as in Example 1 except that the image bearing member manufactured in Manufacturing Example 6 is beaten by a cloth having a fine opening (MICROWIPE MU2000, manufactured by MCC CO., Ltd.), which wraps the powder of boron nitride with a force of 75 g, 4 g, 30 g, 2 g, and 90 g, respectively.

The attachment amount (average) (mg/cm) of boron nitride attached to the image bearing member and the maximum of the variance of the six analysis samples are calculated for each of [Image bearing members 3 to 7] in the same manner as for [Image bearing member 1].

The attachment amount (average) (mg/cm) of boron nitride and the maximum among the variances are shown in Table 2.

Examples 8 to 10

Manufacturing of Image Bearing Members 8 to 10

[Image bearing members 8 to 10] are manufactured in the same manner as in Example 2 except that the image bearing member manufactured in Manufacturing Example 6 is beaten by a cloth having a fine opening (MICROWIPE MU2000, manufactured by MCC CO., Ltd.), which wraps the powder of boron nitride and the metal soap (a mixture of zinc stearate and zinc palmitate) with a force of 30 g, 30 g, and 3 g, respectively.

According to the analysis using the ICP optical emission spectrochemical analyzer, the weight ratio of the metal soap (mixture of zinc stearate and zinc palmitate) and boron nitride is found to be 40/60, 91/9, and 10/60 for [Image bearing member 8], [Image bearing member 9], and [Image bearing member 10], respectively.

The attachment amount (average) (mg/cm) of boron nitride attached to the image bearing member and the maximum of the variance of the six analysis samples are calculated for each of [Image bearing members 8 to 10] in the same manner as for [Image bearing member 1]. The attachment amount (average) (mg/cm) of boron nitride and the maximum among the variances are shown in Table 2.

Comparative Example 1

Manufacturing of Image Bearing Member 11

The image bearing member manufactured in Manufacturing Example 6 is used as [Image bearing member 11].

Comparative Example 2

Manufacturing of Image Bearing Member 12

The image bearing member manufactured in Manufacturing Example 6 is beaten by a cloth having a fine opening (MICROWIPE MU2000, manufactured by MCC CO., Ltd.), which wraps powder of the metal soap (prepared by pulverization of [Protective agent bar 1]) to cause the powder of boron nitride attached to the surface of the image bearing member. Thus, [Image bearing member 12] having 10 mg of the powder attached to its surface is manufactured. The force of beating the image bearing member is 30 g.

Comparative Example 3

Manufacturing of Image Bearing Member 13

The image bearing member manufactured in Manufacturing Example 6 is beaten by a cloth having a fine opening (MICROWIPE MU2000, manufactured by MCC CO., Ltd.), which wraps polymethyl methacrylate resin (PMMA, having an average particle diameter of 0.4 μm) to cause the powder attached to the surface of the image bearing member. Thus, [Image bearing member 13] having 10 mg of the powder of PMMA attached to its surface is manufactured.

The force of beating the image bearing member is 30 g.

TABLE 2

| | Image bearing member | Material applied to image bearing member | Weight ratio of metal soap and boron nitride (metal soap/boron nitride) | Weight of boron nitride attached to image bearing member | Maximum of variance (%) | Memo |
|---|---|---|---|---|---|---|
| Example 1 | Image bearing member 1 | Boron nitride | — | 0.77 | 3 | Used in Example 11 |
| Example 2 | Image bearing member 2 | Boron nitride and metal soap | 70/30 | 0.28 | 9 | Used in Examples 12 and 18 |
| Example 3 | Image bearing member 3 | Boron nitride | — | 0.83 | 10 | Used in Examples 13, 21 and 22 |
| Example 4 | Image bearing member 4 | Boron nitride | — | 0.003 | 5 | Used in Example 14 |
| Example 5 | Image bearing member 5 | Boron nitride | — | 0.3 | 9 | Used in Example 15 |
| Example 6 | Image bearing member 6 | Boron nitride | — | 0.001 | 3 | Used in Example 16 |
| Example 7 | Image bearing member 7 | Boron nitride | — | 1.01 | 2 | Used in Example 17 |
| Example 8 | Image bearing member 8 | Boron nitride and metal soap | 40/60 | 0.3 | 20 | Used in Example 19 |
| Example 9 | Image bearing member 9 | Boron nitride and metal soap | 91/9 | 0.31 | 13 | Used in Example 20 |
| Example 10 | Image bearing member 10 | Boron nitride and metal soap | 40/60 | 0.002 | 4 | Used in Examples 23 and 24 |
| Comparative Example 1 | Image bearing member 11 | None | — | — | — | Used in Comparative Examples 4 and 6 |
| Comparative Example 2 | Image bearing member 12 | Metal soap | — | — | — | Used in Comparative Example 5 |
| Comparative Example 3 | Image bearing member 13 | PMMA | — | — | — | Used in Comparative Example 7 |

Example 11

Image Formation

As shown in Table 3, [Image bearing member 60] is used in the image forming apparatus (imagio MPC4500, a tandem type color image forming apparatus, manufactured by Ricoh Co., Ltd.) including multiple image formation portions (process cartridges) having a protective layer formation device. The protective agent applicator blade is replaced with a blade that contacts the image bearing member at an obtuse angle) (120°) for evaluation.

The image forming apparatus is evaluated under the conditions that the linear speed of the image bearing member is 125 mm/s and a voltage in which AC voltage having an amplitude of 1,100 V with a frequency of 1,450 Hz is overlapped with DC voltage of −600 V is applied between the image bearing member and the charging roller.

The evaluation is conducted in a low temperature (15° C.) and low humidity (20% RH) environment.

ISO test chart (refer to http:www.iso.org/jtc1/sc28 for ISO/IEC JTC 1/SC 28) is used as the output chart for evaluation.

The protective agent blade is formed of urethane.

Evaluation on Whether Lubricant is Present on Blade

After outputting 5,000 ISO test chart on 5,000 sheets, the powder attached to the protective agent applicator blade is gently scraped off by a spatula. Whether boron nitride, metal soap or PMMA is attached is checked by using an ICP optical emission spectrochemical analyzer (SPS 5100 type, manufactured by SII NanoTechnology Inc.), and a Fourier transform infrared spectrophotometer (FT/IR6100, manufactured by JASCO Corporation).

To conduct ICP optical emission spectrochemical analysis, at least a certain amount of the powder is necessary. Therefore, image output is conducted multiple times under the same condition to retrieve analysis samples for ICP optical emission spectrochemical analysis.

In addition, since there are other materials attached to the blade which cannot be retrieved by the spatula, the powder remaining on the blade is wiped off by MICROWIPE. Thereafter, the powder retrieved by the spatula and the attachment on the MICROWIPE are analyzed by an ICP optical emission spectrochemical analyzer.

Furthermore, similarly for the Fourier Transform Infrared Spectrophotometer analysis, image output is conducted multiple times under the same condition and the powder attached to the protective agent applicator blade for each image formation is retrieved therefrom and powder of KBr is coated to the blade. Then, the coated KBr is retrieved again and a tablet for analysis sample is formed of all the retrieved powder for analysis.

Whether boron nitride is present is determined by whether boron is detected by ICP optical emission spectrochemical analysis, and whether the metal soap and PMMA are detected is present by the peaks according to FT-IR.

The results are shown in Table 3.

Evaluation Criteria

G (Good) (boron): boron is detected by ICP optical emission spectrochemical analysis B (Bad) 8boron): boron is not detected by ICP optical emission spectrochemical analysis or under the quantitation limit G (Good) (metal soap): metal soap is detected by IR analysis B (Bad) (metal soap): metal soap is not detected by IR analysis or under the quantitation limit G (Good) (PMMA): PMMA is detected by IR analysis B (Bad) (PMMA): PMMA is not detected by IR analysis or under the quantitation limit Image Evaluation The ISO test chart is output on 60,000 sheets and the output images on 10th sheet, 5,000th sheet, 10,000th sheet, 50,000th sheet, and 60,000th sheet are observed by naked eyes or a microscope and evaluated.

The results are shown in Table 3.

Evaluation Criteria

E (Excellent): quality image

F (Fair): Slightly inferior portions are observed not by naked eyes but with a microscope (no practical problem)

B (Bad): Abnormal image

Examples 12 and 24 and Comparative Examples 4 and 7

Under the conditions of the image bearing member, the protective agent bar, the brush, and the spring pressure with which the protective agent is pressed against the brush shown in Table 3, images for Examples 12 to 24, and Comparative Examples 4 to 7 are formed in the same manner as in Example 11. Whether the lubricant is present on the blade is determined and the images are evaluated in the same manner as in Example 11.

The results are shown in Tables 3-1 and 3-2.

TABLE 3-1

| | | | Brush | | | | |
|---|---|---|---|---|---|---|---|
| | Image bearing member No. | Protective agent No. | Kind of brush | Breadth of fiber (hair) (denier) | Hairs/ $m^2$ | Spring pressure (N) | Linear speed (mm/s) |
| Example 11 | Image bearing member 1 | — | — | — | — | — | 125 |
| Example 12 | Image bearing member 2 | — | — | — | — | — | 125 |
| Example 13 | Image bearing member 3 | 1 | C | 10 | 50,000 | 5.0 | 125 |
| Example 14 | Image bearing member 4 | 1 | C | 10 | 50,000 | 5.0 | 125 |
| Example 15 | Image bearing member 5 | 1 | C | 10 | 50,000 | 6.0 | 125 |
| Example 16 | Image bearing member 6 | 1 | C | 10 | 50,000 | 5.0 | 125 |
| Example 17 | Image bearing member 7 | 1 | B | 20 | 50,000 | 8.0 | 125 |
| Example 18 | Image bearing member 8 | 2 | C | 10 | 50,000 | 5.0 | 125 |
| Example 19 | Image bearing member 9 | 2 | C | 10 | 50,000 | 5.0 | 125 |
| Example 20 | Image bearing member 3 | 2 | C | 10 | 50,000 | 4.0 | 125 |
| Example 21 | Image bearing member 3 | 3 | C | 10 | 50,000 | 5.0 | 125 |
| Example 22 | Image bearing member 3 | 4 | C | 10 | 50,000 | 5.0 | 125 |
| Example 23 | Image bearing member 10 | 3 | B | 20 | 50,000 | 3.2 | 125 |
| Example 24 | Image bearing member 10 | 5 | B | 20 | 50,000 | 3.2 | 125 |
| Comparative Example 4 | Image bearing member 11 | — | — | — | — | — | 125 |
| Comparative Example 5 | Image bearing member 12 | — | — | — | — | — | 125 |
| Comparative Example 6 | Image bearing member 11 | 1 | B | 20 | 50,000 | 3.2 | 125 |
| Comparative Example 7 | Image bearing member 13 | 1 | A | 5.3 | 50,000 | 4.0 | 125 |

* Kind of brush A: 5.3 denier; the number of fibers: 50,000; knitted brush (=brush in which brush fiber is knitted in the base cloth)
* Kind of brush B: 20 denier; the number of fibers: 50,000; knitted brush (=brush in which brush fiber is knitted in the base cloth)
* Kind of brush C: 10 denier; the number of fibers: 50,000; and electrostatically planted brush

TABLE 3-2

| | Lubricant on blade after 5,000 image outputs (Y = Yes, N = No) | Evaluation after 10 image outputs | Evaluation after 5,000 image outputs | Evaluation after 10,000 image outputs | Evaluation after 50,000 image outputs | Evaluation after 60,000 image outputs |
|---|---|---|---|---|---|---|
| Example 11 | Y (boron nitride)<br>N (metal soap) | E | E | E | E | F |
| Example 12 | Y (boron nitride)<br>Y (metal soap) | E | E | E | E | F |
| Example 13 | Y (boron nitride)<br>Y (metal soap) | E | E | E | E | E |
| Example 14 | Y (boron nitride)<br>Y (metal soap) | E | E | E | E | E |
| Example 15 | Y (boron nitride)<br>Y (metal soap) | E | E | E | E | E |
| Example 16 | Y (boron nitride)<br>Y (metal soap) | E | E | E | F | F |
| Example 17 | Y (boron nitride)<br>Y (metal soap) | F | F | F | F | F |

TABLE 3-2-continued

| | Lubricant on blade after 5,000 image outputs (Y = Yes, N = No) | Evaluation after 10 image outputs | Evaluation after 5,000 image outputs | Evaluation after 10,000 image outputs | Evaluation after 50,000 image outputs | Evaluation after 60,000 image outputs |
|---|---|---|---|---|---|---|
| Example 18 | Y (boron nitride) Y (metal soap) | E | E | E | E | E |
| Example 19 | Y (boron nitride) Y (metal soap) | E | E | E | E | E |
| Example 20 | Y (boron nitride) Y (metal soap) | E | E | F | F | F |
| Example 21 | Y (boron nitride) Y (metal soap) | E | E | E | E | E |
| Example 22 | Y (boron nitride) Y (metal soap) | E | E | E | F | F |
| Example 23 | Y (boron nitride) Y (metal soap) | E | E | E | E | E |
| Example 24 | Y (boron nitride) Y (metal soap) | E | E | E | E | E |
| Comparative Example 4 | N (boron nitride) N (metal soap) | E | F | B | B | B |
| Comparative Example 5 | N (boron nitride) N (metal soap) | E | F | B | B | B |
| Comparative Example 6 | N (boron nitride) Y (metal soap) | E | E | F | B | B |
| Comparative Example 7 | N (boron nitride) N (PMMA) | E | F | B | B | B |

As a result of the image evaluation, 10th and 5,000th output images are observed with naked eyes and the quality of image is maintained.

As a result of observation of 10,000th image with naked eyes, the formed image is evaluated as high quality. The 50,000th output image and 60,000 the image are observed with naked eyes and evaluated as high quality.

Furthermore, 10th and 5,000th output images of Examples 11 to 24 are observed with a microscope. Although the dot size is slightly broadened with regard to the 10th image and 5,000th image of Example 17, the 10th images and 5,000th images of Examples other than Example 17 are orderly arranged.

The output images of Example 17 and other Examples are compared with naked eyes again but there is no practical difference between these images.

Next, 10,000th output images of Examples 11 to 24 are observed with a microscope for comparison. Although the dot size is slightly broadened with regard to the 10,000th image of Example 17 and the dot concentration slightly varies with regard to the 10,000th image of Example 20, the 10,000th images of Examples other than Examples 17 and 20 are orderly arranged. The output images of Examples 17 and 20, and other Examples are compared with naked eyes again but there is no practical difference between these images.

Next, 50,000th output images of Examples 11 to 24 are observed with a microscope for comparison. Although the dot size is slightly broadened with regard to the 50,000th images of Examples 17 and 22, and the dot concentration slightly varies with regard to the 10,000th images of Examples 16 and 20, the 50,000th images of Examples other than Examples 16, 17, 20, and 22 are orderly arranged. The output images of Examples 16, 17, 20, and 22 are compared with and the images of other Examples with naked eyes again but there is no practical difference between these images.

Next, 60,000th output images of Examples 11 to 24 are observed with a microscope for comparison. The results are the same in the case of 50,000th image except for Examples 11 and 12. The 60,000th output images of Examples 11 and 12 slightly vary in comparison with the 50,000th output images thereof.

The output images of Examples 11 to 24 are compared with naked eyes again but there is no practical difference between these images.

As a result of the image evaluation, 10th and 5,000th output images of Comparative Examples 4 to 7 are observed with naked eyes and the quality of image is maintained.

Next, 10,000th images are observed with naked eyes for evaluation. The image quality is maintained in Comparative Example 6. However, a slight black band is observed in Comparative Examples 4 and 5, and slight streak deficiency and alight fouling in no image portion (=background portion) are observed in Comparative Example 7.

In addition, the obtained image appears rough.

Next, 50,000th and 60,000th images are observed with naked eyes for evaluation. A slight black band is observed in Comparative Examples 4, 5 and 6 for both images, and slight streak deficiency and alight fouling in no image portion (=background portion) are observed in Comparative Example 7 for both images. In addition, the obtained image appears rough.

Next, 10th output images of Comparative Examples 4 to 7 and Example 11 are observed with a microscope for comparison. The dots are orderly arranged in all the output images.

Next, 5,000th output images of Comparative Examples 4 to 11 and Example 11 are observed with a microscope for comparison. Although the dot concentration is locally slightly dense in the images of Comparative Examples 4 and 5, and the dot concentration locally varies slightly and fouling is observed in no image portion (=background portion) more in Comparative Example 7 than the other output images, the output images of Comparative Example 6 and Example 11 are orderly arranged. The output images of Comparative Examples 4 to 11 and Example 11 are compared with naked eyes again but there is no practical difference between these images.

Next, 10,000th output images of Comparative Example 6 and Example 11 are observed with a microscope for comparison. Although the dot concentration is locally slightly dense in the images of Comparative Example 6, the 10,000th image of Example 11 are orderly arranged.

The output images of Comparative Example 6 and Example 11 are compared with naked eyes again but there is no practical difference between these images.

Manufacturing of Toner

Preparation of Liquid Dispersion of Resin Particles

The following recipe is placed in a reaction container equipped with a stirrer and a thermometer and stirred at 400 rpm for 15 minutes to obtain white emulsion.

| | |
|---|---|
| Water | 683 parts |
| Sodium salt of sulfate of an adduct of methacrylic acid with ethyleneoxide (EREMINOR RS-30, manufactured by Sanyo Chemical Industries, Ltd.) | 11 parts |
| Styrene | 79 parts |
| Methacrylic acid | 79 parts |
| Butyl acrylate | 105 parts |
| Divinyl benzene | 13 parts |
| Ammonium persulfate | 1 part |

Next, the system is heated to 75° C. and reacted for 5 hours. Furthermore, 30 parts of 1 weight % aqueous solution of ammonium persulfate is added and the system is aged for 5 hours at 75° C. to obtain a liquid dispersion [Liquid dispersion 1] of resin particles.

The weight average particle diameter of [Liquid dispersion 1] of the resin particles measured by using LA-920 is 105 nm.

Resin obtained by drying part of [Liquid dispersion 1] of the resin particles has a glass transition temperature of 95° C., a number average molecular weight of 140,000, and a weight average molecular weight of 980,000.

The following recipe is placed in a reaction container equipped with a stirrer and a thermometer and stirred at 400 rpm for 15 minutes to obtain white emulsion.

| | |
|---|---|
| Water | 683 parts |
| Sodium salt of sulfate of an adduct of methacrylic acid with ethyleneoxide (EREMINOR RS-30, manufactured by Sanyo Chemical Industries, Ltd.) | 11 parts |
| Styrene | 83 parts |
| Methacrylic acid | 83 parts |
| Butyl acrylate | 110 parts |
| Ammonium persulfate | 1 part |

Next, the system is heated to 75° C. and reacted for 5 hours. Furthermore, 30 parts of 1 weight % aqueous solution of ammonium persulfate is added and the system is aged for 5 hours at 75° C. to obtain [Liquid dispersion 2] of resin particles. The weight average particle diameter of [Liquid dispersion 2] of the resin particles measured by using LA-920 is 100 nm. Resin obtained by drying part of [Liquid dispersion 2] of the resin particles has a glass transition temperature of 80° C., a number average molecular weight of 1,700, and a weight average molecular weight of 10,000.

Synthesis of Polyester

The following components are placed in a container equipped with a condenser, a stirrer and a nitrogen introducing tube to conduct a reaction at 230° C. at normal pressure for 8 hours followed by another reaction for 5 hours with a reduced pressure of 10 to 15 mmHg and 45 parts by weight of trimellitic anhydride is added to the reaction container to conduct a reaction at 180° C. for 2 hours to obtain [Polyester 1].

| | |
|---|---|
| Adduct of bisphenol A with 2 mole of ethylene oxide | 220 parts |
| Adduct of bisphenol A with 3 mole of propylene oxide | 561 parts |
| Terephthalic acid | 218 parts |
| Adipic acid | 48 parts |
| Dibutyl tin oxide | 2 parts |

[Polyester 1] has a number average molecular weight of 2,500, and a weight average molecular weight of 6,700, a glass transition temperature of 43° C. and an acid value of 25 mgKOH/g.

Synthesis of Polyester Prepolymer

The following recipe is placed in a container equipped with a condenser, a stirrer and a nitrogen introducing tube to conduct a reaction at 230° C. for 8 hours followed by another reaction for 5 hours with a reduced pressure of 10 to 15 mmHg to synthesize a polyester having a hydroxyl group:

| | |
|---|---|
| Adduct of bisphenol A with 2 mole of ethylene oxide | 682 parts |
| Adduct of bisphenol A with 2 mole of propylene oxide: | 81 parts |
| Terephthalic acid: | 283 parts |
| Trimellitic anhydride: | 22 parts |
| Dibutyl tin oxide: | 2 parts |

The polyester having a hydroxyl group has a number average molecular weight of 2,100, and a weight average molecular weight of 9,500, a glass transition temperature of 55° C., an acid value of 0.5 mgKOH/g. and a hydroxyl value of 49 mgKOH/g.

Next, 411 parts of the polyester having a hydroxyl group, 89 parts of isophorone diisocyanate, and 500 parts of ethyl acetate are placed in a reaction container equipped with a condenser, stirrer and a nitrogen introducing tube to conduct reaction at 100° C. for 5 hours to prepare [Polyester prepolymer 1]. [Polyester prepolymer 1] has an isolated isocyanate amount of 1.53% by weight.

Synthesis of Ketimine

In a reaction container equipped with a stirrer and a thermometer, 170 parts of isophoronediamine and 75 parts of methyl ethyl ketone are mixed to conduct reaction at 50° C. for 5 hours to obtain [Ketimine 1]. [Ketimine 1] has an amine value of 418 mgKOH/g.

Preparation of Master Batch 40 parts of carbon black (REGUL 400R, manufactured by Cabot Corporation), 60 parts of polyester resin (RS-801 having an acid value of 10 mgKOH/g, a weight average molecular weight of 20,000, and a glass transition temperature of 64° C., manufactured by Sanyo Chemical Industries.) and 30 parts of water are mixed by a HENSCHEL MIXER The mixture is mixed and kneaded for 45 minutes by two rolls where the temperature of the surface is set at 130° C. and pulverized by a pulverizer (manufactured by Hosokawa Micron Corporation) to a size having a diameter of 1 mm. Thus, [Master batch 1] is obtained.

Preparation of Toner Liquid Material

The following components are placed in a reacting container equipped with a stirrer and a thermometer.

| | |
|---|---|
| [Polyester 1] | 378 parts |
| Carnauba wax | 110 parts |
| CCA (salicylic acid metal complex E-84 manufactured by Orient Chemical Industries, Ltd.) | 22 parts |
| Ethyl acetate | 947 parts |

The system is heated to a temperature of 80° C. while stirring and maintain 80° C. for 5 hours followed by cooling down to 30° C. in one hour.

Then, 500 parts of [Master Batch 1] and 500 parts of ethyl acetate are added in the container and mixed for one hour; 1,324 parts of the obtained liquid mixture is moved to a container and dispersion is conducted under the condition of liquid transfer speed of 1 kg/hour, disc circumference speed of 6 m/sec, 80 volume % filling of 0.5 mm zirconia beads, and 3 pass using a beads mill (ULTRAVISCOMILL, manufactured by Aimex Co., Ltd.).

Then, 1,324 parts of [Polyester 1] of 65% ethyl acetate solution is added and a liquid dispersion is obtained by using ULTRAVISCOMILL (manufactured by Aimex Co., Ltd.) with 1 pass under the conditions specified above.

The liquid dispersion has a solid portion density (130° C. for 30 minutes) of 50% by weight.

648 parts of the obtained liquid dispersion, 154 parts of [Polyester Prepolymer 1], and 6.6 parts of [Ketimine 1] are placed in a container and mixed at 5,000 rpm for one minute by a TK HOMOMIXER (manufactured by Primix Corporation) to obtain [Toner liquid material 1].

Preparation of Slurry

The following components are placed in a container and mixed at 3,000 rpm for one minute by a TK HOMOMIXER (manufactured by Primix Corporation).

| | |
|---|---|
| Water | 990 parts |
| [Liquid dispersion 1] of resin particles | 8 parts |
| [Liquid dispersion 2] of resin particles | 72 parts |
| 48.5% by weight aqueous solution of sodium dodecyldiphenyl etherdisulfonate (EREMINOR MON-7 from Sanyo Chemical Industries, Ltd.) | 40 parts |
| Ethyl acetate | 90 parts |

809 parts of [Toner liquid material 1] is added and the resultant is mixed at 13,000 rpm for 20 minutes by a TK HOMOMIXER (manufactured by Primix Corporation).

Furthermore, the liquid mixture is placed in a reaction container equipped with a stirrer and a thermometer followed by removal of the solvent at 30° C. for 8 hours. Subsequent to a four hour aging at 45° C., [Slurry 1] is obtained.

Washing, Drying and Classification 100 parts of [Slurry 1] is filtered with a reduced pressure to obtain a filtered cake.

Then, 300 parts of deionized water is added to the filtered cake and the resultant is mixed by a TK HOMOMIXER at 12,000 rpm for 10 minutes followed by filtration. This process is repeated three times.

The obtained filtered cake is dried by a circulation drier at 45° C. for 48 hours. The dried cake is sieved by using a screen having an opening of 75 μm to obtain [Mother toner particle 1].

Addition of Fluidizer

Silica that is surface treated by using hexamithyl disilazane having an average particle diameter of 12 nm is added to [Mother particle 1] such that the content of the silica in the toner is 2.0% by weight. The resultant is mixed for two minutes by using a HENSCHEL MIXER (manufactured by Mitsui Mining Company, Limited) to obtain a toner.

The particle size distribution of the toner is measured by using a flow type particle image analyzer FPIA-2100 (manufactured by SYSMEX CORPORATION). The toner has a weight average particle diameter of 5.30 μm, a number average particle diameter of 4.65 μm, and an average circularity of 0.97.

Manufacturing of Image Bearing Member

A liquid application for undercoating layer containing 6 parts of alkyd resin (Beckozole 1307-60-EL, manufactured by Dainippon Ink and Chemicals, Inc.), 4 parts of melamine resin (Super-beckamine G-821-60, manufactured by Dainippon Ink and Chemicals, Inc.), 40 parts of titanium oxide, and 200 parts of methylethyl ketone are applied to an aluminum drum (=electroconductive substrate) having an outer diameter of 40 mm by dip coating by drying to obtain an undercoating layer having a thickness of 3.6 μm.

Next, a liquid application for charge generation layer containing 2 parts of Y type oxotitanyl phthalocyanine pigment, 0.2 parts of polyvinyl butyral (S-LEC, BM-S, manufactured by SEKISUI CHEMICAL CO., LTD.), and 50 parts of tetrahydrofuran is applied by dip coating to the electroconductive substrate on which the undercoating layer is formed followed by drying to obtain a charge generation layer having a thickness of 0.14 μm.

Furthermore, a liquid application for charge transport layer containing 10 parts of bisphenol A type polycarbonate (Panlite K1300, manufactured by Teijin Corporation), 10 parts of a charge transport material A represented by the following chemical structure 2, and 100 parts of methylene chloride are applied by dip coating to the electroconductive substrate on which the charge generation layer is formed followed by drying to obtain a charge transport layer having a thickness of 23 μm.

Chemical structure 2

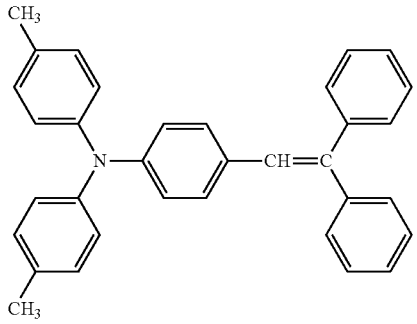

Finally, a liquid application for a surface layer containing 10 parts of Z type polycarbonate, 7 parts of the charge transport material A, 6 parts of alumina particles having an average particle diameter of 0.3 μm, 0.08 parts of a dispersion helper (BYK-P104, manufactured by Byk Chemie Co., Ltd.), 700 parts of tetrahydrofuran, and 200 parts of cyclohexanone are spray-coated to the electroconductive substrate on which the charge transport layer is formed followed by drying to obtain a surface layer having a thickness of 3.5 μm.

Manufacturing of Cleaning Blade 1

The area 3 mm or less from the front end of a urethane blade having a resilient elastic ratio of 21% that contacts an image bearing member at a right angle is dipped in a liquid dispersion in which boron nitride is dispersed in water, and pulled out therefrom followed by drying. Thus, [Cleaning blade 1] is obtained which has an average amount of the boron nitride attached in the area 3 mm or less from the front end thereof of 0.2 mg/cm$^2$.

Manufacturing of Cleaning Blade 2

The area 3 mm or less from the front end of a urethane blade having a resilient elastic ratio of 21% that contacts an image bearing member at a right angle is dipped in a liquid dispersion in which boron nitride is dispersed in water, and pulled out therefrom followed by drying. Thus, [Cleaning blade 2] is obtained which has an average amount of the boron nitride attached in the area 3 mm or less from the front end thereof of 1.2 mg/cm$^2$.

Manufacturing of Cleaning Blade 3

The area 3 mm or less from the front end of a urethane blade having a resilient elastic ratio of 21% that contacts an image bearing member at a right angle is dipped in a liquid dispersion in which a mixture of metal soap containing zinc stearate, and zinc palmitate, and boron nitride is dispersed in water, and pulled out therefrom followed by drying. Thus, [Cleaning blade 3] is obtained which has an average amount of the mixture attached in the area 3 mm or less from the front end thereof of 5 mg/cm$^2$. The ratio of the zinc stearate to the zinc palmitate is 55:45 and the weight ratio of the metal soap to the boron nitride is 80:20.

[Cleaning blade 3] is analyzed by an optical emission spectrochemical analyzer (SPS 5100 type, manufactured by SII NanoTechnology Inc.) and the weight ratio of the mixture of the metal soap and the boron nitride attached to the blade is 80:20.

The powder of the mixture is prepared by placing a mixture of metal soap and boron nitride in an aluminum mold having an inner size of 8 mm×350 mm, compressing it by using a hydraulic press until the mixture is compressed to 95% of the true specific gravity to obtain a bar having a size of 7 mm×8 mm×350 mm, and pulverizing the bar.

Manufacturing of Cleaning Blade 4

The area 3 mm or less from the front end of a urethane blade having a resilient elastic ratio of 21% that contacts an image bearing member at a right angle is dipped in a liquid dispersion in which a mixture of metal soap containing zinc stearate, and zinc palmitate, and boron nitride is dispersed in water, and pulled out therefrom followed by drying. Thus, [Cleaning blade 4] is obtained which has an average amount of the mixture attached in the area 3 mm or less from the front end thereof of 0.04 mg/cm$^2$. The ratio of the zinc stearate to the zinc palmitate is 55:45 and the weight ratio of the metal soap to the boron nitride is 91:9. [Cleaning blade 4] is analyzed by an optical emission spectrochemical analyzer (SPS 5100 type, manufactured by SII NanoTechnology Inc.) and the weight ratio of the mixture of the metal soap and the boron nitride attached to the blade is 91:9.

The powder of the mixture is prepared by placing a mixture of metal soap and boron nitride in an aluminum mold having an inner size of 8 mm×350 mm, compressing it by using a hydraulic press until the mixture is compressed to 95% of the true specific gravity to obtain a bar having a size of 7 mm×8 mm×350 mm, and pulverizing the bar.

Manufacturing of Cleaning Blade 5

The area 3 mm or less from the front end of a urethane blade having a resilient elastic ratio of 21% that contacts an image bearing member at a right angle is dipped in a liquid dispersion in which a mixture of metal soap containing zinc stearate, and zinc palmitate, and boron nitride is dispersed in water, and pulled out therefrom followed by drying. Thus, [Cleaning blade 5] is obtained which has an average amount of the mixture attached in the area 3 mm or less from the front end thereof of 0.02 mg/cm$^2$. The ratio of the zinc stearate to the zinc palmitate is 55:45 and the weight ratio of the metal soap to the boron nitride is 50:50.

[Cleaning blade 5] is analyzed by an optical emission spectrochemical analyzer (SPS 5100 type, manufactured by SII NanoTechnology Inc.) and the weight ratio of the mixture of the metal soap and the boron nitride attached to the blade is 50:50.

The powder of the mixture is prepared by placing a mixture of metal soap and boron nitride in an aluminum mold having an inner size of 8 mm×350 mm, compressing it by using a hydraulic press until the mixture is compressed to 95% of the true specific gravity to obtain a bar having a size of 7 mm×8 mm×350 mm, and pulverizing the bar.

Manufacturing of Cleaning Blade 6

The area 3 mm or less from the front end of a urethane blade having a resilient elastic ratio of 21% that contacts an image bearing member at a right angle is inserted in a container that accommodates yellow toner, and pulled out therefrom. Thus, [Cleaning blade 6] is obtained which has an average amount of the yellow toner attached in the area 3 mm or less from the front end thereof of 0.2 mg/cm$^2$.

Manufacturing of Cleaning Blade 7

The area 3 mm or less from the front end of a urethane blade having a resilient elastic ratio of 21% that contacts an image bearing member at a right angle is dipped in a liquid dispersion in which carbon fluoride particles are dispersed in isopropyl ether, and pulled out therefrom followed by drying. Thus, [Cleaning blade 7] is obtained which has an average amount of the boron nitride attached in the area 3 mm or less from the front end thereof of 0.2 mg/cm$^2$.

Manufacturing of Cleaning Blade 8

The area 3 mm or less from the front end of a urethane blade having a resilient elastic ratio of 21% that contacts an image bearing member at a right angle is inserted in a container that accommodates spherical silicone resin particles, and pulled out therefrom. Thus, [Cleaning blade 8] is obtained which has an average amount of the boron nitride attached in the area 3 mm or less from the front end thereof of 0.2 mg/cm$^2$.

Manufacturing of Second Cleaning Blade 1

The area 3 mm or less from the front end of a urethane blade having a resilient elastic ratio of 20% that contacts an image bearing member at a right angle is dipped in a liquid dispersion in which boron nitride is dispersed in water, and pulled out therefrom followed by drying. Thus, [Second Cleaning blade 1] is obtained which has an average amount of the boron nitride attached in the area 3 mm or less from the front end thereof of 0.2 mg/cm$^2$.

Manufacturing of Second Cleaning Blade 2

The area 3 mm or less from the front end of a urethane blade having a resilient elastic ratio of 21% that contacts an image bearing member at a right angle is dipped in a liquid dispersion in which boron nitride is dispersed in water, and pulled out therefrom followed by drying. Thus, [Second Cleaning blade 2] is obtained which has an average amount of the boron nitride attached in the area 3 mm or less from the front end thereof of 1.2 mg/cm$^2$.

Manufacturing of Second Cleaning Blade 3

The area 3 mm or less from the front end of a urethane blade having a resilient elastic ratio of 20% that contacts an image bearing member at a right angle is dipped in a liquid dispersion in which a mixture of metal soap containing zinc stearate, and zinc palmitate, and boron nitride is dispersed in water, and pulled out therefrom followed by drying. Thus, [Second Cleaning blade 3] is obtained which has an average amount of the mixture attached in the area 3 mm or less from the front end thereof of 0.02 mg/cm$^2$. The ratio of the zinc stearate to the zinc palmitate is 55:45 and the weight ratio of the metal soap to the boron nitride is 50:50. [Second Cleaning blade 3] is analyzed by an optical emission spectrochemical analyzer (SPS 5100 type, manufactured by SII NanoTechnology Inc.) and the weight ratio of the mixture of the metal soap and the boron nitride attached to the blade is 50:50.

The powder of the mixture is prepared by placing a mixture of metal soap and boron nitride in an aluminum mold having an inner size of 8 mm×350 mm, compressing it by using a hydraulic press until the mixture is compressed to 95% of the true specific gravity to obtain a bar having a size of 7 mm×8 mm×350 mm, and pulverizing the bar.

Manufacturing of Second Cleaning Blade 4

The area 3 mm or less from the front end of a urethane blade having a resilient elastic ratio of 52% that contacts an image bearing member at a right angle is dipped in a liquid dispersion in which a mixture of metal soap containing zinc stearate, and zinc palmitate, and boron nitride is dispersed in water, and pulled out therefrom followed by drying. Thus, [Second Cleaning blade 4] is obtained which has an average amount of the mixture attached in the area 3 mm or less from the front end thereof of 0.04 mg/cm$^2$. The ratio of the zinc stearate to the zinc palmitate is 55:45 and the weight ratio of the metal soap to the boron nitride is 91:9.

[Second Cleaning blade 4] is analyzed by an ICP optical emission spectrochemical analyzer (SPS5100 type, manufactured by SII NanoTechnology Inc.) and the weight ratio of the mixture of the metal soap and the boron nitride attached to the blade is 91:9.

The powder of the mixture is prepared by placing a mixture of metal soap and boron nitride in an aluminum mold having an inner size of 8 mm×350 mm, compressing it by using a hydraulic press until the mixture is compressed to 95% of the true specific gravity to obtain a bar having a size of 7 mm×8 mm×350 mm, and pulverizing the bar.

Manufacturing of Second Cleaning Blade 5

The area 3 mm or less from the front end of a urethane blade having a resilient elastic ratio of 20% that contacts an image bearing member at a right angle is dipped in a liquid dispersion in which a mixture of metal soap containing zinc stearate, and zinc palmitate, and boron nitride is dispersed in water, and pulled out therefrom followed by drying. Thus, [Second Cleaning blade 5] is obtained which has an average amount of the mixture attached in the area 3 mm or less from the front end thereof of 0.3 mg/cm$^2$. The ratio of the zinc stearate to the zinc palmitate is 55:45 and the weight ratio of the metal soap to the boron nitride is 91:9.

Manufacturing of Second Cleaning Blade 6

The area 3 mm or less from the front end of a urethane blade having a resilient elastic ratio of 20% that contacts an image bearing member at a right angle is dipped in a liquid dispersion in which metal soap containing zinc stearate, and zinc palmitate, is dispersed in water, and pulled out therefrom followed by drying. Thus, [Second Cleaning blade 6] is obtained which has an average amount of the mixture attached in the area 3 mm or less from the front end thereof of 0.2 mg/cm$^2$. The ratio of the zinc stearate to the zinc palmitate is 55:45.

Manufacturing of Second Cleaning Blade 7

The area 3 mm or less from the front end of a urethane blade having a resilient elastic ratio of 20% that contacts an image bearing member at a right angle is inserted in a container that accommodates yellow toner, and pulled out therefrom. Thus, [Second Cleaning blade 7] is obtained which has an average amount of yellow toner attached in the area 3 mm or less from the front end thereof of 0.2 mg/cm$^2$.

Manufacturing of Protective Agent Bar 1

A mixture of metal soap containing zinc stearate and zinc plamitate is placed in an aluminum mold having an inner size of 8 mm×350 mm, and compressed by using a hydraulic press until the mixture is compressed to 95% of the true specific gravity to obtain a bar having a size of 7 mm×8 mm×350 mm.

The both ends in the longitudinal direction of the bar are severed and the bottom face is cut to obtain [Protective agent bar 1] having a dimension of 7 mm×8 mm×310 mm.

Double-faced adhesive tape is attached to the bottom of [Protective agent bar 1] to fix it to a metal support.

Manufacturing of Protective Agent Bar 2

[Protective agent bar 2] is prepared in the same manner as in the case of [Protective agent bar 1] except that powder mixture of metal soap containing zinc stearate, and zinc palmitate, and boron nitride is used. The ratio of the zinc stearate to the zinc palmitate is 66:34 and the weight ratio of the metal soap to the boron nitride is 97:3.

Manufacturing of Protective Agent Bar 3

[Protective agent bar 3] is prepared in the same manner as in the case of [Protective agent bar 1] except that powder mixture of metal soap containing zinc stearate, and zinc palmitate, and boron nitride is used. The ratio of the zinc stearate to the zinc palmitate is 69:31 and the weight ratio of the metal soap to the boron nitride is 97:3.

Manufacturing of Protective Agent Bar 4

[Protective agent bar 30] is prepared in the same manner as in the case of [Protective agent bar 1] except that powder mixture of metal soap containing zinc stearate, and zinc palmitate, and boron nitride with spherical aluminum particles having an average particle diameter of 0.3 μm is used. The ratio of the zinc stearate to the zinc palmitate is 40:60 and the weight ratio of the metal soap to the boron nitride is 70:4, and the spherical aluminum particles are added in an amount of 4% by weight based on the metal soap.

Manufacturing of Protective Agent Bar 5

[Protective agent bar 5] is prepared in the same manner as in the case of [Protective agent bar 1] except that powder mixture of metal soap containing zinc stearate, and zinc palmitate, and boron nitride with spherical aluminum particles having an average particle diameter of 0.3 μm is used. The ratio of the zinc stearate to the zinc palmitate is 50:50 and the weight ratio of the metal soap to the boron nitride is 65:4, and the spherical aluminum particles are added in an amount of 4% by weight based on the metal soap.

Example 25

In a tandem type color image forming apparatus (imagio MPC5000, manufactured by Ricoh Co., Ltd.) having multiple process cartridges 100A (refer to FIG. 3), [Cleaning blade 1], [Second cleaning blade 1], [Protective agent bar 1], and [Brush 1] in which fibers having a breadth of 5.3 denier, and a length of 3 mm are planted with a density of 5×10$^4$ fibers/inch$^2$ are used as the cleaning blade 11, the cleaning blade 31, the protective agent bar 21, and the brush 23, respectively.

Next, ISO test chart (refer to http:www.iso.org/jtc1/sc28 of ISO/IEC JTC 1/SC 28) is used as the output chart and printed on 10,000 sheets with a spring pressure of the protective agent 21 pressed against the brush 23 of 8.0 N.

As a result of observation of 10,000th image with naked eyes, the image is evaluated as high quality.

In addition, when the 10,000th image is observed with a microscope, the dots are aligned orderly.

Furthermore, when the powder attached to the cleaning blade 11 is scraped off with a spatula, and measured by an ICP optical emission spectrochemical analyzer (SPS5100 type, manufactured by SII NanoTechnology Inc.), boron is detected. That is, boron nitride is attached to the cleaning blade 11.

Next, the ISO test chart is again output on 40,000 sheets and as a result of observation of 50,000th image with naked eyes, the image is evaluated as high quality.

In addition, when the 50,000th image is observed with a microscope, the dots are aligned orderly.

Example 26

ISO Test Chart are output on 10,000 sheets in the same manner as in Example 25 except that [Cleaning blade 5],

[Second cleaning blade 3], [Protective agent bar 2], and [Brush 2] in which fibers having a breadth of 20 denier, and a length of 3 mm are planted with a density of $5\times10^4$ fibers/inch$^2$ are used as the cleaning blade 11, the cleaning blade 31, the protective agent bar 21, and the brush 23, respectively.

As a result of observation of 10,000th image with naked eyes, the formed image is evaluated as high quality. In addition, when the 10,000th image is observed with a microscope, the dots are aligned orderly.

Furthermore, when the powder attached to the cleaning blade 11 is scraped off with a spatula, and measured by an ICP optical emission spectrochemical analyzer (SPS5100 type, manufactured by SII NanoTechnology Inc.), boron is detected. That is, boron nitride is attached to the cleaning blade 11.

Next, the ISO test chart is again output on 40,000 sheets and as a result of observation of 50,000th image with naked eyes, the image is evaluated as high quality.

In addition, when the 50,000th image is observed with a microscope, the dots are aligned orderly.

Example 27

ISO Test Chart are output on 10,000 sheets in the same manner as in Example 25 except that [Cleaning blade 5], [Second cleaning blade 5], [Protective agent bar 3], and [Brush 2] in which fibers having a breadth of 20 denier, and a length of 3 mm are planted with a density of $5\times10^4$ fibers/inch$^2$ are used as the cleaning blade 11, the cleaning blade 31, the protective agent bar 21, and the brush 23, respectively, and the protective agent bar 21 is pressed against with a spring pressure of 5.0 N.

As a result of observation of 10,000th image with naked eyes, the framed image is evaluated as high quality. In addition, when the 10,000th image is observed with a microscope, the dots are aligned orderly.

Furthermore, when the powder attached to the cleaning blade 11 is scraped off with a spatula, and measured by an ICP optical emission spectrochemical analyzer (SPS5100 type, manufactured by SII NanoTechnology Inc.), boron is detected. That is, boron nitride is attached to the cleaning blade 11.

Next, the ISO test chart is again output on 40,000 sheets and as a result of observation of 50,000th image with naked eyes, the image is evaluated as high quality. In addition, when the 50,000th image is observed with a microscope, the dot density relatively slightly varies in comparison with the 50,000th image in Example 26.

Example 28

ISO Test Chart are output on 10,000 sheets in the same manner as in Example 25 except that [Cleaning blade 3], [Second cleaning blade 5], [Protective agent bar 4], and [Brush 3] in which fibers having a breadth of 10 denier, and a length of 3 mm are planted with a density of $5\times10^4$ fibers/inch$^3$ are used as the cleaning blade 11, the cleaning blade 31, the protective agent bar 21, and the brush 23, respectively, and the protective agent bar 21 is pressed against with a spring pressure of 3.2 N. As a result of observation of the 10,000th image with naked eyes, the formed image is evaluated as high quality.

In addition, when the 10,000th image is observed with a microscope, the dots are aligned orderly. Furthermore, when the powder attached to the cleaning blade 11 is scraped off with a spatula, and measured by an ICP optical emission spectrochemical analyzer (SPS5100 type, manufactured by SII NanoTechnology Inc.), boron is detected. That is, boron nitride is attached to the cleaning blade 11.

Next, the ISO test chart is again output on 40,000 sheets and as a result of observation of the 50,000th image with naked eyes, the image is evaluated as high quality.

In addition, when the 50,000th image is observed with a microscope, the dots are aligned orderly.

As a result of observation of 10th image with naked eyes, the formed image is evaluated as high quality. In addition, when the 10th image is observed with a microscope, the dots are aligned orderly.

Example 29

ISO Test Chart are output on 10,000 sheets in the same manner as in Example 25 except that [Cleaning blade 2], [Second cleaning blade 2], [Protective agent bar 1], and [Brush 3] in which fibers having a breadth of 20 denier, and a length of 3 mm are planted with a density of $3\times10^4$ fibers/inch$^2$ are used as the cleaning blade 11, the cleaning blade 31, the protective agent bar 21, and the brush 23, respectively, and the protective agent bar 21 is pressed against with a spring pressure of 3.2 N. As a result of observation of 10,000th image with naked eyes, the formed image is evaluated as high quality. In addition, when the 10,000th image is observed with a microscope, the dots are aligned orderly.

Furthermore, when the powder attached to the cleaning blade 11 is scraped off with a spatula, and measured by an ICP optical emission spectrochemical analyzer (SPS5100 type, manufactured by SII NanoTechnology Inc.), boron is detected. That is, boron nitride is attached to the cleaning blade 11.

Next, the ISO test chart is again output on 40,000 sheets and as a result of observation of 50,000th image with naked eyes, the image is evaluated as high quality. In addition, when the 50,000th image is observed with a microscope, the dots are aligned orderly.

As a result of observation of the 10th image with naked eyes, the formed image is evaluated as high quality. In addition, when the 10th image is observed with a microscope, there are portions where dots are relatively slightly spread in comparison with the 10th image in Example 28.

Example 30

In a tandem type color image forming apparatus (imagio MPC4500,manufactured by Ricoh Co., Ltd.) having multiple process cartridges 100B (refer to FIG. 4), ISO Test Chart are output on 10,000 sheets in the same manner as in Example 25 except that [Cleaning blade 4], [Second cleaning blade 4], [Protective agent bar 2], and [Brush 2], and the protective agent bar 21 is pressed against with a spring pressure of 2.8 N.

As a result of observation of 10,000th image with naked eyes, the formed image is evaluated as high quality. In addition, when the 10,000th image is observed with a microscope, the dot density relatively slightly varies in comparison with the 10,000th image in Example 26.

Furthermore, when the powder attached to the cleaning blade 11 is scraped off with a spatula, and measured by an ICP optical emission spectrochemical analyzer (SPS5100 type, manufactured by SII NanoTechnology Inc.), boron is detected. That is, boron nitride is attached to the cleaning blade 11.

Next, the ISO test chart is again output on 40,000 sheets and as a result of observation of 50,000th image with naked eyes, the image is evaluated as high quality.

In addition, when the 50,000th image is observed with a microscope, the dot density relatively slightly varies in comparison with the 50,000th image in Example 26.

Example 31

ISO Test Chart are output on 10,000 sheets in the same manner as in Example 29 except that [Cleaning blade 3], [Second cleaning blade 6], [Protective agent bar 5], and [Brush 3] are used as the cleaning blade 11, the cleaning blade 31, the protective agent bar 21, and the brush 23, respectively, and the protective agent bar 21 is pressed against with a spring pressure of 4.0 N. As a result of observation of 10,000th image with naked eyes, the formed image is evaluated as high quality.

In addition, when the 10,000th image is observed with a microscope, the dots are relatively slightly spread in comparison with the 10,000th image of Example 26.

Furthermore, when the powder attached to the cleaning blade 11 is scraped off with a spatula, and measured by an ICP optical emission spectrochemical analyzer (SPS5100 type, manufactured by SII NanoTechnology Inc.), boron is detected. That is, boron nitride is attached to the cleaning blade 11.

Next, the ISO test chart is again output on 40,000 sheets and as a result of observation of 50,000th image with naked eyes, the image is evaluated as high quality.

In addition, when the 50,000th image is observed with a microscope, the dot size is relatively slightly spread in comparison with the 50,000th image of Example 26.

Example 32

ISO Test Chart are output on 10,000 sheets in the same manner as in Example 25 except that [Cleaning blade 3], [Second cleaning blade 6], [Protective agent bar 1], and [Brush 3] are used as the cleaning blade 11, the cleaning blade 31, the protective agent bar 21, and the brush 23, respectively, and the protective agent bar 21 is pressed against with a spring pressure of 5.0 N.

As a result of observation of 10,000th image with naked eyes, the formed image is evaluated as high quality.

In addition, when the 10,000th image is observed with a microscope, the dots are aligned orderly. Furthermore, when the powder attached to the cleaning blade 11 is scraped off with a spatula, and measured by an ICP optical emission spectrochemical analyzer (SPS5100 type, manufactured by SII NanoTechnology Inc.), boron is detected. That is, boron nitride is attached to the cleaning blade 11.

Next, the ISO test chart is again output on 40,000 sheets and as a result of observation of 50,000th image with naked eyes, the image is evaluated as high quality.

In addition, when the 50,000th image is observed with a microscope, the dots are aligned orderly.

Example 33

ISO Test Chart are output on 10,000 sheets in the same manner as in Example 25 except that [Cleaning blade 2], [Second cleaning blade 6], [Protective agent bar 1], and [Brush 3] are used as the cleaning blade 11, the cleaning blade 31, the protective agent bar 21, and the brush 23, respectively, and the protective agent bar 21 is pressed against with a spring pressure of 4.0 N.

As a result of observation of 10,000th image with naked eyes, the formed image is evaluated as high quality.

In addition, when the 10,000th image is observed with a microscope, the dots are aligned orderly. Furthermore, when the powder attached to the cleaning blade 11 is scraped off with a spatula, and measured by an ICP optical emission spectrochemical analyzer (SPS5100 type, manufactured by SII NanoTechnology Inc.), boron is detected. That is, boron nitride is attached to the cleaning blade 11.

Next, the ISO test chart is again output on 40,000 sheets and as a result of observation of 50,000th image with naked eyes, the image is evaluated as high quality.

In addition, when the 50,000th image is observed with a microscope, the dots are aligned orderly.

As a result of observation of 10th image with naked eyes, the formed image is evaluated as high quality. In addition, when the 10th image is observed with a microscope, there are portions where dots are relatively slightly spread in comparison with the 10th image in Example 28 but the dots are relatively less spread than 10th image of Example 29.

Example 34

[Cleaning blade 1], [Second cleaning blade 2], [Protective agent bar 1], and [Brush 1] are used as the cleaning blade 11, the cleaning blade 31, the protective agent bar 21, and the brush 23, respectively.

Next, ISO test chart is printed on 10,000 sheets with a spring pressure of the protective agent 21 pressed against the brush 23 of 8.0 N.

As a result of observation of 10,000th image with naked eyes, the formed image is evaluated as high quality. In addition, when the 10,000th image is observed with a microscope, the dots are aligned orderly.

Furthermore, when the powder attached to the cleaning blade 11 is scraped off with a spatula, and measured by an ICP optical emission spectrochemical analyzer (SPS5100 type, manufactured by SII NanoTechnology Inc.), boron is detected. That is, boron nitride is attached to the cleaning blade 11.

Next, the ISO test chart is again output on 40,000 sheets and as a result of observation of the 50,000th image with naked eyes, the image is evaluated as high quality.

In addition, when the 50,000th image is observed with a microscope, the dots are aligned orderly.

Example 35

ISO Test Chart are output on 10,000 sheets in the same manner as in Example 25 except that [Cleaning blade 5], [Second cleaning blade 3], [Protective agent bar 1], and [Brush 2] are used as the cleaning blade 11, the cleaning blade 31, the protective agent bar 21, and the brush 23, respectively, and the protective agent bar 21 is pressed against with a spring pressure of 7.0 N.

As a result of observation of 10,000th image with naked eyes, the formed image is evaluated as high quality. In addition, when the 10,000th image is observed with a microscope, the dots are aligned orderly.

Furthermore, when the powder attached to the cleaning blade 11 is scraped off with a spatula, and measured by an ICP optical emission spectrochemical analyzer (SPS5100 type, manufactured by SII NanoTechnology Inc.), boron is detected. That is, boron nitride is attached to the cleaning blade 11.

Next, the ISO test chart is again output on 40,000 sheets and as a result of observation of 50,000th image with naked eyes, the image is evaluated as high quality.

In addition, when the 50,000th image is observed with a microscope, the dots are aligned orderly.

Comparative Example 8

ISO Test Chart are output on 10,000 sheets in the same manner as in Example 25 except that [Cleaning blade 6], [Second cleaning blade 7], [Protective agent bar 1], and [Brush 2] are used as the cleaning blade 11, the cleaning blade 31, the protective agent bar 21, and the brush 23, respectively, and the protective agent bar 21 is pressed against with a spring pressure of 3.0 N.

As a result of observation of 10,000th image with naked eyes, the formed image has found to have slight white vertical streak.

Next, the ISO test chart is again output on 40,000 sheets and as a result of observation of 50,000th image with naked eyes, the white vertical streak is thicker in dense than that of 10,000th image.

Comparative Example 9

ISO Test Chart are output on 10,000 sheets in the same manner as in Example 25 except that [Cleaning blade 7] is used as the cleaning blade 11 and spherical silicone resin particles are preliminarily applied to the image bearing member 60.

As a result of observation of 10,000th image with naked eyes, the formed image has found to have a black band.

In addition, the powder attached to the cleaning blade 11 is scraped off with a spatula and KBr is sprinkled over the powder to form a tablet. When the tablet is measured by a Fourier transform infrared spectrophotometer (FT/IR6100, manufactured by JASCO Corporation), no peak deriving from carbon fluoride is detected. That is, no carbon fluoride is present on the cleaning blade 11.

Next, the ISO test chart is again output on 40,000 sheets and as a result of observation of 50,000th image with naked eyes, the black band is thicker in dense than that of 10,000th image.

Comparative Example 10

ISO Test Chart are output on 10,000 sheets in the same manner as in Example 25 except that [Cleaning blade 8] is used as the cleaning blade 11 without using the protective agent bar 21, the brush 23, and the blade 31.

As a result of observation of 10,000th image with naked eyes, the formed image has found to have a slight black band.

Furthermore, when the powder attached to the cleaning blade 11 is scraped off with a spatula, and measured by an ICP optical emission spectrochemical analyzer (SPS5100 type, manufactured by SII NanoTechnology Inc.), silicon is detected. That is, no spherical silicone resin particles are attached to the cleaning blade 11.

Next, the ISO test chart is again output on 40,000 sheets and as a result of observation of 50,000th image with naked eyes, slight black band is observed and thin background fouling is observed in non-image portions (background portion).

In addition, the obtained image appears rough.

As described above, the image bearing member of the present disclosure and the image forming apparatus using the image bearing member are suitably and widely used in photocopiers, printers, facsimile machines, etc., and particularly full color photocopiers, full color laser printers, full color facsimile machines, etc. using a direct or indirect electrophotography multi-color image formation system.

This document claims priority and contains subject matter related to Japanese Patent Applications Nos. JP 2009-237595-A, JP 2010-196693-A, JP 2009-271869-A and JP 2009-2010-166209-A, filed on Oct. 14, 2009, Sep. 2, 2010, Nov. 30, 2009, and Jul. 23, 2010, respectively, the entire contents of which are hereby incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

an image bearing member that bears a latent electrostatic image;

a charging device that charges a surface of the image bearing member;

an irradiator that irradiates the surface of the image bearing member to form the latent electrostatic image thereon;

a development device that develops the latent electrostatic image with a development agent comprising a toner to form a visualized image;

a transfer device that transfers the visualized image to a recording medium;

a cleaning device having a cleaning blade having a front end that removes the toner remaining on the surface of the image bearing member, with a lubricant comprising boron nitride being attached to the front end; and a protective agent supplying device that supplies a protective agent comprising metal soap to the surface of the image bearing member, wherein an average attachment amount of the boron nitride in an area where the lubricant is attached is from 0.01 to 1 $mg/cm^2$.

2. The image forming apparatus according to claim 1, wherein the lubricant comprises metal soap.

3. The image forming apparatus according to claim 2, wherein a weight ratio of the boron nitride to a total weight of the boron nitride and the metal soap is 10% or greater.

4. The image forming apparatus according to claim 1, wherein the front end of the cleaning blade contacts the image bearing member against a rotation direction thereof.

5. The image forming apparatus according to claim 1, wherein the front end of the cleaning blade has an obtuse angle while in contact with the image bearing member.

6. The image forming apparatus according to claim 1, wherein the protective agent comprises boron nitride and a weight ratio of the boron nitride in the protective agent to a total weight of the boron nitride in the protective agent and the metal soap in the protective agent is 30% or less.

7. The image forming apparatus according to claim 1, further comprising a second blade having a front end that contacts the surface of the image bearing member and regulates a layer thickness of the protective agent supplied to the image bearing member, wherein a lubricant comprising boron nitride is attached to the front end of the second blade.

* * * * *